US012215897B2

(12) United States Patent
Makino et al.

(10) Patent No.: US 12,215,897 B2
(45) Date of Patent: Feb. 4, 2025

(54) AIR CONDITIONING APPARATUS AND OUTDOOR UNIT

(71) Applicant: Mitsubishi Electric Corporation, Tokyo (JP)

(72) Inventors: Hiroaki Makino, Tokyo (JP); Hirotaka Ishida, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 442 days.

(21) Appl. No.: 17/614,235

(22) PCT Filed: Jul. 22, 2019

(86) PCT No.: PCT/JP2019/028625

§ 371 (c)(1),
(2) Date: Nov. 24, 2021

(87) PCT Pub. No.: WO2021/014525

PCT Pub. Date: Jan. 28, 2021

(65) Prior Publication Data

US 2022/0214081 A1 Jul. 7, 2022

(51) Int. Cl.
*F25B 13/00* (2006.01)

(52) U.S. Cl.
CPC ..... *F25B 13/00* (2013.01); *F25B 2313/004* (2013.01); *F25B 2313/006* (2013.01); *F25B 2313/02741* (2013.01)

(58) Field of Classification Search
CPC ..... F25B 13/00; F25B 2313/004; F25B 2313/006; F25B 2313/02741
See application file for complete search history.

(56) References Cited

U.S. PATENT DOCUMENTS

2009/0282861 A1 11/2009 Setoguchi et al.
2014/0290292 A1 10/2014 Kato et al.
(Continued)

FOREIGN PATENT DOCUMENTS

JP H02-075863 A 3/1990
JP H06-213518 A 8/1994
(Continued)

OTHER PUBLICATIONS

Nakakoshi et al., Room Heating/Cooling Apparatus, Mar. 15, 1990, JPH0275863A), Whole Document (Year: 1990).*
(Continued)

*Primary Examiner* — Larry L Furdge
(74) *Attorney, Agent, or Firm* — Posz Law Group, PLC

(57) ABSTRACT

In an air conditioning apparatus, heat exchange is conducted between refrigerant passing through a first high-temperature-side flow path and refrigerant passing through a first low-temperature-side flow path of a cooler, and between refrigerant passing through a second high-temperature-side flow path and refrigerant passing through a second low-temperature-side flow path of the cooler. A switching device switches between first/second refrigerant circuits. In the first circuit, an inlet of the first high-temperature-side flow path is formed downstream of the first low-temperature-side flow path with respect to an outlet of the first high-temperature-side flow path, and in the second refrigerant circuit, an inlet of the second high-temperature-side flow path is formed downstream of the second low-temperature-side flow path with respect to an outlet of the second high-temperature-side flow path.

10 Claims, 20 Drawing Sheets

(56) References Cited

U.S. PATENT DOCUMENTS

| | | | | |
|---|---|---|---|---|
| 2015/0276271 | A1 | 10/2015 | Uselton | |
| 2017/0284713 | A1 | 10/2017 | Tanaka | |
| 2019/0330747 | A1* | 10/2019 | Ishida | C23C 30/00 |

FOREIGN PATENT DOCUMENTS

| | | | |
|---|---|---|---|
| JP | 2009-228979 | A | 10/2009 |
| JP | 2010-002109 | A | 1/2010 |
| JP | 2010-031728 | A | 2/2010 |
| JP | WO2013/080244 | A1 | 6/2013 |
| JP | 2016-020760 | A | 2/2016 |
| WO | 2016/071955 | A1 | 5/2016 |

OTHER PUBLICATIONS

Extended European Search Report dated Aug. 1, 2022 issued in corresponding EP Patent Application No. 19938900.8.

Japanese Office Action dated Sep. 6, 2022 issued in corresponding JP Patent Application No. 2021-534881 (and English machine translation).

Japanese Office Action mailed Feb. 21, 2023 in corresponding Japanese Patent Application No. 2021-534881 (and English machine translation).

International Search Report of the International Searching Authority mailed Aug. 27, 2019 for the corresponding international application No. PCT/JP2019/028625 (English translation only).

* cited by examiner

AIR CONDITIONING APPARATUS AND OUTDOOR UNIT

CROSS REFERENCE TO RELATED APPLICATION

This application is a U.S. national stage application of International Application No. PCT/JP2019/028625, filed on Jul. 22, 2019, the contents of which are incorporated herein by reference.

TECHNICAL FIELD

The present disclosure relates to an air conditioning apparatus and an outdoor unit used in the air conditioning apparatus.

BACKGROUND

In the related art, there is an air conditioning apparatus including a compressor, a flow path switching device, a heat source-side heat exchanger, a pressure-reducing device, and a load-side heat exchanger. Such an air conditioning apparatus is capable of switching between a first refrigerant circuit in which the heat source-side heat exchanger functions as a condenser and the load-side heat exchanger functions as an evaporator, and a second refrigerant circuit in which the heat source-side heat exchanger functions as an evaporator and the load-side heat exchanger functions as a condenser.

Particularly, Patent Document 1 discloses an air conditioning apparatus including a main refrigerant circuit that includes a supercooling heat exchanger between a load-side heat exchanger (corresponding to an indoor heat exchanger in Patent Document 1) and a pressure-reducing device (corresponding to an expansion valve in Patent Document 1), and a bypass piping that branches from between the pressure-reducing device and the supercooling heat exchanger to be connected to a suction side of a compressor via a supercooling expansion valve and the supercooling heat exchanger. In addition, in the air conditioning apparatus disclosed in Patent Document 1, in a second refrigerant circuit in which the load-side heat exchanger functions as a condenser, a refrigerant in a gas-liquid two-phase state flows out from the load-side heat exchanger, the refrigerant in a gas-liquid two-phase state is cooled into a liquid state by the supercooling heat exchanger, and the refrigerant in a liquid state flows into the pressure-reducing device. In the air conditioning apparatus of Patent Document 1, with these configurations, the charge amount of the refrigerant is reduced, and the refrigerant in a gas-liquid two-phase state is prevented from flowing into the pressure-reducing device.

PATENT DOCUMENT

[Patent Document 1]

Japanese Unexamined Patent Application, First Publication No. 2016-20760

However, in the air conditioning apparatus of Patent Document 1, the refrigerant amount can be reduced in the second refrigerant circuit in which a heat source-side heat exchanger functions as an evaporator and the load-side heat exchanger functions as a condenser, but the refrigerant amount cannot be reduced in a first refrigerant circuit in which the heat source-side heat exchanger functions as a condenser and the load-side heat exchanger functions as an evaporator.

Generally, the refrigerant to be charged into the air conditioning apparatus is charged at an amount according to the refrigerant amount in an operation state requiring the refrigerant at maximum. Therefore, in a case that the refrigerant amount required for the first refrigerant circuit is larger than the refrigerant amount required for the second refrigerant circuit, in the air conditioning apparatus of Patent Document 1, the charge amount of the refrigerant cannot be reduced.

SUMMARY

An object of the present disclosure is to provide an air conditioning apparatus and an outdoor unit that have an effect of being capable of reducing the charge amount of a refrigerant in both a first refrigerant circuit and a second refrigerant circuit.

According to one aspect of the present disclosure, there is provided an air conditioning apparatus including: a compressor that compresses a refrigerant; a pressure-reducing device that reduces a pressure of the refrigerant; a heat source-side heat exchanger that makes heat exchange to be conducted between the refrigerant and a heat source-side heat medium; a load-side heat exchanger that makes heat exchange to be conducted between the refrigerant and a load-side heat medium; a cooler that cools the refrigerant; a flow path switching device that switches a refrigerant circuit in which the refrigerant circulates; and a refrigerant piping that connects the compressor, the pressure-reducing device, the heat source-side heat exchanger, the load-side heat exchanger, the cooler, and the flow path switching device. The flow path switching device switches between a first refrigerant circuit in which the refrigerant circulates in order of the compressor, the heat source-side heat exchanger, the cooler, the pressure-reducing device, the load-side heat exchanger, and the compressor and a second refrigerant circuit in which the refrigerant circulates in order of the compressor, the load-side heat exchanger, the cooler, the pressure-reducing device, the heat source-side heat exchanger, and the compressor.

According to an aspect of the present disclosure, there is provided an outdoor unit including: a compressor that compresses a refrigerant; a pressure-reducing device that reduces a pressure of the refrigerant; a heat source-side heat exchanger that makes heat exchange to be conducted between the refrigerant and a heat source-side heat medium; a cooler that cools the refrigerant; a flow path switching device that switches a refrigerant circuit in which the refrigerant circulates; a refrigerant piping that connects the compressor, the pressure-reducing device, the heat source-side heat exchanger, the cooler, and the flow path switching device; a first piping connection portion connected to one end portion of a load-side heat exchanger flow path, which is formed in a load-side heat exchanger that makes heat exchange to be conducted between the refrigerant and a load-side heat medium, via a piping; and a second piping connection portion connected to the other end portion of the load-side heat exchanger flow path via a piping. The flow path switching device switches between a first refrigerant circuit in which the refrigerant flows in order of the second piping connection portion, the compressor, the heat source-side heat exchanger, the cooler, the pressure-reducing device, and the first piping connection portion and a second refrigerant circuit in which the refrigerant flows in order of the first piping connection portion, the cooler, the pressure-reducing device, the heat source-side heat exchanger, the compressor, and the second piping connection portion.

The air conditioning apparatus and the outdoor unit according to one aspect of the present disclosure have an effect of being capable of reducing the charge amount of the refrigerant in both the first refrigerant circuit and the second refrigerant circuit.

DETAILED DESCRIPTION

Air conditioning apparatuses according to embodiments of the present disclosure will be described in detail with reference to the drawings. Incidentally, the present disclosure is not limited only to the following embodiments, and modifications or omissions can be made without departing from the concept of the present disclosure. Further, configurations of the air conditioning apparatuses, configurations of outdoor units, and additional configurations according to the embodiments and modified examples can also be appropriately combined.

Embodiment I

Figure 1:
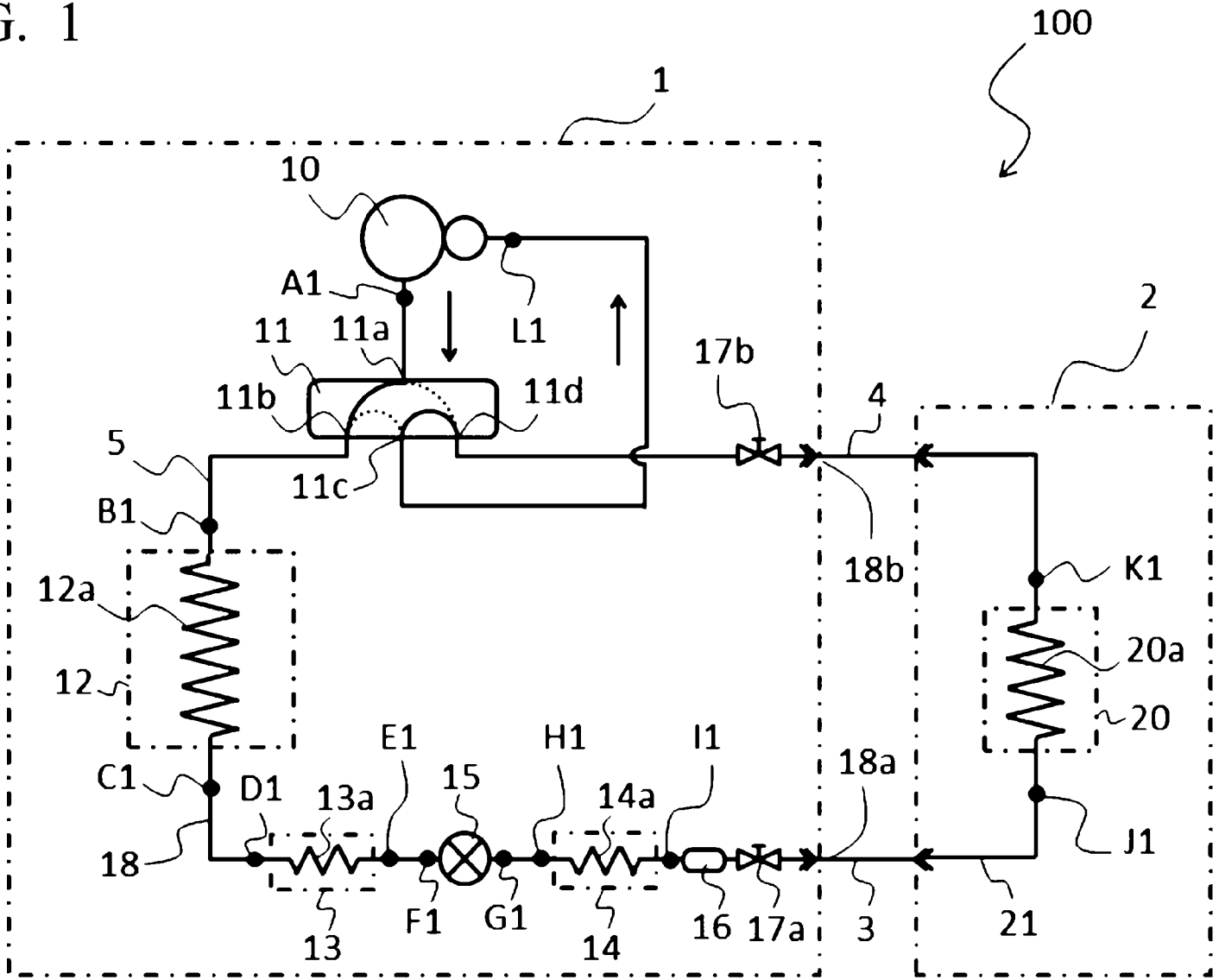
FIG. 1 is a refrigerant circuit diagram of an air conditioning apparatus according to an embodiment I.

FIG. 1 is a refrigerant circuit diagram of an air conditioning apparatus according to an embodiment I. An air conditioning apparatus 100 according to the embodiment I will be described. The air conditioning apparatus 100 includes an outdoor unit 1 and an indoor unit 2. The outdoor unit 1 and the indoor unit 2 are connected to each other by a first connection refrigerant piping 3 and a second connection refrigerant piping 4. The outdoor unit 1, the indoor unit 2, the first connection refrigerant piping 3, and the second connection refrigerant piping 4 form a refrigerant circuit 5 in which a refrigerant circulates.

The air conditioning apparatus 100 is capable of performing two types of operations, namely, a cooling operation of cooling air in an air conditioning target space such as a room in a building and a heating operation of heating air in the air conditioning target space. Since the refrigerant circuit 5 changes between the cooling operation and the heating operation, when the refrigerant circuit 5 is described in a distinguished manner, the refrigerant circuit 5 during the cooling operation is referred to as a first refrigerant circuit 5*a*, and the refrigerant circuit 5 during the heating operation is referred to as a second refrigerant circuit 5*b*.

As the refrigerant circulating in the refrigerant circuit 5, a refrigerant is used which evaporates or condenses in an outdoor heat exchanger 12 and an indoor heat exchanger 20 to be described later. Specifically, in the air conditioning apparatus 100 according to the embodiment I, a case in which R290 that has a relatively low global warming potential (GWP) and is highly flammable is used as the refrigerant will be described.

Next, the outdoor unit 1 according to the embodiment I will be described. The outdoor unit 1 includes a compressor 10, a four-way valve 11, the outdoor heat exchanger 12, a first cooler 13, a second cooler 14, an expansion valve 15, a strainer 16, and two shutoff valves 17 inside a housing, and these components are connected to each other by an outdoor unit refrigerant piping 18. The outdoor unit refrigerant piping 18 is provided with a first piping connection portion 18*a* connected to one end portion of an indoor heat exchanger flow path 20*a*, which is formed in the indoor heat exchanger 20 to be described, via the first connection refrigerant piping 3, and a second piping connection portion 18*b* connected to the other end portion of the indoor heat exchanger flow path 20*a* via the second connection refrigerant piping 4.

The compressor 10 compresses the refrigerant which has been suctioned from a suction port to be in a high-temperature and high-pressure gas state, and discharges the refrigerant from a discharge port. The compressor 10 may be formed of, for example, an inverter compressor or the like of which the capacity can be controlled. In the air conditioning apparatus 100 according to the embodiment I, a case in which polyalkylene glycol is used as a chiller oil of the compressor 10 will be described.

The four-way valve 11 switches between the first refrigerant circuit 5*a* and the second refrigerant circuit 5*b*. Specifically, the four-way valve 11 includes a total of four ports, namely, a first port 11*a*, a second port 11*b*, a third port 11*c*, and a fourth port 11*d*. The first port 11*a* is connected to the discharge port of the compressor 10 via the outdoor unit refrigerant piping 18. The second port 11*b* is connected to one end portion of an outdoor heat exchanger flow path 12*a* to be described later via the outdoor unit refrigerant piping 18. The third port 11*c* is connected to the suction port of the compressor via the outdoor unit refrigerant piping 18. The fourth port 11*d* is connected to the other end portion of the indoor heat exchanger flow path 20*a* to be described later via a second shutoff valve 17*b*, the outdoor unit refrigerant piping 18, the second connection refrigerant piping 4, and an indoor unit refrigerant piping 21 to be described later.

The outdoor heat exchanger 12 makes heat exchange to be conducted between air in an outdoor space and the refrigerant passing through the outdoor heat exchanger flow path 12*a* formed inside the outdoor heat exchanger 12. The other end portion of the outdoor heat exchanger flow path 12*a* is connected to one end portion of a first cooler flow path 13*a* of the first cooler 13 to be described later via the outdoor unit refrigerant piping 18. Incidentally, a specific structure of the outdoor heat exchanger 12 will be described later. In the air conditioning apparatus 100 according to the embodiment I, the air in the outdoor space corresponds to a heat source-side heat medium. Incidentally, the heat source-side heat medium is a medium that exchanges heat with the refrigerant in a heat source-side heat exchanger (corresponding to the outdoor heat exchanger 12).

The first cooler flow path 13*a* is formed in the first cooler 13. The first cooler 13 cools the refrigerant passing through the first cooler flow path 13*a*. The other end portion of the first cooler flow path 13*a* is connected to one end portion of a second cooler flow path 14*a* of the second cooler 14 to be described later via the outdoor unit refrigerant piping 18 and the expansion valve 15.

The second cooler flow path 14*a* is formed in the second cooler 14. The second cooler 14 cools the refrigerant passing through the second cooler flow path 14*a*. The other end portion of the second cooler flow path 14*a* is connected to one end portion of the indoor heat exchanger flow path 20*a* via the outdoor unit refrigerant piping 18, the strainer 16, a first shutoff valve 17*a*, the first connection refrigerant piping 3, and the indoor unit refrigerant piping 21.

Incidentally, a method for cooling the refrigerant in the first cooler 13 and the second cooler 14 of the air conditioning apparatus 100 according to the embodiment I is not particularly limited. Namely, as long as the configuration is such that the refrigerant passing through the first cooler flow path 13*a* and the refrigerant passing through the second cooler flow path 14*a* can be cooled, the first cooler 13 and the second cooler 14 may use any cooling method.

The expansion valve 15 reduces the pressure of the passing refrigerant. The expansion valve 15 may be formed of, for example, an electronic expansion valve or the like such that a conical needle is inserted into a hole having a predetermined hole diameter, and the position of the needle is controlled to control the opening area of the hole to an arbitrary size, thereby, the flow rate of the refrigerant is arbitrarily adjusted.

The strainer 16 separates impurities from the passing refrigerant. Exemplary examples of the impurities to be separated by the strainer 16 include foreign matter introduced into the refrigerant circuit during piping work, metal powder delaminated from the outdoor unit refrigerant piping 18, products generated by a chemical change of the refrigerant, and the like.

The first shutoff valve 17*a* and the second shutoff valve 17*b* open or close the refrigerant circuit 5. The first shutoff valve 17*a* and the second shutoff valve 17*b* each are formed of, for example, a two-way valve, or the like.

The indoor unit 2 includes the indoor heat exchanger 20 inside a housing. The indoor heat exchanger 20 is connected to the first connection refrigerant piping 3 and the second connection refrigerant piping 4 by the indoor unit refrigerant piping 21.

The indoor heat exchanger 20 makes heat exchange between the air in the air conditioning target space and the refrigerant passing through the indoor heat exchanger flow path 20*a* formed inside the indoor heat exchanger 20. The volume of the indoor heat exchanger 20 is smaller than the volume of the outdoor heat exchanger 12. Incidentally, the volume of the indoor heat exchanger 20 corresponds to the volume of the indoor heat exchanger flow path 20*a*, and the volume of the outdoor heat exchanger 12 corresponds to the volume of the outdoor heat exchanger flow path 12*a*. In the air conditioning apparatus 100 according to the embodiment I, the air in the air conditioning target space corresponds to a load-side heat medium. Incidentally, the load-side heat medium is a medium that exchanges heat with the refrigerant in a load-side heat exchanger (corresponding to the indoor heat exchanger 20).

Figure 2:
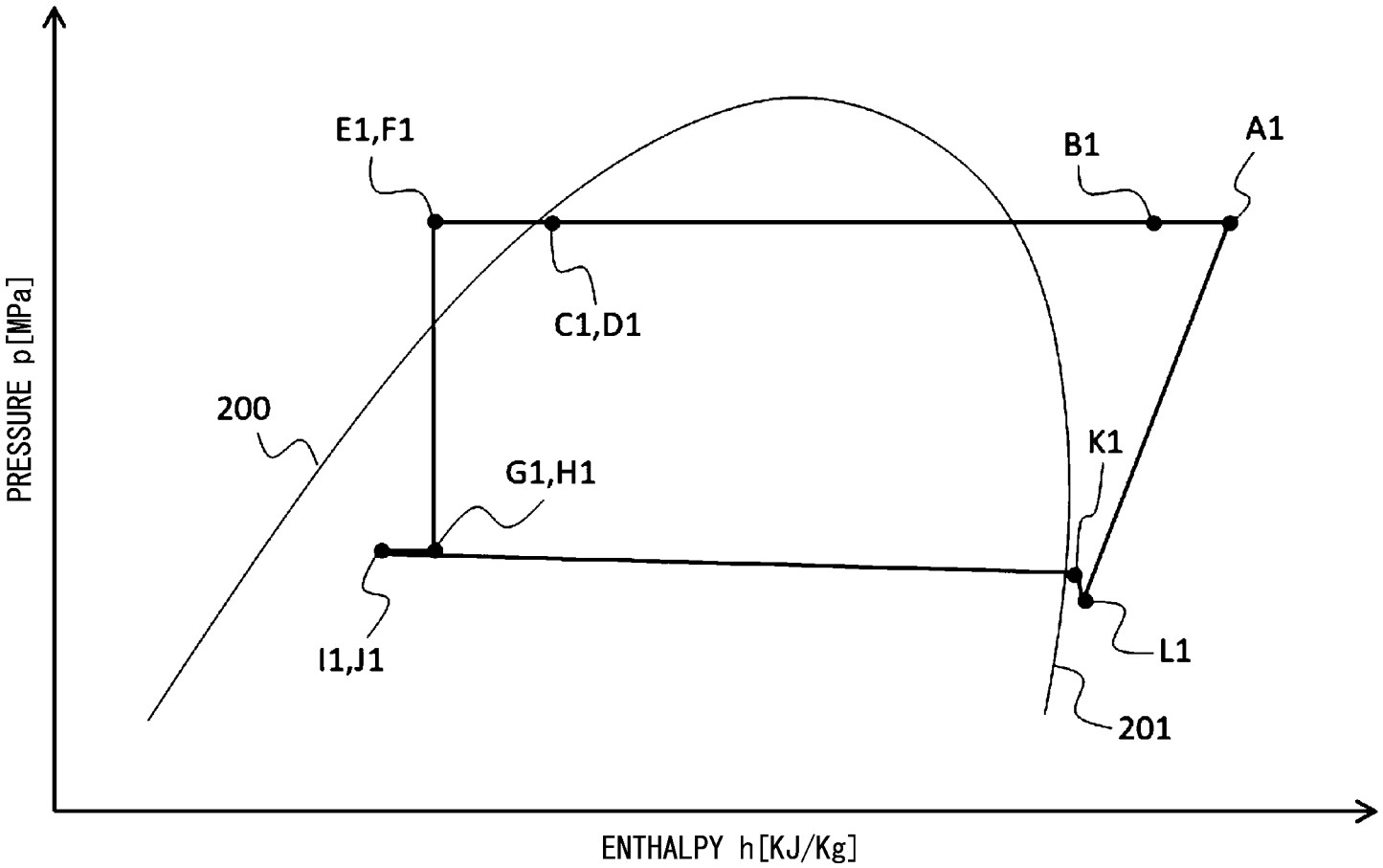
FIG. 2 is a pressure-enthalpy diagram showing a refrigeration cycle in a first refrigerant circuit of the air conditioning apparatus according to the embodiment I.

FIG. 2 is a pressure-enthalpy diagram showing a refrigeration cycle in the first refrigerant circuit of the air conditioning apparatus according to the embodiment I. Next, a flow of the refrigerant circulating in the first refrigerant circuit 5*a* will be described. In the first refrigerant circuit 5*a*, the four-way valve 11 switches to a flow path shown by a solid line in FIG. 1. Namely, in the first refrigerant circuit 5*a*, the four-way valve 11 is in a state where the first port 11*a* and the second port 11*b* are connected to each other and the third port 11*c* and the fourth port 11*d* are connected to each other. Incidentally, the horizontal axis of the pressure-enthalpy diagram in FIG. 2 or the like of the present disclosure is enthalpy [kJ/kg], and the vertical axis is pressure [Mpa]. The pressure-enthalpy diagram in FIG. 2 or the like of the present disclosure shows a saturated liquid line 200 and a saturated vapor line 201 in addition to the refrigeration cycle. The state of the refrigerant showed by A1-L1 in FIG. 2 corresponds to the state of the refrigerant in A1-L1 of the refrigerant circuit of the air conditioning apparatus 100 showed in FIG. 1.

First, the refrigerant in a high-temperature and high-pressure gas state (A1) which has been discharged from the compressor 10 flows into the outdoor heat exchanger flow path 12*a* (B1). Due to heat loss of the refrigerant when passing through the outdoor unit refrigerant piping 18, the refrigerant (B1) flowing into the outdoor heat exchanger flow path 12*a* is a refrigerant in a gas state which has a lower enthalpy than the refrigerant (A1) immediately before being discharged from the compressor 10. In the first refrigerant circuit 5*a*, the outdoor heat exchanger 12 functions as a condenser, and the refrigerant passing through the outdoor heat exchanger flow path 12*a* is cooled by the air in the outdoor space. The cooled refrigerant goes into a high-pressure gas-liquid two-phase state, and flows out from the outdoor heat exchanger flow path 12*a* (C1).

The refrigerant that has flowed out from the outdoor heat exchanger flow path 12*a* flows into the first cooler flow path 13*a* (D1). The refrigerant in a high-pressure gas-liquid two-phase state passing through the first cooler flow path 13*a* is cooled into a high-pressure liquid state, and the refrigerant in a high-pressure liquid state flows out from the first cooler flow path 13*a* (E1).

The refrigerant that has flowed out from the first cooler flow path 13*a* flows into the expansion valve 15 (F1). The refrigerant in a high-pressure liquid state which has flowed into the expansion valve 15 is reduced in pressure into a low-pressure gas-liquid two-phase state, and the refrigerant in a low-pressure gas-liquid two-phase state flows out from the expansion valve 15 (G1).

The refrigerant that has flowed out from the expansion valve 15 flows into the second cooler flow path 14*a* (H1). The refrigerant passing through the second cooler flow path 14*a* is cooled, and the refrigerant in a gas-liquid two-phase state which has a lower enthalpy than the refrigerant immediately before flowing into the second cooler flow path 14*a* flows out from the second cooler flow path 14*a* (I1).

Here, in the first refrigerant circuit 5*a*, the cooling amount of the refrigerant passing through the first cooler flow path 13*a* is preferably larger than the cooling amount of the refrigerant passing through the second cooler flow path 14*a*.

The refrigerant that has flowed out from the second cooler flow path 14*a* flows into the indoor heat exchanger flow path 20*a* (J1). In the first refrigerant circuit 5*a*, the indoor heat exchanger 20 functions as an evaporator, and the refrigerant passing through the indoor heat exchanger flow path 20*a* is heated by the air in the air conditioning target space. The heated refrigerant goes into a gas state, and flows out from the indoor heat exchanger flow path 20*a* (K1). Due to pressure loss in the indoor heat exchanger flow path 20*a*, the pressure of the refrigerant (K1) flowing from the indoor heat exchanger flow path 20*a* is lower than the pressure of the refrigerant (J1) immediately before flowing into the indoor heat exchanger flow path 20*a*. Incidentally, the air in the air conditioning target space is cooled by the refrigerant passing through the indoor heat exchanger flow path 20*a*.

Due to pressure loss of the refrigerant when passing through the indoor unit refrigerant piping 21, the second connection refrigerant piping 4, and the outdoor unit refrigerant piping 18, the refrigerant that has flowed out from the indoor heat exchanger flow path 20*a* becomes the refrigerant in a gas state of which the pressure has been more reduced than that of the refrigerant (K1) immediately after having flowed out from the indoor heat exchanger flow path 20*a*, and the refrigerant in a gas state is suctioned into the suction port of the compressor 10 (L1). The refrigerant that has been suctioned from the suction port of the compressor 10 is discharged again in a high-temperature and high-pressure gas state (A1).

Figure 3:
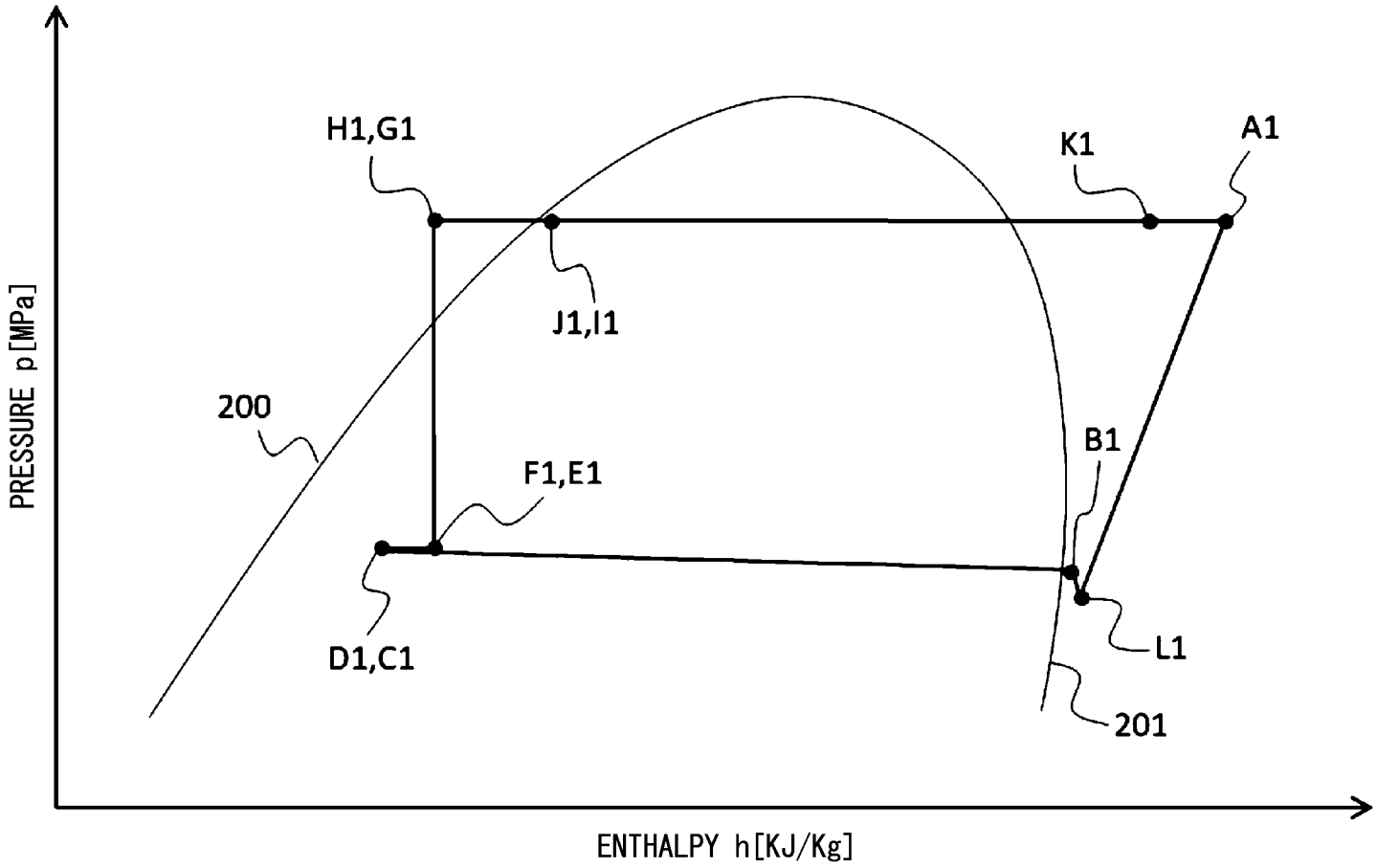
FIG. 3 is a pressure-enthalpy diagram showing a refrigeration cycle in a second refrigerant circuit of the air conditioning apparatus according to the embodiment I.

FIG. 3 is a pressure-enthalpy diagram showing a refrigeration cycle in the second refrigerant circuit of the air conditioning apparatus according to the embodiment I. Next, a flow of the refrigerant circulating in the second refrigerant circuit 5*b* will be described. In the second refrigerant circuit 5*b*, the four-way valve 11 switches to a flow path showed by a dotted line in FIG. 1. Namely, in the second refrigerant circuit 5*b*, the four-way valve 11 is in a state where the first port 11*a* and the fourth port 11*d* are connected to each other and the second port 11*b* and the third port 11*c* are connected to each other. Incidentally, the state of the refrigerant showed by A1-L1 in FIG. 3 corresponds to the state of the refrigerant in A1-L1 of the refrigerant circuit of the air conditioning apparatus 100 showed in FIG. 1.

First, the refrigerant in a high-temperature and high-pressure gas state (A1) which has been discharged from the compressor 10 flows into the indoor heat exchanger flow path 20*a* (K1). Due to heat loss of the refrigerant when passing through the outdoor unit refrigerant piping 18, the second connection refrigerant piping 4, and the indoor unit refrigerant piping 21, the refrigerant (K1) flowing into the indoor heat exchanger flow path 20*a* is a refrigerant in a gas state which has a lower enthalpy than the refrigerant (A1) immediately before being discharged from the compressor 10. In the second refrigerant circuit 5*b*, the indoor heat exchanger 20 functions as a condenser, and the refrigerant passing through the indoor heat exchanger flow path 20*a* is cooled by the air in the air conditioning target space. The cooled refrigerant goes into a high-pressure gas-liquid two-phase state, and flows out from the indoor heat exchanger flow path 20*a* (J1). Incidentally, the air in the air conditioning target space is heated by the refrigerant passing through the indoor heat exchanger flow path 20*a*.

The refrigerant that has flowed out from the indoor heat exchanger flow path 20*a* flows into the second cooler flow path 14*a* (I1). The refrigerant in a high-pressure gas-liquid two-phase state which passes through the second cooler flow path 14*a* is cooled into a high-pressure liquid state, and the refrigerant in a high-pressure liquid state flows out from the second cooler flow path 14*a* (H1).

The refrigerant that has flowed out from the second cooler flow path 14*a* flows into the expansion valve 15 (G1). The refrigerant in a high-pressure liquid state which has flowed into the expansion valve 15 is reduced in pressure into a low-pressure gas-liquid two-phase state, and the refrigerant in a low-pressure gas-liquid two-phase state flows out from the expansion valve 15 (F1).

The refrigerant that has flowed out from the expansion valve 15 flows into the first cooler flow path 13*a* (E1). The refrigerant passing through the first cooler flow path 13*a* is cooled, and the refrigerant in a gas-liquid two-phase state which has a lower enthalpy than the refrigerant immediately before flowing into the first cooler flow path 13*a* flows out from the first cooler flow path 13*a* (D1).

Here, in the second refrigerant circuit 5*b*, the cooling amount of the refrigerant passing through the second cooler flow path 14*a* is preferably larger than the cooling amount of the refrigerant passing through the first cooler flow path 13*a*.

The refrigerant that has flowed out from the first cooler flow path 13*a* flows into the outdoor heat exchanger flow path 12*a* (C1). In the second refrigerant circuit 5*b*, the outdoor heat exchanger 12 functions as an evaporator, and the refrigerant passing through the outdoor heat exchanger flow path 12*a* is heated by the air in the outdoor space. The heated refrigerant goes into a gas state, and flows out from the outdoor heat exchanger flow path 12*a* (B1). Due to pressure loss in the outdoor heat exchanger flow path 12*a*, the pressure of the refrigerant (B1) flowing out from the outdoor heat exchanger flow path 12*a* is lower than the pressure of the refrigerant (C1) immediately before flowing into the outdoor heat exchanger flow path 12*a*.

Due to pressure loss of the refrigerant when passing through the outdoor unit refrigerant piping 18, the refrigerant that has flowed out from the outdoor heat exchanger flow path 12*a* becomes a refrigerant in a gas state of which the pressure has been more reduced than that of the refrigerant (K1) immediately after having flowed out from the indoor heat exchanger flow path 20*a*, and the refrigerant in a gas state is suctioned into the suction port of the compressor 10 (L1). The refrigerant that has been suctioned from the suction port of the compressor 10 is discharged again in a high-temperature and high-pressure gas state (A1).

As described above, the air conditioning apparatus 100 according to the embodiment I includes the cooler (corresponding to the first cooler 13 in the first refrigerant circuit 5*a* and corresponding to the second cooler 14 in the second refrigerant circuit 5*b*) that cools the refrigerant flowing from the heat exchanger functioning as a condenser to the expansion valve 15 in both the first refrigerant circuit 5*a* and the second refrigerant circuit 5*b*.

In the air conditioning apparatus 100 according to the embodiment I, the refrigerant flowing from the heat exchanger functioning as a condenser to the cooler (corresponding to the first cooler 13 in the first refrigerant circuit 5*a* and corresponding to the second cooler 14 in the second refrigerant circuit 5*b*) is in a gas-liquid two-phase state in both the first refrigerant circuit 5*a* and the second refrigerant circuit 5*b*.

In the air conditioning apparatus 100 according to the embodiment I, the refrigerant flowing from the cooler (corresponding to the first cooler 13 in the first refrigerant circuit 5*a* and corresponding to the second cooler 14 in the second refrigerant circuit 5*b*) to the expansion valve 15 is in a liquid state in both the first refrigerant circuit 5*a* and the second refrigerant circuit 5*b*.

Figure 4:
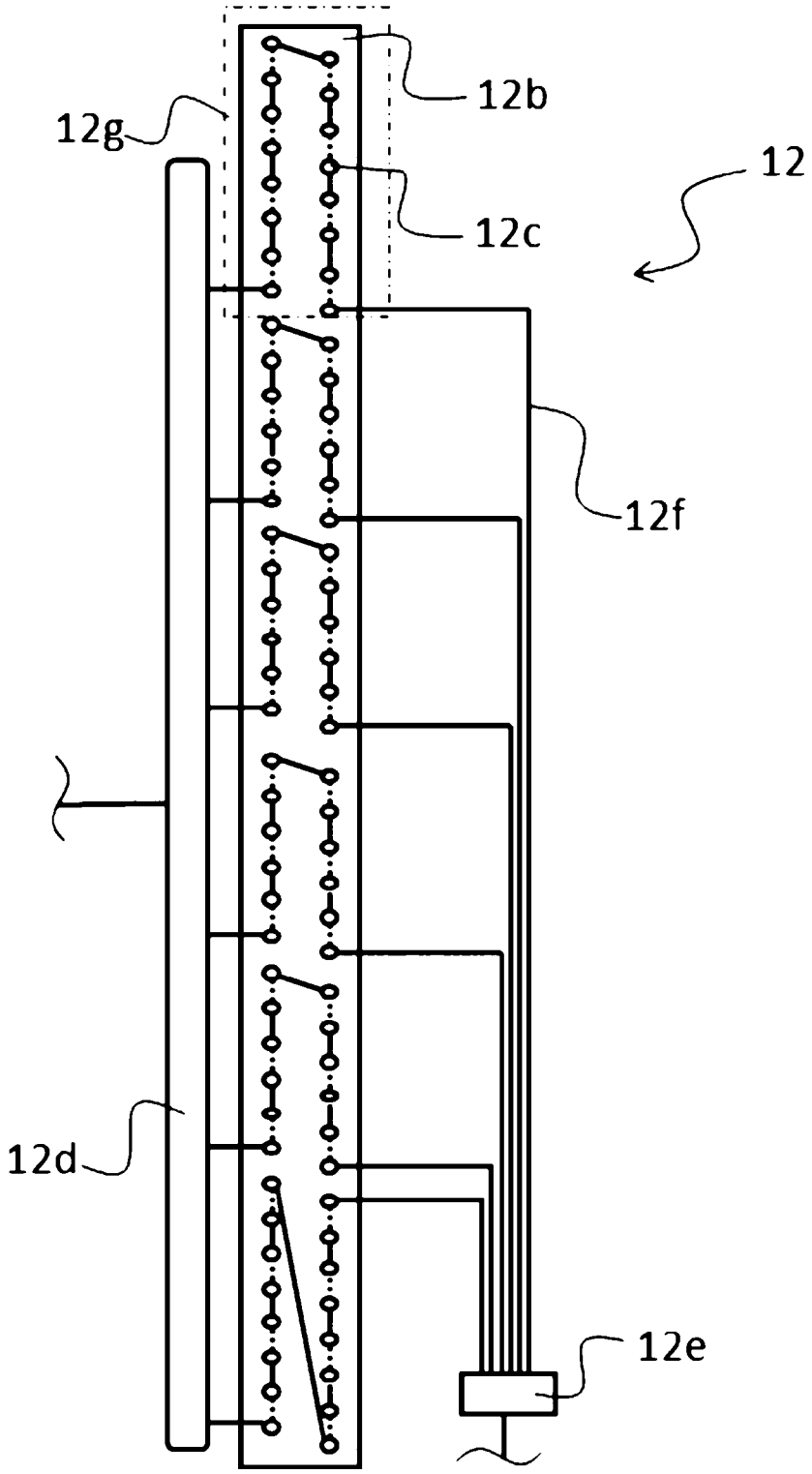
FIG. 4 is a schematic view of an outdoor heat exchanger of the air conditioning apparatus according to the embodiment I.

FIG. 4 is a schematic view of the outdoor heat exchanger of the air conditioning apparatus according to the embodiment I. Next, a structure of the outdoor heat exchanger 12 will be described. The outdoor heat exchanger 12 includes a radiation fin 12*b*, a heat transfer pipe 12*c*, a header 12*d*, a distributor 12*e*, and a capillary pipe 12*f*.

The radiation fin 12*b* is a plate-shaped metallic member, and a plurality of the radiation fins 12*b* are arranged in parallel at predetermined intervals. In the embodiment I, the radiation fins 12*b* are arranged in a vertical direction of the drawing sheet in FIG. 4.

The heat transfer pipe 12*c* is a piping through which the refrigerant flows, and a plurality of the heat transfer pipes 12*c* are provided to penetrate through the radiation fins 12*b* in a direction orthogonal to the plane of the radiation fin 12*b* (vertical direction of the drawing sheet in FIG. 4). The plurality of heat transfer pipes 12*c* are partly connected to each other by U-shaped pipes not showed, so that a plurality of unit flow paths 12*g* are formed. In the outdoor heat exchanger according to the embodiment I, six unit flow paths 12*g* are formed. The heat transfer pipes 12*c* are attached to the radiation fins 12*b* such that heat of the refrigerant flowing through the heat transfer pipes 12*c* is capable of moving to the radiation fins 12*b*.

The header 12*d* distributes or collects the inflowing refrigerant. The header 12*d* is connected to the second port 11*b* of the four-way valve 11 via the outdoor unit refrigerant piping 18. The header 12*d* is connected to one end portions of the plurality of unit flow paths 12*g*. Therefore, in the first refrigerant circuit 5*a*, the header 12*d* distributes the refrigerant in a gas state, which has been discharged from the compressor 10, to each of the plurality of unit flow paths 12*g*. Further, in the second refrigerant circuit 5*b*, the header 12*d* collects the refrigerant in a gas-liquid two-phase state which has passed through the unit flow paths 12*g*.

The distributor 12*e* distributes or collects the inflowing refrigerant. The distributor 12*e* is connected to the one end portion of the first cooler flow path 13*a* via the outdoor unit refrigerant piping 18. The distributor 12*e* is connected to the other end portions of the plurality of unit flow paths 12*g* via the capillary pipe 12*f*. Therefore, in the first refrigerant circuit 5*a*, the distributor 12*e* collects the refrigerant in a gas-liquid two-phase state which has passed through the unit flow paths 12*g*. Further, in the second refrigerant circuit 5*b*, the distributor 12*e* distributes the refrigerant in a gas state, which has passed through the first cooler flow path 13*a*, to each of the plurality of unit flow paths 12*g*.

A flow path of the header 12*d*, a flow path of the distributor 12*e*, the capillary pipe 12*f*, and the unit flow paths 12*g* correspond to the outdoor heat exchanger flow path 12*a*. Further, the volume of the outdoor heat exchanger 12 is the total volume of the volume of the flow path of the header 12*d*, the volume of the flow path of the distributor 12*e*, the volume of a plurality of the capillary pipes 12*f*, and the volume of the plurality of unit flow paths 12*g*.

As described above, the air conditioning apparatus 100 according to the embodiment I includes the cooler (corresponding to the first cooler 13 and the second cooler 14) that cools the refrigerant. A flow path switching device (corresponding to the four-way valve 11) of the air conditioning apparatus 100 switches between the first refrigerant circuit 5*a* and the second refrigerant circuit 5*b*. In the first refrigerant circuit 5*a*, the refrigerant circulates in order of the compressor 10, the heat source-side heat exchanger (corresponding to the outdoor heat exchanger 12), the cooler (corresponding to the first cooler 13), a pressure-reducing device (corresponding to the expansion valve 15), the load-side heat exchanger (corresponding to the indoor heat exchanger 20), and the compressor 10. In the second refrigerant circuit 5*b*, the refrigerant circulates in order of the compressor 10, the load-side heat exchanger, the cooler (corresponding to the second cooler 14), the pressure-reducing device, the heat source-side heat exchanger, and the compressor 10. With this configuration, the air conditioning apparatus 100 according to the embodiment I is capable of including the cooler (corresponding to the first cooler 13 in the first refrigerant circuit 5*a* and corresponding to the second cooler 14 in the second refrigerant circuit 5*b*) that cools the refrigerant flowing from the heat exchanger functioning as a condenser to the pressure-reducing device in both the first refrigerant circuit 5*a* and the second refrigerant circuit 5*b*. With this configuration, the air conditioning apparatus 100 according to the embodiment I has the effect that the refrigerant flowing from the heat exchanger functioning as a condenser to the cooler is capable of going into a gas-liquid two-phase state in both the first refrigerant circuit 5*a* and the second refrigerant circuit 5*b*.

Further, as an additional configuration, the air conditioning apparatus 100 according to the embodiment I has a configuration in which the refrigerant flowing from the heat source-side heat exchanger to the cooler is in a gas-liquid two-phase state in the first refrigerant circuit 5*a*, and the refrigerant flowing from the load-side heat exchanger to the cooler is in a gas-liquid two-phase state in the second refrigerant circuit 5*b*. With this additional configuration, the refrigerant flowing out from the heat exchanger functioning as a condenser in both the first refrigerant circuit 5*a* and the second refrigerant circuit 5*b* goes into a gas-liquid two-phase state, so that the air conditioning apparatus 100 according to the embodiment I has an effect of being capable of more reducing the refrigerant amount required for operation than when the refrigerant flowing out from the heat exchanger functioning as a condenser is in a liquid state.

Further, as an additional configuration, the air conditioning apparatus 100 according to the embodiment I has a configuration in which the refrigerant flowing from the cooler to the pressure-reducing device is in a liquid state in the first refrigerant circuit 5*a*, and the refrigerant flowing from the cooler to the pressure-reducing device is in a liquid state in the second refrigerant circuit 5*b*. Generally, when the refrigerant flowing into the pressure-reducing device is a refrigerant in a gas-liquid two-phase state, the refrigerant flows into the pressure-reducing device in a discontinuous state. For this reason, the flow speed of the refrigerant passing through the pressure-reducing device changes discontinuously, so that flow noise of the refrigerant is generated to cause discomfort to a user. However, with this additional configuration, since the refrigerant flowing into the pressure-reducing device goes into a liquid state, the air conditioning apparatus 100 according to the embodiment I has an effect of suppressing the generation of flow noise. The refrigerant in a gas-liquid two-phase state has a larger volume flow rate at the same mass flow rate than the refrigerant in a liquid state. Generally, since the pressure-reducing device narrows the flow path to reduce the pressure of the refrigerant, when the volume flow rate is large as that of the refrigerant in a gas-liquid two-phase state, passing resistance in the pressure-reducing device increases, so that the refrigerant is not capable of flowing at a mass flow rate required for the refrigerant circuit. Therefore, the air conditioning apparatus in which the refrigerant in a gas-liquid two-phase state passes through the pressure-reducing device requires the use of a large pressure-reducing device such as the use of an expansion valve having a large hole diameter. However, with this additional configuration, since the refrigerant flowing into the pressure-reducing device goes into a liquid state, the air conditioning apparatus 100 according to the embodiment I has an effect of being capable of suppressing an increase in the size of the pressure-reducing device.

Further, as an additional configuration, in the air conditioning apparatus 100 according to the embodiment I, the heat source-side heat exchanger includes two distribution members (corresponding to the header 12*d* and the distributor 12*e*) that distribute or merge flows of the refrigerant, and the plurality of unit flow paths 12*g* are formed between the distribution members. With this additional configuration, in the air conditioning apparatus 100 according to the embodiment I, the contact surface area between the refrigerant flowing through the heat source-side heat exchanger and the heat source-side heat medium is increased, so that heat exchange is effectively conducted. With this additional configuration, in the air conditioning apparatus 100 according to the embodiment I, since the volume of an outlet of the heat exchanger functioning as a condenser in the first refrigerant circuit 5*a* is large, a difference in required refrigerant amount between the case of a liquid state and the case of a gas-liquid two-phase state is also large. Therefore, the effect of reducing the refrigerant amount required for the above-described operations is more remarkable when this additional configuration is provided than when this additional configuration is not provided.

Further, as an additional configuration, the air conditioning apparatus 100 according to the embodiment I has a configuration in which the refrigerant flowing from the heat source-side heat exchanger to the cooler in the first refrigerant circuit 5*a* is in a gas-liquid two-phase state, the refrigerant flowing from the load-side heat exchanger to the cooler in the second refrigerant circuit 5*b* is in a gas-liquid two-phase state, and the volume of the heat source-side heat exchanger and the volume of the load-side heat exchanger are different from each other. Here, the smaller a difference between the amount of the liquid refrigerant existing in the first refrigerant circuit and the amount of the liquid refrigerant existing in the second refrigerant circuit is, the smaller a difference between the refrigerant amount required for the first refrigerant circuit and the refrigerant amount required for the second refrigerant circuit is. Therefore, the amount of the surplus refrigerant when the refrigerant circuit is switched is reduced. In the structure in which the volume of the heat source-side heat exchanger and the volume of the load-side heat exchanger are different from each other, in comparison between when the refrigerant flowing out from the heat exchanger functioning as a condenser is in a liquid state and when the refrigerant flowing out from the heat exchanger functioning as a condenser is in a gas-liquid two-phase state, the difference between the amount of the liquid refrigerant existing in the first refrigerant circuit and the amount of the liquid refrigerant existing in the second refrigerant circuit is smaller when the refrigerant flowing out from the heat exchanger functioning as a condenser is in a gas-liquid two-phase state. Therefore, this additional configuration has an effect of being capable of further reducing the amount of the surplus refrigerant when the refrigerant circuit is switched than a case that the refrigerant flowing out from the heat exchanger functioning as a condenser is in a liquid state.

The outdoor unit 1 according to the embodiment I includes the compressor 10; the pressure-reducing device (corresponding to the expansion valve 15); the heat source-side heat exchanger (corresponding to the outdoor heat exchanger 12); the cooler (corresponding to the first cooler 13 and the second cooler 14) that cools the refrigerant; the flow path switching device (corresponding to the four-way valve 11); the first piping connection portion 18*a*; and the second piping connection portion 18*b*. The first piping connection portion 18*a* is connected to one end portion of a load-side heat exchanger flow path (corresponding to the indoor heat exchanger flow path 20*a*), which is formed in the load-side heat exchanger (corresponding to the indoor heat exchanger 20) that makes heat exchange to be conducted between the refrigerant and the load-side heat medium, via a piping (corresponding to the first connection refrigerant piping 3). The second piping connection portion 18*b* is connected to the other end portion of the load-side heat exchanger flow path via a piping (corresponding to the second connection refrigerant piping 4). The flow path switching device switches between the first refrigerant circuit and the second refrigerant circuit. In the first refrigerant circuit, the refrigerant flows in order of the second piping connection portion 18*b*, the compressor 10, the heat source-side heat exchanger, the cooler (corresponding to the first cooler 13), the pressure-reducing device, and the first piping connection portion 18*a*. In the second refrigerant circuit, the refrigerant flows in order of the first piping connection portion 18*a*, the cooler (corresponding to the second cooler 14), the pressure-reducing device, the heat source-side heat exchanger, the compressor, and the second piping connection portion. With this configuration, the outdoor unit 1 according to the embodiment I has the effect that the refrigerant passing between the cooler and the heat exchanger functioning as a condenser is capable of going into a gas-liquid two-phase state in both the first refrigerant circuit and the second refrigerant circuit.

Incidentally, in the air conditioning apparatus 100 according to the embodiment I, R290 is used as the refrigerant, but refrigerants other than R290 may be used. For example, a single refrigerant such as R32 or R134a, a pseudo-azeotropic refrigerant mixture such as R410A or R404A, a mixture of a non-azeotropic refrigerant mixture such as R407C and a refrigerant, of which the global warming potential is a relatively small, such as CF3CF=CH2 including double bonds in the chemical formula, or a natural refrigerant such as CO2 may be used as the refrigerant.

Meanwhile, in the case where a large amount of a flammable refrigerant such as R290 or R32 is used, there is a probability that a gas phase having a flammable concentration is formed when the refrigerant leaks out of the air conditioning apparatus. As described above, the air conditioning apparatus 100 according to the embodiment I has an effect of being capable of reducing the refrigerant amount required for operation. Therefore, the air conditioning apparatus 100 according to the embodiment I is capable of performing operation with a small amount of the refrigerant that does not form a gas phase having a flammable concentration even when the flammable refrigerant leaks. Therefore, since the air conditioning apparatus 100 according to the embodiment I has a configuration that the refrigerant is a flammable refrigerant as an additional configuration, the air conditioning apparatus 100 has a remarkable effect of being capable of performing operation with the refrigerant amount that does not form a gas phase having a flammable concentration even when the flammable refrigerant leaks. Incidentally, the flammable refrigerant refers to a refrigerant of which the flammability classification according to ISO 817:2014 belongs to any of 2 L: weak flammability, 2: flammability, and 3: strong flammability.

In the air conditioning apparatus 100 according to the embodiment I, polyalkylene glycol is used as the chiller oil, but other chiller oils may be used. For example, when R-32 is used as the refrigerant, a chiller oil according to the type of the refrigerant may be selected, for example, an ethereal oil is used as the chiller oil.

Meanwhile, since polyalkylene glycol has low solubility to R290, the lack of the refrigerant existing in the refrigeration cycle due to R290 being dissolved in the chiller oil is suppressed. Generally, the compressor includes a mechanism that suctions up the chiller oil, which is accumulated in a bottom portion, and supplies the chiller oil to a sliding portion of the compressor. When the refrigerant in a liquid state and the chiller oil have substantially the same density, a liquid in which the chiller oil and the refrigerant are mixed is supplied to the sliding portion of the compressor, so that the lubrication of the sliding portion cannot be secured, thereby impairing the reliability of the compressor. Meanwhile, the density of polyalkylene glycol is larger than the density of R290 in a liquid state regardless of temperature. Therefore, in the air conditioning apparatus 100 according to the embodiment I, even when R290 in a liquid state exists in the compressor, since R290 in a liquid state floats in an upper portion of the chiller oil, and the chiller oil is accumulated in the bottom portion of the compressor, the chiller oil is capable of being supplied to the sliding portion of the compressor, and the reliability of the compressor is improved. Therefore, as an additional configuration, the air conditioning apparatus 100 according to the embodiment I has a configuration in which the refrigerant is R290 and the chiller oil is polyalkylene glycol, so that the reliability of the compressor is improved.

In the air conditioning apparatus 100 according to the embodiment I, the refrigerant circuit 5 during cooling operation is referred to as the first refrigerant circuit 5*a*, and the refrigerant circuit 5 during heating operation is referred to as the second refrigerant circuit 5*b*; however, the present disclosure is not limited thereto. The refrigerant circuit 5 in a state where the load-side heat exchanger (corresponding to the indoor heat exchanger 20) functions as an evaporator and the heat source-side heat exchanger (corresponding to the outdoor heat exchanger 12) functions as a condenser may be the first refrigerant circuit 5*a*. The refrigerant circuit 5 in a state where the load-side heat exchanger functions as a condenser and the heat source-side heat exchanger functions as an evaporator may be the second refrigerant circuit 5*b*. For example, the refrigerant circuit during dehumidifying operation of condensing and dehumidifying moisture contained in the air in the air conditioning target space may be referred to as the first refrigerant circuit 5*a*. The refrigerant circuit during defrosting operation of defrosting the heat source-side heat exchanger may be referred to as the second refrigerant circuit 5*b*.

The air conditioning apparatus 100 according to the embodiment I is configured such that one outdoor heat exchanger 12 and one indoor heat exchanger 20 form the refrigerant circuit, but is not limited thereto. For example, the air conditioning apparatus may include one outdoor unit and a plurality of the indoor units, and one outdoor heat exchanger and a plurality of the indoor heat exchangers may form the refrigerant circuit. In this case, the volume of the load-side heat exchanger is the sum of the volumes of the plurality of indoor heat exchangers. The outdoor unit may also include a plurality of the outdoor heat exchangers, and the plurality of outdoor heat exchangers may form the refrigerant circuit. In this case, the volume of the heat source-side heat exchanger is the sum of the volumes of the plurality of outdoor heat exchangers. In the air conditioning apparatus according to the embodiment I, the volume of the outdoor heat exchanger 12 is larger than the volume of the indoor heat exchanger 20, and the volume of the heat source-side heat exchanger is larger than the volume of the load-side heat exchanger; however, the present disclosure is not limited thereto, and for example, a plurality of the indoor heat exchangers 20 may form the refrigerant circuit, so that the volume of the load-side heat exchanger is larger than the volume of the heat source-side heat exchanger.

Modified Example of Embodiment I

Next, an air conditioning apparatus 101 according to a modified example I of the embodiment I will be described. The air conditioning apparatus 101 according to the modified example I of the embodiment I includes a relay 6 and an indoor unit 2*a* instead of the indoor unit 2 as compared with the air conditioning apparatus 100 according to the embodiment I. Incidentally, the configuration of the outdoor unit 1 of the air conditioning apparatus 101 according to the modified example I of the embodiment I and a flow of the refrigerant flowing through the outdoor unit 1 are the same as those of the air conditioning apparatus 100 according to the embodiment I, and a description thereof will be omitted.

Figure 5:
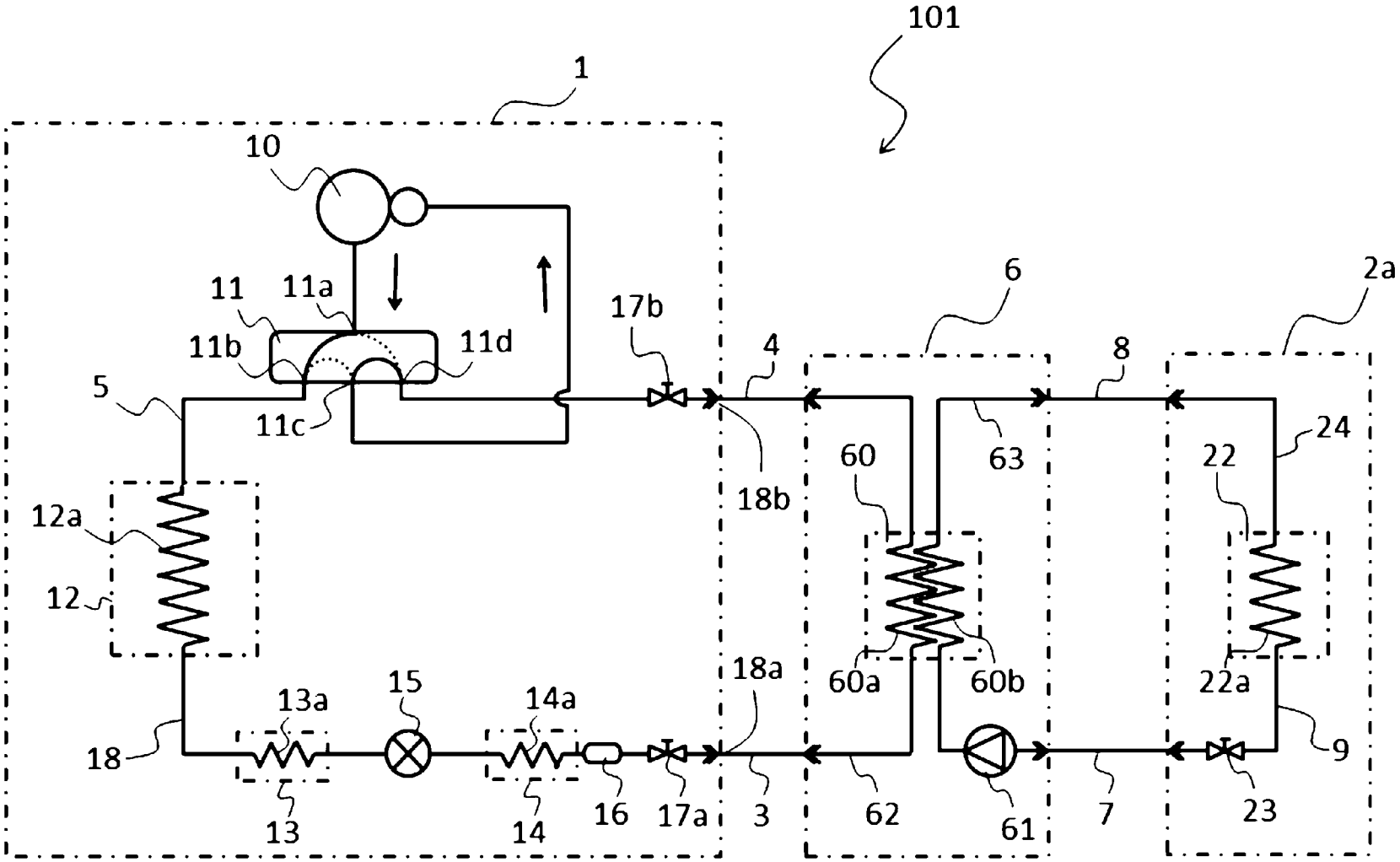
FIG. 5 is a circuit diagram showing a configuration of a refrigerant circuit and a heat medium circuit of an air conditioning apparatus according to a modified example I of the embodiment I.

FIG. 5 is a circuit diagram showing a configuration of a refrigerant circuit and a heat medium circuit of the air conditioning apparatus according to the modified example I of the embodiment I. The air conditioning apparatus 101 includes the outdoor unit 1, the indoor unit 2*a*, and the relay 6. The outdoor unit 1 and the relay 6 are connected to each other by the first connection refrigerant piping 3 and the second connection refrigerant piping 4. The relay 6 and the indoor unit 2*a* are connected to each other by a first connection heat medium piping 7 and a second connection heat medium piping 8. The outdoor unit 1, the relay 6, the first connection refrigerant piping 3, and the second connection refrigerant piping 4 form the refrigerant circuit 5 in which the refrigerant circulates. Further, the relay 6, the indoor unit 2*a*, the first connection heat medium piping 7, and the second connection heat medium piping 8 form a heat medium circuit 9 in which a heat medium to be described later circulates.

The air conditioning apparatus 101 can perform two types of operations, namely, the same cooling operation and heating operation as those of the air conditioning apparatus 100 according to the embodiment I. Since a flow path of the refrigerant circuit 5 changes between the cooling operation and the heating operation similar to the air conditioning apparatus 100 according to the embodiment I, the refrigerant circuit 5 during the cooling operation is referred to as the first refrigerant circuit 5*a*, and the refrigerant circuit 5 during the heating operation is referred to as the second refrigerant circuit 5*b*. A flow path of the heat medium circuit 9 is the same during both the cooling operation and the heating operation.

As the heat medium that circulates in the heat medium circuit 9, a heat medium is used which conducts heat exchange in a liquid state in a refrigerant-to-heat medium heat exchanger 60 to be described later and an indoor heat exchanger 22 to be described later. For example, brine (antifreeze), water, a mixed solution of brine and water, or a mixed solution of an additive having a high anticorrosive effect and water can be used as the heat medium.

Next, the relay 6 will be described. The relay 6 includes the refrigerant-to-heat medium heat exchanger 60 and a pump 61 inside a housing.

A refrigerant flow path 60*a* and a heat medium flow path 60*b* are formed in the refrigerant-to-heat medium heat exchanger 60. The refrigerant-to-heat medium heat exchanger 60 makes heat exchange to be conducted between the refrigerant passing through the refrigerant flow path 60*a* and the heat medium passing through the heat medium flow path 60*b*. The refrigerant flow path 60*a* is connected to the first connection refrigerant piping 3 and the second connection refrigerant piping 4 via a relay refrigerant piping 62. The heat medium flow path 60*b* is connected to the first connection heat medium piping 7 and the second connection heat medium piping 8 via a relay heat medium piping 63. The volume of the refrigerant flow path 60*a* is smaller than the volume of the outdoor heat exchanger flow path 12*a*. Incidentally, in the air conditioning apparatus 101 of the modified example I of the embodiment I, the heat medium corresponds to a load-side heat medium.

The pump 61 pressurizes and discharges the suctioned heat medium. The pump 61 may be formed of, for example, a pump or the like of which the capacity can be controlled. The pump 61 is provided in the middle of the relay heat medium piping 63 that connects the refrigerant-to-heat medium heat exchanger 60 and the first connection heat medium piping 7.

The indoor unit 2*a* includes the indoor heat exchanger 22 and a shutoff valve 23 inside a housing.

The indoor heat exchanger 22 makes heat exchange to be conducted between the air in the air conditioning target space and the heat medium passing through an indoor heat exchanger flow path 22*a* formed inside the indoor heat exchanger 22. The indoor heat exchanger flow path 22*a* is connected to the first connection heat medium piping 7 and the second connection heat medium piping 8 via an indoor unit heat medium piping 24.

The shutoff valve 23 opens or closes the heat medium circuit 9. The shutoff valve 23 is formed of, for example, a two-way valve, or the like.

Next, a flow of the refrigerant circulating in the first refrigerant circuit 5*a* or the second refrigerant circuit 5*b* according to the modified example I of the embodiment I will be described. Incidentally, since a flow of the refrigerant inside the outdoor unit 1 is the same as that described in the embodiment I, a description thereof will be omitted.

In the first refrigerant circuit 5*a*, the refrigerant in a gas-liquid two-phase state that has flowed out from the second cooler flow path 14*a* flows into the refrigerant flow path 60*a*. In the first refrigerant circuit 5*a*, the refrigerant-to-heat medium heat exchanger 60 functions as an evaporator, and the refrigerant passing through the refrigerant flow path 60*a* is heated by the heat medium passing through the heat medium flow path 60*b*. The heated refrigerant goes into a gas state, and flows out from the refrigerant flow path 60*a* to flow to the suction port of the compressor 10.

In the second refrigerant circuit 5*b*, the refrigerant that has been discharged from the compressor flows into the refrigerant flow path 60*a*. In the second refrigerant circuit 5*b*, the refrigerant-to-heat medium heat exchanger 60 functions as a condenser, and the refrigerant passing through the refrigerant flow path 60*a* is cooled by the heat medium passing through the heat medium flow path 60*b*. The cooled refrigerant goes into a high-pressure gas-liquid two-phase state, and flows out from the refrigerant flow path 60*a* to flow to the second cooler flow path 14*a*.

Next, a flow of the heat medium circulating in the heat medium circuit 9 will be described. First, the heat medium that has been discharged from the pump 61 flows into the heat medium flow path 60*b* of the refrigerant-to-heat medium heat exchanger 60. The heat medium that has flowed into the heat medium flow path 60*b* is cooled by the refrigerant passing through the refrigerant flow path 60*a* when the refrigerant circuit 5 is the first refrigerant circuit 5*a*, and is heated by the refrigerant passing through the refrigerant flow path 60*a* when the refrigerant circuit 5 is the second refrigerant circuit 5*b*, and the heat medium flows out from the heat medium flow path 60*b*.

The heat medium that has flowed out from the heat medium flow path 60*b* flows into the indoor heat exchanger flow path 22*a*. The heat medium that has flowed into the indoor heat exchanger flow path 22*a* is heated by the air in the air conditioning target space in a state where the refrigerant circuit 5 is the first refrigerant circuit 5*a*, and is cooled by the air in the air conditioning target space in a state where the refrigerant circuit 5 is the second refrigerant circuit 5*b*, and the heat medium flows out from the indoor heat exchanger flow path 22*a*. The heat medium that has flowed out from the indoor heat exchanger flow path 22*a* is suctioned into the pump 61 and is discharged again. Incidentally, the air in the air conditioning target space is cooled by the heat medium passing through the indoor heat exchanger flow path 22*a* in a state where the refrigerant circuit 5 is the first refrigerant circuit 5*a*, and is heated by the heat medium passing through the indoor heat exchanger flow path 22*a* in a state where the refrigerant circuit 5 is the second refrigerant circuit 5*b*.

As described above, similar to the air conditioning apparatus 100 according to the embodiment I, the air conditioning apparatus 101 according to the modified example I of the embodiment I includes the cooler (corresponding to the first cooler 13 and the second cooler 14) that cools the refrigerant. The flow path switching device (corresponding to the four-way valve 11) of the air conditioning apparatus 101 switches between the first refrigerant circuit 5*a* and the second refrigerant circuit 5*b*. In the first refrigerant circuit 5*a*, the refrigerant circulates in order of the compressor 10, the heat source-side heat exchanger (corresponding to the outdoor heat exchanger 12), the cooler (corresponding to the first cooler 13), the pressure-reducing device (corresponding to the expansion valve 15), the load-side heat exchanger (corresponding to the refrigerant-to-heat medium heat exchanger 60), and the compressor 10. In the second refrigerant circuit 5*b*, the refrigerant circulates in order of the compressor 10, the load-side heat exchanger, the cooler (corresponding to the second cooler 14), the pressure-reducing device, the heat source-side heat exchanger, and the compressor 10. Therefore, with this configuration, the air conditioning apparatus 101 according to the modified example I of the embodiment I has the same effect as the effect described in the embodiment I.

Similar to the outdoor unit 1 according to the embodiment I, the outdoor unit 1 according to the modified example I of the embodiment I includes the compressor 10; the pressure-reducing device (corresponding to the expansion valve 15); the heat source-side heat exchanger (corresponding to the outdoor heat exchanger 12); the cooler (corresponding to the first cooler 13 and the second cooler 14) that cools the refrigerant; the flow path switching device (corresponding to the four-way valve 11); the first piping connection portion 18*a* connected to one end portion of the load-side heat exchanger flow path (corresponding to the refrigerant flow path 60*a*), which is formed in the load-side heat exchanger (corresponding to the refrigerant-to-heat medium heat exchanger 60) that makes heat exchange to be conducted between the refrigerant and the load-side heat medium, via the piping (corresponding to the first connection refrigerant piping 3); and the second piping connection portion 18*b* connected to the other end portion of the load-side heat exchanger flow path via the piping (corresponding to the second connection refrigerant piping 4). The flow path switching device of the outdoor unit 1 switches between the first refrigerant circuit and the second refrigerant circuit. In the first refrigerant circuit, the refrigerant flows in order of the second piping connection portion 18*b*, the compressor 10, the heat source-side heat exchanger, the cooler (corresponding to the first cooler 13), the pressure-reducing device, and the first piping connection portion 18*a*. In the second refrigerant circuit, the refrigerant flows in order of the first piping connection portion 18*a*, the cooler (corresponding to the second cooler 14), the pressure-reducing device, the heat source-side heat exchanger, the compressor, and the second piping connection portion. Therefore, with this configuration, the outdoor unit 1 according to the modified example I of the embodiment I has the same effect as the effect described in the embodiment I.

Modified Example II of Embodiment I

Next, an air conditioning apparatus 102 according to a modified example II of the embodiment I will be described. The air conditioning apparatus 102 according to the modified example II of the embodiment I is different from the air conditioning apparatus 101 according to the modified example I of the embodiment I in that an outdoor unit 1*a* is provided instead of the outdoor unit 1 and the relay 6. Incidentally, the indoor unit 2*a* of the air conditioning apparatus 102 of the modified example II of the embodiment I is the same as that of the air conditioning apparatus 101 according to the modified example I of the embodiment I, and a description thereof will be omitted.

Figure 6:
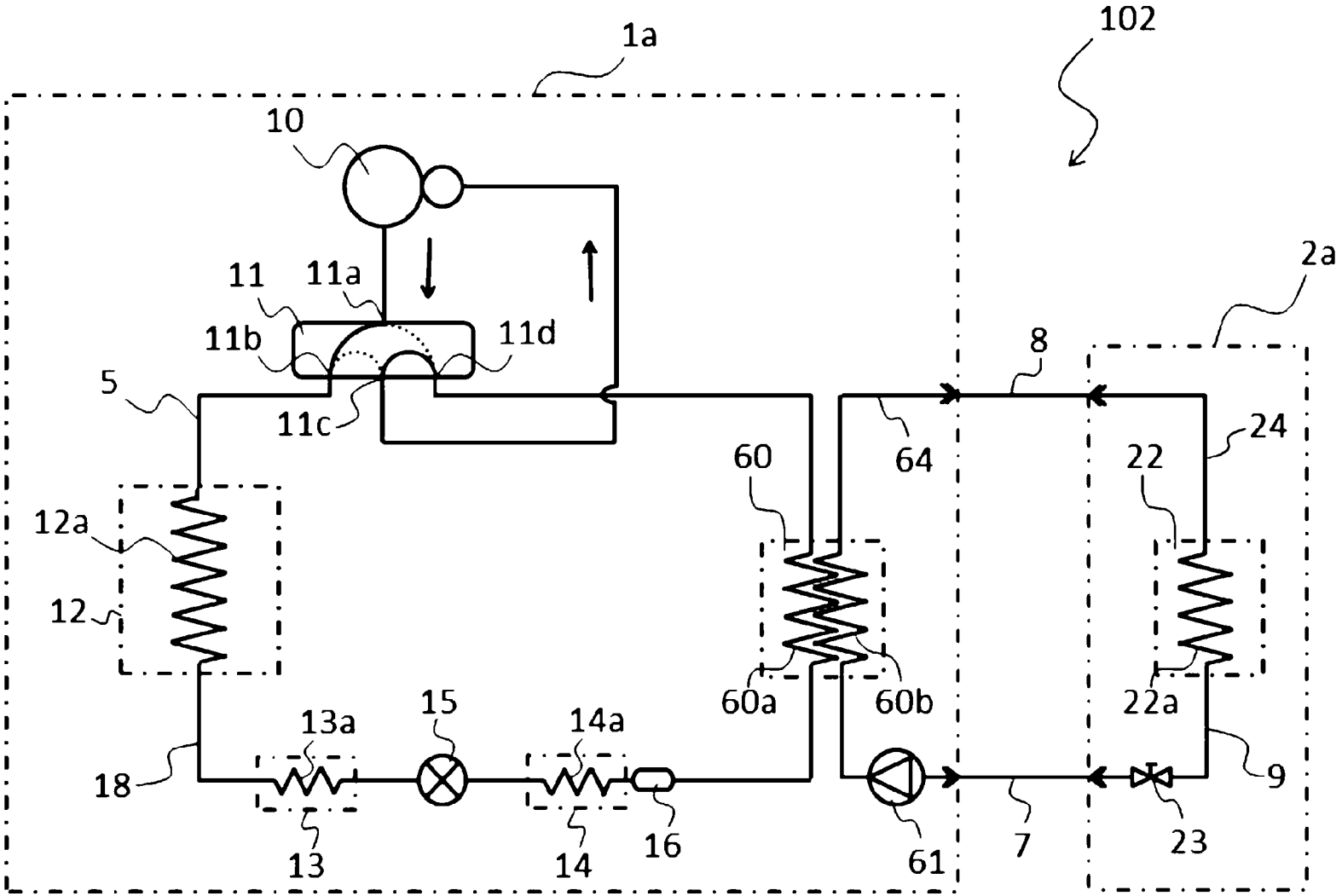
FIG. 6 is a circuit diagram showing a configuration of a refrigerant circuit and a heat medium circuit of an air conditioning apparatus according to a modified example II of the embodiment I.

FIG. 6 is a circuit diagram showing a configuration of a refrigerant circuit and a heat medium circuit of an air conditioning apparatus according to the modified example II of the embodiment I. The outdoor unit 1*a* is such that the configuration of the outdoor unit 1 and the configuration of the relay 6 in the air conditioning apparatus 101 according to the modified example I of the embodiment I is contained inside one housing. Specifically, the outdoor unit 1*a* newly includes the refrigerant-to-heat medium heat exchanger 60, the pump 61, and an outdoor unit heat medium piping 64 inside the housing of the outdoor unit 1 according to the embodiment I. The second cooler flow path 14*a* is connected to the strainer 16 via the outdoor unit refrigerant piping 18, and is connected to one end portion of the refrigerant flow path 60*a*. The fourth port 11*d* of the four-way valve 11 is connected to the other end portion of the refrigerant flow path 60*a* via the outdoor unit refrigerant piping 18. The heat medium flow path 60*b* is connected to the first connection heat medium piping 7 and the second connection heat medium piping 8 via the outdoor unit heat medium piping 64. Incidentally, since the refrigerant circuit 5 and the heat medium circuit 9 of the air conditioning apparatus 102 according to the modified example II of the embodiment I are substantially the same as the refrigerant circuit 5 and the heat medium circuit 9 of the air conditioning apparatus 101 according to the modified example I of the embodiment I, a description thereof will be omitted.

As described above, similar to the air conditioning apparatus 100 according to the embodiment I, the air conditioning apparatus 102 according to the modified example II of the embodiment I includes the cooler (corresponding to the first cooler 13 and the second cooler 14) that cools the refrigerant. The flow path switching device (corresponding to the four-way valve 11) of the air conditioning apparatus 102 switches between the first refrigerant circuit 5*a* and the second refrigerant circuit 5*b*. In the first refrigerant circuit 5*a*, the refrigerant circulates in order of the compressor 10, the heat source-side heat exchanger (corresponding to the outdoor heat exchanger 12), the cooler (corresponding to the first cooler 13), the pressure-reducing device (corresponding to the expansion valve 15), the load-side heat exchanger (corresponding to the refrigerant-to-heat medium heat exchanger 60), and the compressor 10. In the second refrigerant circuit 5*b*, the refrigerant circulates in order of the compressor 10, the load-side heat exchanger, the cooler (corresponding to the second cooler 14), the pressure-reducing device, the heat source-side heat exchanger, and the compressor 10. Therefore, with this configuration, the air conditioning apparatus 102 according to the modified example II of the embodiment I has the same effect as the effect described in the embodiment I.

Similar to the outdoor unit 1 according to the embodiment I, the outdoor unit 1*a* according to the modified example II of the embodiment I includes the compressor 10; the pressure-reducing device (corresponding to the expansion valve 15); the heat source-side heat exchanger (corresponding to the outdoor heat exchanger 12); the cooler (corresponding to the first cooler 13 and the second cooler 14) that cools the refrigerant; the flow path switching device (corresponding to the four-way valve 11); the first piping connection portion (corresponding to the other end portion of the second cooler flow path 14*a*) connected to one end portion of the load-side heat exchanger flow path (corresponding to the refrigerant flow path 60*a*), which is formed in the load-side heat exchanger (corresponding to the refrigerant-to-heat medium heat exchanger 60) that makes heat exchange to be conducted between the refrigerant and the load-side heat medium, via the piping (corresponding to the outdoor unit refrigerant piping 18 that connects the other end portion of the second cooler flow path 14*a* and one end portion of the refrigerant flow path 60*a*); and the second piping connection portion (corresponding to the fourth port 11*d*) connected to the other end portion of the load-side heat exchanger flow path via the piping (corresponding to the outdoor unit refrigerant piping 18 that connects the fourth port 11*d* and the other end portion of the refrigerant flow path 60*a*). The flow path switching device of the outdoor unit 1 switches between the first refrigerant circuit and the second refrigerant. In the first refrigerant circuit, the refrigerant flows in order of the second piping connection portion, the compressor 10, the heat source-side heat exchanger, the cooler (corresponding to the first cooler 13), the pressure-reducing device, and the first piping connection portion. In the second refrigerant circuit, the refrigerant flows in order of the first piping connection portion, the cooler (corresponding to the second cooler 14), the pressure-reducing device, the heat source-side heat exchanger, the compressor, and the second piping connection portion. Therefore, with this configuration, the outdoor unit 1*a* according to the modified example II of the embodiment I has the same effect as the effect described in the embodiment I.

Embodiment II

Next, an air conditioning apparatus 103 according to an embodiment II will be described. The air conditioning apparatus 103 according to the embodiment II is different from the air conditioning apparatus 100 according to the embodiment I in that an outdoor unit 1*b* includes a first refrigerant-to-refrigerant heat exchanger 30 and a second refrigerant-to-refrigerant heat exchanger 31 as a specific example of the first cooler 13 and the second cooler 14. Incidentally, since the air conditioning apparatus 103 according to the embodiment II has the same configuration as that of the air conditioning apparatus 100 according to the embodiment I except for a structure of the outdoor unit 1*b*, a description thereof will be omitted.

Figure 7:
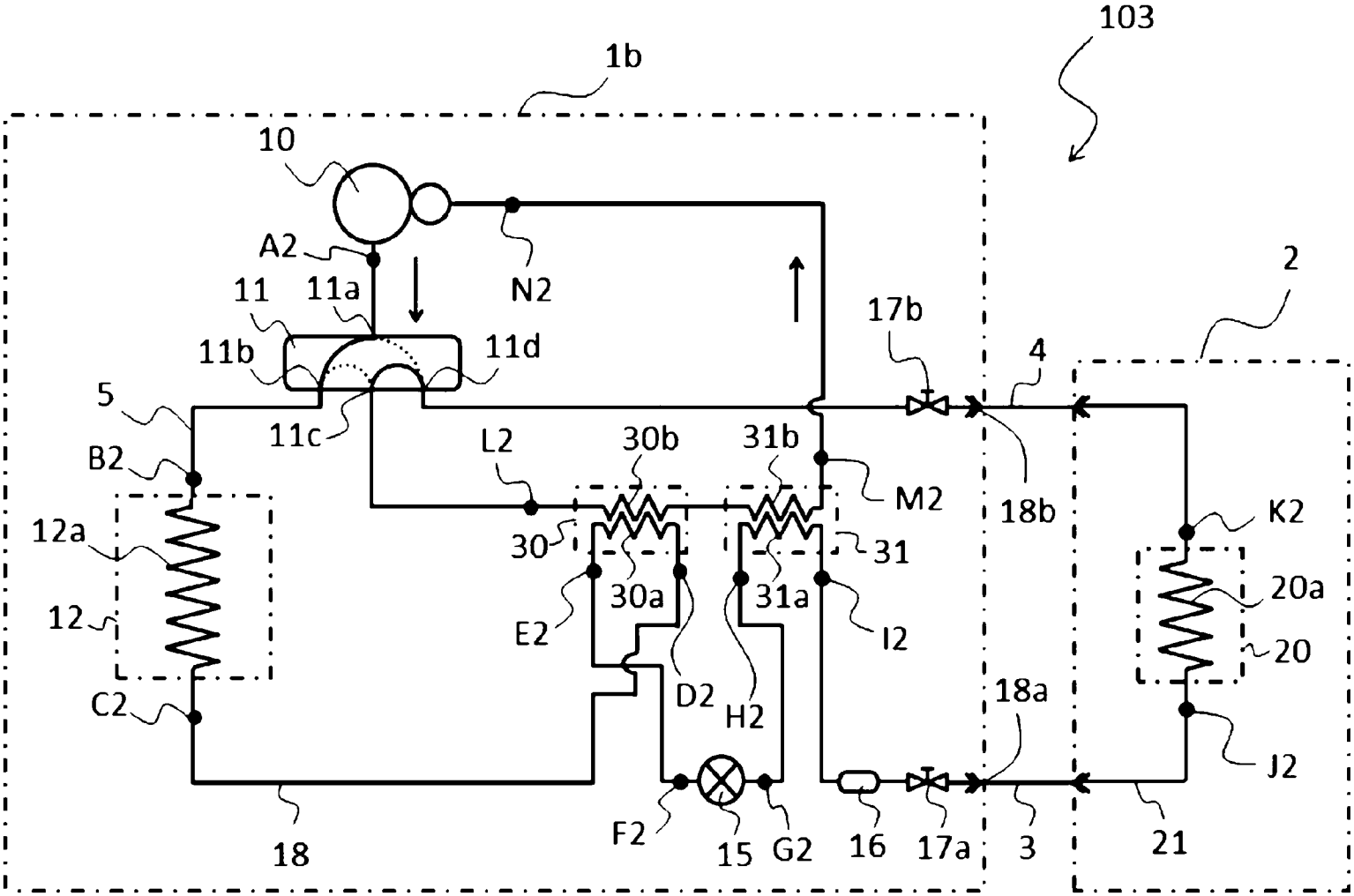
FIG. 7 is a refrigerant circuit diagram of an air conditioning apparatus according to an embodiment II.

FIG. 7 is a refrigerant circuit diagram of the air conditioning apparatus according to the embodiment II. The outdoor unit 1*b* includes the compressor 10, the four-way valve 11, the outdoor heat exchanger 12, the expansion valve 15, the strainer 16, two shutoff valves 17, the first refrigerant-to-refrigerant heat exchanger 30, and the second refrigerant-to-refrigerant heat exchanger 31 inside a housing, and these components are connected to each other by the outdoor unit refrigerant piping 18. Incidentally, since the compressor 10, the four-way valve 11, the outdoor heat exchanger 12, the expansion valve 15, the strainer 16, and the two shutoff valves 17 according to the embodiment II are substantially the same as the components with the same reference signs according to the embodiment I except for a connection relationship between some components, a description thereof will be omitted.

A first high-temperature-side flow path 30*a* and a first low-temperature-side flow path 30*b* are formed in the first refrigerant-to-refrigerant heat exchanger 30. The first refrigerant-to-refrigerant heat exchanger 30 makes heat exchange to be conducted between the refrigerant passing through the first high-temperature-side flow path 30*a* and the refrigerant passing through the first low-temperature-side flow path 30*b*. One end portion of the first high-temperature-side flow path 30*a* is connected to the other end portion of the outdoor heat exchanger flow path 12*a* via the outdoor unit refrigerant piping 18. The other end portion of the first high-temperature-side flow path 30*a* is connected to one end portion of a second high-temperature-side flow path 31*a* of the second refrigerant-to-refrigerant heat exchanger 31 to be described later via the expansion valve 15 and the outdoor unit refrigerant piping 18. One end portion of the first low-temperature-side flow path 30*b* is connected to the third port 11*c* of the four-way valve 11 via the outdoor unit refrigerant piping 18. The other end portion of the first low-temperature-side flow path 30*b* is connected to one end portion of a second low-temperature-side flow path 31*b* of the second refrigerant-to-refrigerant heat exchanger 31 to be described later. Incidentally, a specific structure of the first refrigerant-to-refrigerant heat exchanger 30 will be described later.

The second high-temperature-side flow path 31*a* and the second low-temperature-side flow path 31*b* are formed in the second refrigerant-to-refrigerant heat exchanger 31. The second refrigerant-to-refrigerant heat exchanger 31 makes heat exchange to be conducted between the refrigerant passing through the second high-temperature-side flow path 31*a* and the refrigerant passing through the second low-temperature-side flow path 31*b*. The other end portion of the second high-temperature-side flow path 31*a* is connected to one end portion of the indoor heat exchanger flow path 20*a* via the outdoor unit refrigerant piping 18, the strainer 16, the first shutoff valve 17*a*, the first connection refrigerant piping 3, and the indoor unit refrigerant piping 21. The other end portion of the second low-temperature-side flow path 31*b* is connected to the suction port of the compressor 10 via the outdoor unit refrigerant piping 18. Incidentally, a specific structure of the second refrigerant-to-refrigerant heat exchanger 31 will be described later.

Figure 8:
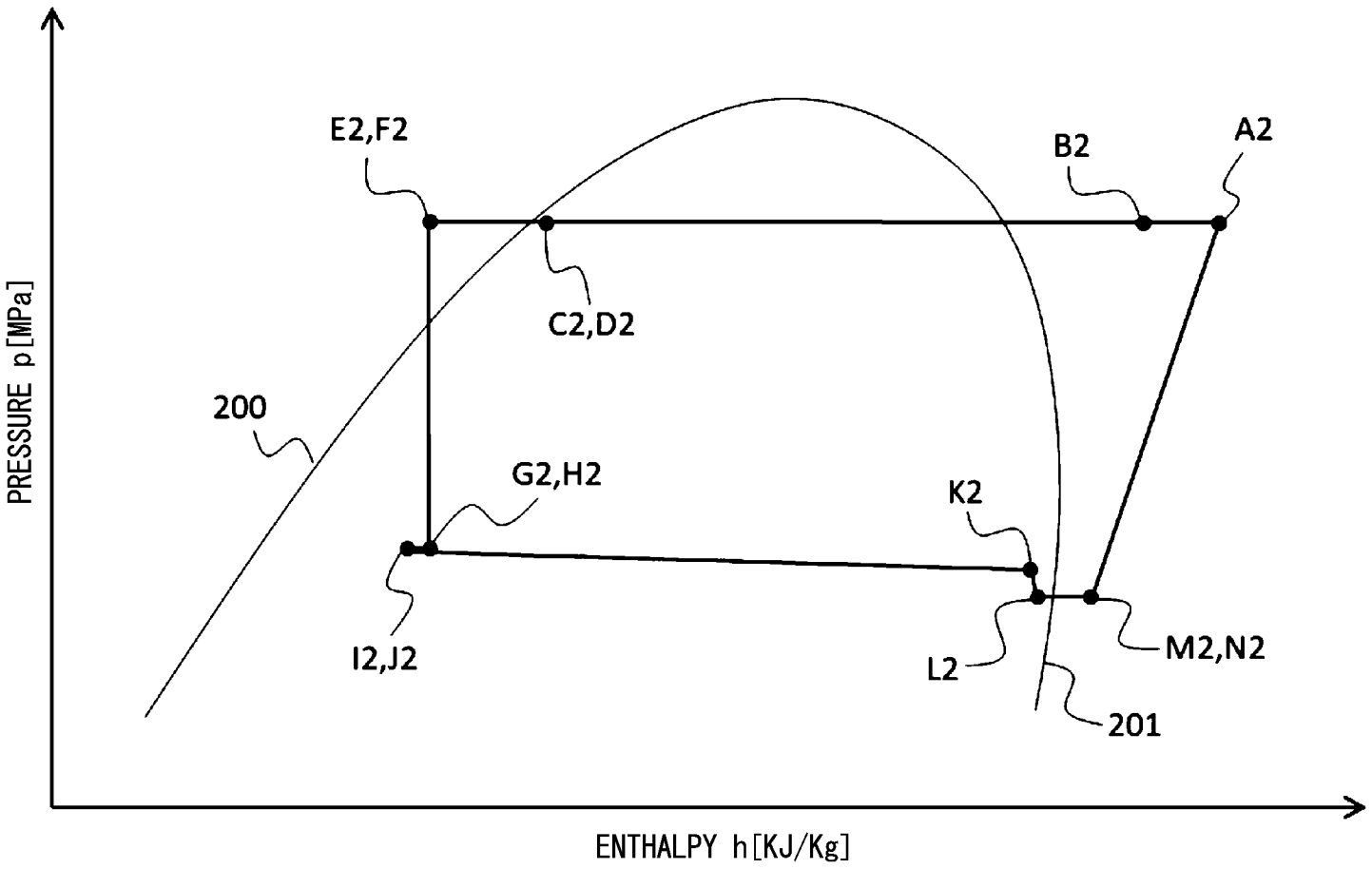
FIG. 8 is a pressure-enthalpy diagram showing a refrigeration cycle in a first refrigerant circuit of the air conditioning apparatus according to the embodiment II.

FIG. 8 is a pressure-enthalpy diagram showing a refrigeration cycle in a first refrigerant circuit of the air conditioning apparatus according to the embodiment II. Next, a flow of the refrigerant circulating in the first refrigerant circuit 5*a* will be described. In the first refrigerant circuit 5*a*, the four-way valve 11 switches to a flow path showed by a solid line in FIG. 7. Namely, in the first refrigerant circuit 5*a*, the four-way valve 11 is in a state where the first port 11*a* and the second port 11*b* are connected to each other and the third port 11*c* and the fourth port 11*d* are connected to each other. Incidentally, the state of the refrigerant showed by A2-N2 in FIG. 8 corresponds to the state of the refrigerant in A2-N2 of the refrigerant circuit of the air conditioning apparatus 103 showed in FIG. 7.

First, similar to the embodiment I, the refrigerant in a high-temperature and high-pressure gas state (A2) which has been discharged from the compressor 10 flows into the outdoor heat exchanger flow path 12*a* (B2). Since the outdoor heat exchanger 12 functions as a condenser similar to the embodiment I, the refrigerant in a high-pressure gas-liquid two-phase state flows out from the outdoor heat exchanger flow path 12*a* (C2).

The refrigerant in a high-pressure gas-liquid two-phase state which has flowed out from the outdoor heat exchanger flow path 12*a* flows into the first high-temperature-side flow path 30*a* (D2). The refrigerant passing through the first low-temperature-side flow path 30*b* is a refrigerant of a lower temperature than that of the refrigerant passing through the first high-temperature-side flow path 30*a*. Therefore, the refrigerant in a high-pressure gas-liquid two-phase state passing through the first high-temperature-side flow path 30*a* is cooled by the refrigerant passing through the first low-temperature-side flow path 30*b*. The cooled refrigerant passing through the first high-temperature-side flow path 30*a* goes into a high-pressure liquid state, and flows out from the first high-temperature-side flow path 30*a* (E2).

The refrigerant in a high-pressure liquid state which has flowed out from the first high-temperature-side flow path 30*a* flows into the expansion valve 15 (F2), goes into a low-pressure gas-liquid two-phase state, and flows out from the expansion valve 15 (G2).

The refrigerant in a low-pressure gas-liquid two-phase state which has flowed out from the expansion valve 15 flows into the second high-temperature-side flow path 31*a* (H2). The refrigerant passing through the second low-temperature-side flow path 31*b* is in a lower temperature than that of the refrigerant passing through the second high-temperature-side flow path 31*a*. Therefore, the refrigerant in a low-pressure gas-liquid two-phase state passing through the second high-temperature-side flow path 31*a* is cooled by the refrigerant passing through the second low-temperature-side flow path 31*b*. The cooled refrigerant passing through the second high-temperature-side flow path 31*a* goes into a gas-liquid two-phase state where the enthalpy is lower than that of the refrigerant immediately before flowing into the second high-temperature-side flow path 31*a*, and flows out from the second high-temperature-side flow path 31*a* (12). Incidentally, the reason of the temperature of the refrigerant passing through the second low-temperature-side flow path 31*b* is lower than that of the refrigerant passing through the second high-temperature-side flow path 31*a* is that the refrigerant which has flowed out from the second high-temperature-side flow path 31*a* is reduced in pressure due to pressure loss in a flow path from the second high-temperature-side flow path 31*a* to the second low-temperature-side flow path 31*b*, and the temperature of the refrigerant is reduced according to the reduced pressure.

Here, in the first refrigerant circuit 5*a*, a difference in temperature between the refrigerant passing through the first high-temperature-side flow path 30*a* and the refrigerant passing through the first low-temperature-side flow path 30*b* is larger than a difference in temperature between the refrigerant passing through the second high-temperature-side flow path 31*a* and the refrigerant passing through the second low-temperature-side flow path 31*b*. Therefore, the cooling amount of the refrigerant passing through the first high-temperature-side flow path 30*a* is larger than the cooling amount of the refrigerant passing through the second high-temperature-side flow path 31*a*.

The refrigerant that has flowed out from the second high-temperature-side flow path 31*a* flows into the indoor heat exchanger flow path 20*a* (J2). Similar to the embodiment I, the indoor heat exchanger 20 functions as an evaporator. The refrigerant passing through the indoor heat exchanger flow path 20*a* is heated by the air in the air conditioning target space. The refrigerant passing through the indoor heat exchanger flow path 20*a* goes into a gas-liquid two-phase state where the enthalpy is higher and the pressure is lower than those of the refrigerant immediately before flowing into the indoor heat exchanger flow path 20*a*, and flows out from the indoor heat exchanger flow path 20*a* (K2).

The refrigerant that has flowed out from the indoor heat exchanger flow path 20*a* flows into the first low-temperature-side flow path 30*b* and the second low-temperature-side flow path 31*b* in order (L2). Due to pressure loss of the refrigerant when passing through the indoor unit refrigerant piping 21, the second connection refrigerant piping 4, and the outdoor unit refrigerant piping 18, the refrigerant (L2) flowing into the first low-temperature-side flow path 30*b* is a refrigerant in a gas-liquid two-phase state of which the pressure has been more reduced than that of the refrigerant (K2) immediately after having flowed out from the indoor heat exchanger flow path 20*a*. The refrigerant in a gas-liquid two-phase state passing through the first low-temperature-side flow path 30*b* is heated by the refrigerant passing through the first high-temperature-side flow path 30*a*. The refrigerant passing through the second low-temperature-side flow path 31*b* is heated by the refrigerant passing through the second high-temperature-side flow path 31*a*. The refrigerant passing through the first low-temperature-side flow path 30*b* and the second low-temperature-side flow path 31*b* goes into a low-temperature gas state, and flows out from the second low-temperature-side flow path 31*b* (M2). The refrigerant that has flowed out from the second low-temperature-side flow path 31*b* is suctioned into the suction port of the compressor 10 (N2), and is discharged again in a high-temperature and high-pressure gas state (A2).

Figure 9:
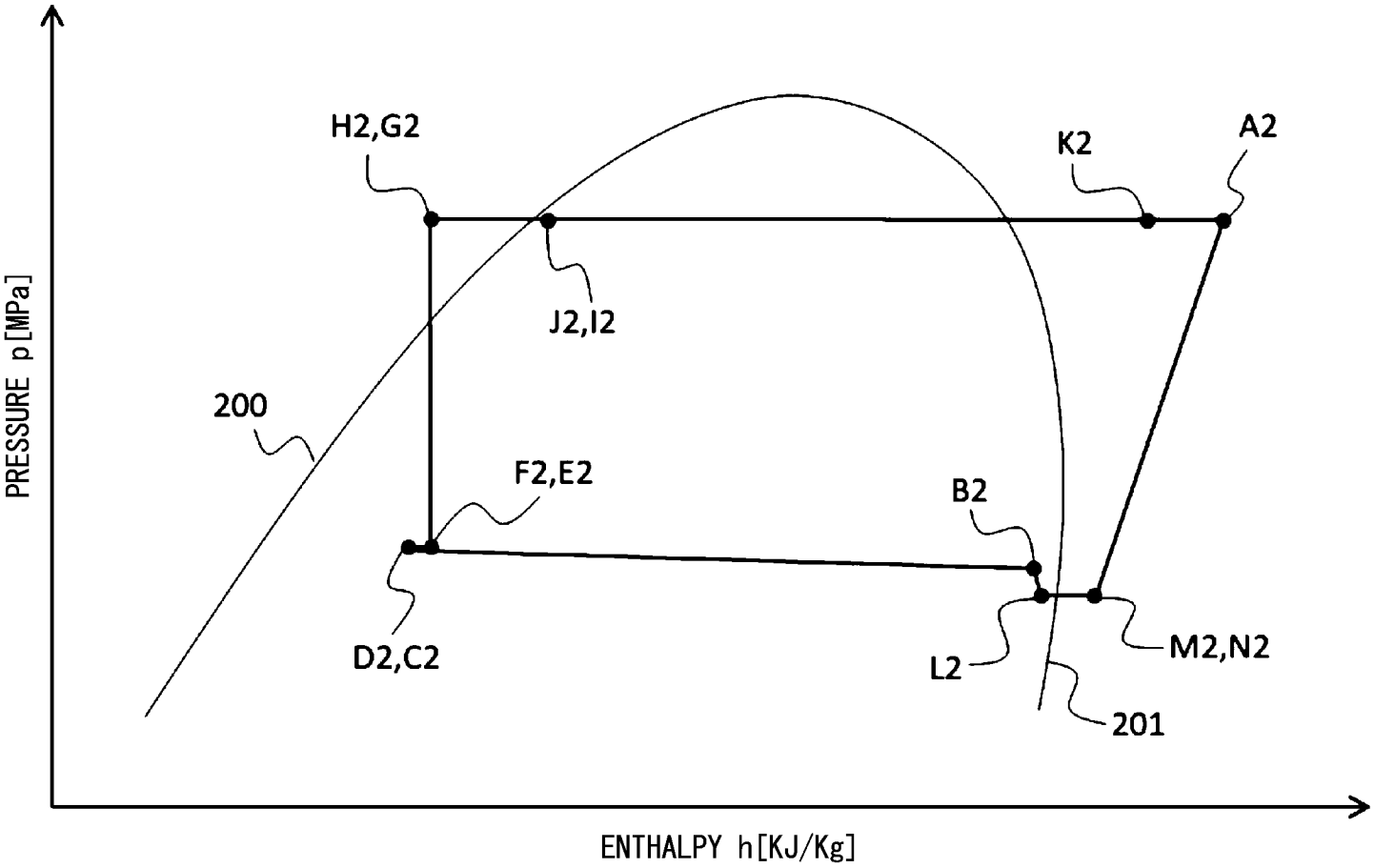
FIG. 9 is a pressure-enthalpy diagram showing a refrigeration cycle in a second refrigerant circuit of the air conditioning apparatus according to the embodiment II.

FIG. 9 is a pressure-enthalpy diagram showing a refrigeration cycle in a second refrigerant circuit of the air conditioning apparatus according to the embodiment II. Next, a flow of the refrigerant circulating in the second refrigerant circuit 5*b* will be described. In the second refrigerant circuit 5*b*, the four-way valve 11 switches to a flow path showed by a dotted line in FIG. 7. Namely, in the second refrigerant circuit 5*b*, the four-way valve 11 is in a state where the first port 11*a* and the fourth port 11*d* are connected to each other and the second port 11*b* and the third port 11*c* are connected to each other. Incidentally, the state of the refrigerant showed by A2-N2 in FIG. 9 corresponds to the state of the refrigerant in A2-N2 of the refrigerant circuit of the air conditioning apparatus 103 showed in FIG. 7.

First, similar to the embodiment I, the refrigerant (A2) which has been discharged from the compressor 10 and in a high-temperature and high-pressure gas state flows into the indoor heat exchanger flow path 20*a* (K2). Since the indoor heat exchanger 20 functions as a condenser similar to the embodiment I, the refrigerant in a high-pressure gas-liquid two-phase state flows out from the indoor heat exchanger flow path 20*a* (J2).

The refrigerant which has flowed out from the indoor heat exchanger flow path 20*a* and in a high-pressure gas-liquid two-phase state flows into the second high-temperature-side flow path 31*a* (I2). The refrigerant passing through the second low-temperature-side flow path 31*b* is a refrigerant of a lower temperature than that of the refrigerant passing through the second high-temperature-side flow path 31*a*. Therefore, the refrigerant in a high-pressure gas-liquid two-phase state passing through the second high-temperature-side flow path 31*a* is cooled by the refrigerant passing through the second low-temperature-side flow path 31*b*. The cooled refrigerant passing through the second high-temperature-side flow path 31*a* goes into a high-pressure liquid state, and flows out from the second high-temperature-side flow path 31*a* (H2).

The refrigerant in a high-pressure liquid state which has flowed out from the second high-temperature-side flow path 31*a* flows into the expansion valve 15 (G2), goes into a low-pressure gas-liquid two-phase state, and flows out from the expansion valve 15 (F2).

The refrigerant in a gas-liquid two-phase state which has flowed out from the expansion valve 15 flows into the first high-temperature-side flow path 30*a* (E2). The refrigerant passing through the first low-temperature-side flow path 30*b* is a refrigerant of a lower temperature than that of the refrigerant passing through the first high-temperature-side flow path 30*a*. Therefore, the refrigerant in a gas-liquid two-phase state passing through the first high-temperature-side flow path 30*a* is cooled by the refrigerant passing through the first low-temperature-side flow path 30*b*. The refrigerant passing through the first high-temperature-side flow path 30*a* goes into a gas-liquid two-phase state where the enthalpy is lower than that of the refrigerant immediately before flowing into the first high-temperature-side flow path 30*a*, and flows out from the first high-temperature-side flow path 30*a* (D2). Incidentally, the reason of the temperature of the refrigerant passing through the first low-temperature-side flow path 30*b* is lower than that of the refrigerant passing through the first high-temperature-side flow path 30*a* is that, similar to the second high-temperature-side flow path 31*a* and the second low-temperature-side flow path 31*b* in the first refrigerant circuit 5*a*, the pressure is reduced due to pressure loss in a flow path from the first high-temperature-side flow path 30*a* to the first low-temperature-side flow path 30*b*, and the temperature of the refrigerant is reduced according to the reduced pressure.

Here, in the second refrigerant circuit 5*b*, a difference in temperature between the refrigerant passing through the first high-temperature-side flow path 30*a* and the refrigerant passing through the first low-temperature-side flow path 30*b* is smaller than a difference in temperature between the refrigerant passing through the second high-temperature-side flow path 31*a* and the refrigerant passing through the second low-temperature-side flow path 31*b*. Therefore, the cooling amount of the refrigerant passing through the second high-temperature-side flow path 31*a* is larger than the cooling amount of the refrigerant passing through the first high-temperature-side flow path 30*a*.

The refrigerant in a gas-liquid two-phase state which has flowed out from the first high-temperature-side flow path 30*a* flows into the outdoor heat exchanger flow path 12*a* (C2). Similar to the embodiment I, the outdoor heat exchanger 12 functions as an evaporator. The refrigerant passing through the outdoor heat exchanger flow path 12*a* is heated by the air in the outdoor space. The refrigerant passing through the outdoor heat exchanger flow path 12*a* goes into a gas-liquid two-phase state where the enthalpy is higher and the pressure is lower than those of the refrigerant immediately before flowing into the outdoor heat exchanger flow path 12*a*, and flows out from the outdoor heat exchanger flow path 12*a* (B2).

The refrigerant that has flowed out from the indoor heat exchanger flow path 20*a* flows into the first low-temperature-side flow path 30*b* and the second low-temperature-side flow path 31*b* in order (L2). Due to pressure loss of the refrigerant when passing through the outdoor unit refrigerant piping 18, the refrigerant (L2) flowing into the first low-temperature-side flow path 30*b* is a refrigerant in a gas-liquid two-phase state of which the pressure has been more reduced than that of the refrigerant (K2) immediately after having flowed out from the indoor heat exchanger flow path 20*a*. The refrigerant in a gas-liquid two-phase state passing through the first low-temperature-side flow path 30*b* is heated by the refrigerant passing through the first high-temperature-side flow path 30*a*. The refrigerant passing through the second low-temperature-side flow path 31*b* is heated by the refrigerant passing through the second high-temperature-side flow path 31*a*. The refrigerant passing through the first low-temperature-side flow path 30*b* and the second low-temperature-side flow path 31*b* goes into a low-temperature gas state, and flows out from the second low-temperature-side flow path 31*b* (M2). The refrigerant that has flowed out from the second low-temperature-side flow path 31*b* is suctioned into the suction port of the compressor 10 (N2), and is discharged again in a high-temperature and high-pressure gas state (A2).

As described above, the air conditioning apparatus 103 according to the embodiment II includes the cooler (corresponding to the first refrigerant-to-refrigerant heat exchanger 30 in the first refrigerant circuit 5*a* and corresponding to the second refrigerant-to-refrigerant heat exchanger 31 in the second refrigerant circuit 5*b*) that cools the refrigerant flowing from the heat exchanger that functions as a condenser to the expansion valve 15 in both the first refrigerant circuit 5*a* and the second refrigerant circuit 5*b*.

The air conditioning apparatus 103 according to the embodiment II includes the refrigerant-to-refrigerant heat exchanger (corresponding to the first refrigerant-to-refrigerant heat exchanger 30 in the first refrigerant circuit 5*a* and corresponding to the second refrigerant-to-refrigerant heat exchanger 31 in the second refrigerant circuit 5*b*) that makes heat exchange to be conducted between the refrigerant flowing from the heat exchanger functioning as a condenser to the expansion valve 15 and the refrigerant flowing from the heat exchanger that functions as an evaporator to the compressor in both the first refrigerant circuit 5*a* and the second refrigerant circuit 5*b*.

In the air conditioning apparatus 103 according to the embodiment II, the refrigerant flowing from the heat exchanger functioning as a condenser to the cooler (corresponding to the first refrigerant-to-refrigerant heat exchanger 30 in the first refrigerant circuit 5*a* and corresponding to the second refrigerant-to-refrigerant heat exchanger 31 in the second refrigerant circuit 5*b*) in both the first refrigerant circuit 5*a* and the second refrigerant circuit 5*b* is in a gas-liquid two-phase state.

In the air conditioning apparatus 103 according to the embodiment II, the refrigerant flowing from the cooler (corresponding to the first refrigerant-to-refrigerant heat exchanger 30 in the first refrigerant circuit 5*a* and corresponding to the second refrigerant-to-refrigerant heat exchanger 31 in the second refrigerant circuit 5*b*) to the expansion valve 15 in both the first refrigerant circuit 5*a* and the second refrigerant circuit 5*b* is in a liquid state.

Figure 10:
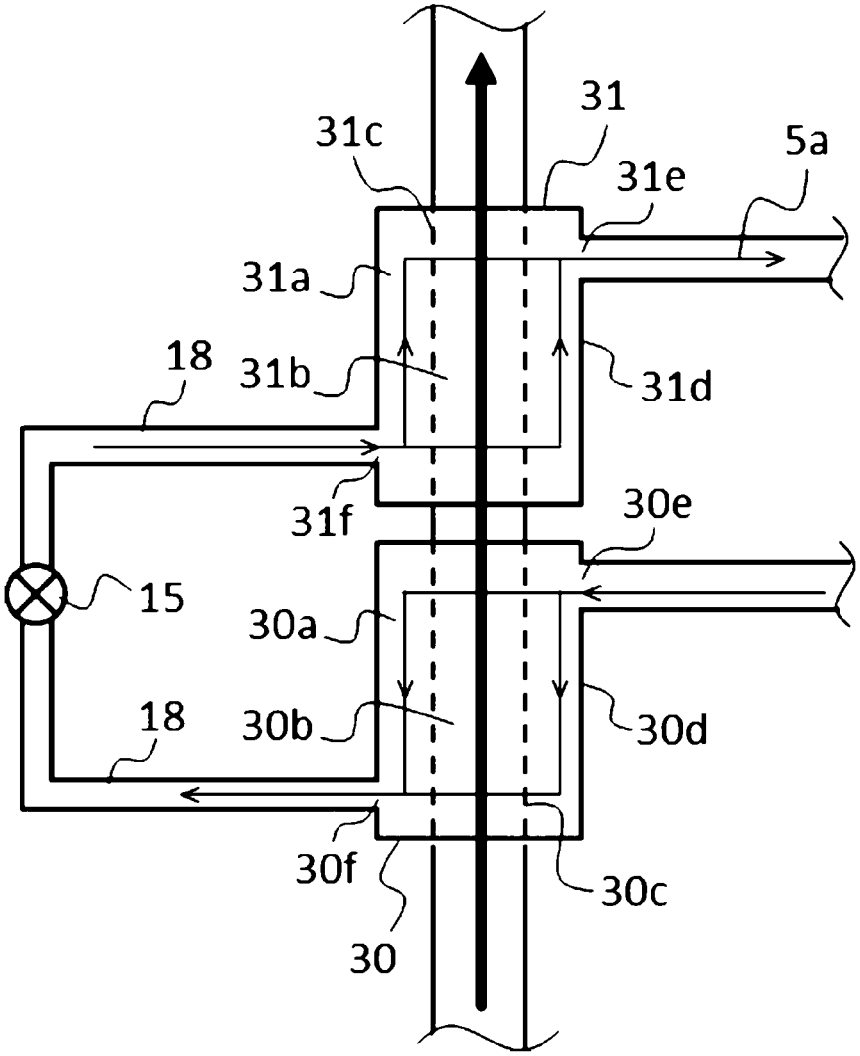
FIG. 10 is a schematic view of a first refrigerant-to-refrigerant heat exchanger and a second refrigerant-to-refrigerant heat exchanger in the first refrigerant circuit of the air conditioning apparatus according to the embodiment II.
Figure 11:
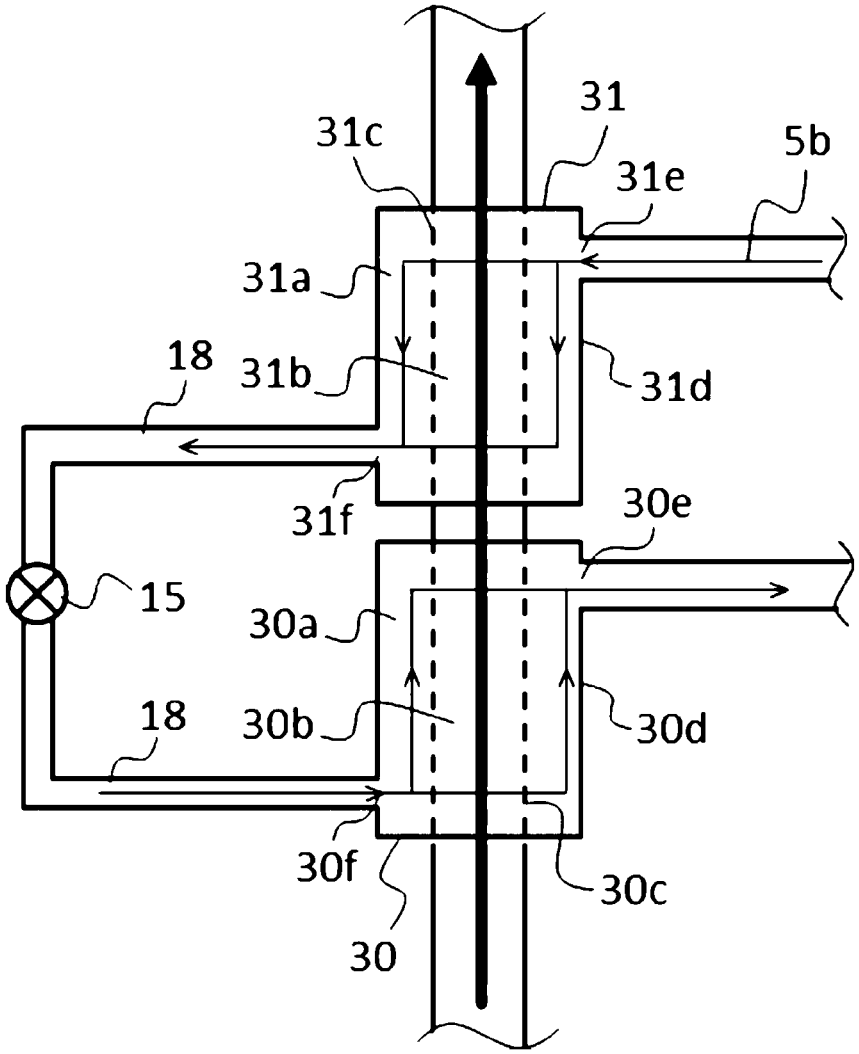
FIG. 11 is a schematic view of the first refrigerant-to-refrigerant heat exchanger and the second refrigerant-to-refrigerant heat exchanger in the second refrigerant circuit of the air conditioning apparatus according to the embodiment II.

FIG. 10 is a schematic view of the first refrigerant-to-refrigerant heat exchanger and the second refrigerant-to-refrigerant heat exchanger in the first refrigerant circuit of the air conditioning apparatus according to the embodiment II. FIG. 11 is a schematic view of the first refrigerant-to-refrigerant heat exchanger and the second refrigerant-to-refrigerant heat exchanger in the second refrigerant circuit of the air conditioning apparatus according to the embodiment II. Next, a structure of the first refrigerant-to-refrigerant heat exchanger 30 and the second refrigerant-to-refrigerant heat exchanger 31 will be described. The first refrigerant-to-refrigerant heat exchanger 30 includes a first inner pipe 30*c* and a first outer pipe 30*d*. The second refrigerant-to-refrigerant heat exchanger 31 includes a second inner pipe 31*c* and a second outer pipe 31*d*.

The first inner pipe 30*c* and the second inner pipe 31*c* are pipings through which the refrigerant flows. One end portion (lower end portion FIGS. 10 and 11) of the first inner pipe 30*c* is connected to the third port 11*c* of the four-way valve 11 via the outdoor unit refrigerant piping 18, and the other end portion (upper end portion of FIGS. 10 and 11) is connected to one end portion of the second inner pipe 31*c*. The other end portion (upper end portion in FIGS. 10 and 11) of the second inner pipe 31*c* is connected to the suction port of the compressor 10 via the outdoor unit refrigerant piping 18. Incidentally, an inner flow path of the first inner pipe 30*c* corresponds to the first low-temperature-side flow path 30*b*, and an inner flow path of the second inner pipe 31*c* corresponds to the second low-temperature-side flow path 31*b*. As showed in FIGS. 10 and 11, the refrigerant passing through the first low-temperature-side flow path 30*b* and the second low-temperature-side flow path 31*b* flows in a direction from one end portion toward the other end portion (direction from a lower side toward an upper side in FIGS. 10 and 11) in both the first refrigerant circuit 5*a* and the second refrigerant circuit 5*b*.

The first outer pipe 30*d* is provided to cover the first inner pipe 30*c*, and is a piping in which the refrigerant flows through a flow path formed between the first inner pipe 30*c* and the first outer pipe 30*d*. A first inlet and outlet port 30*e* connected to the outdoor heat exchanger flow path 12*a* via the outdoor unit refrigerant piping 18 and a second inlet and outlet port 30*f* connected to the expansion valve 15 via the outdoor unit refrigerant piping 18 are formed in the first outer pipe 30*d*. The first inlet and outlet port 30*e* is formed at a place located downstream of the refrigerant flowing through the first low-temperature-side flow path 30*b* with respect to the second inlet and outlet port 30*f*. Incidentally, the flow path between the first inner pipe 30*c* and the first outer pipe 30*d* corresponds to the first high-temperature-side flow path 30*a*. The first inlet and outlet port 30*e* corresponds to the one end portion of the first high-temperature-side flow path 30*a*, and the second inlet and outlet port 30*f* corresponds to the other end portion of the first high-temperature-side flow path 30*a*.

The second outer pipe 31*d* is provided to cover the second inner pipe 31*c*, and is a piping in which the refrigerant flows through a flow path formed between the second inner pipe 31*c* and the second outer pipe 31*d*. A third inlet and outlet port 31*e* and a fourth inlet and outlet port 31*f* are formed in the second outer pipe 31*d*. The third inlet and outlet port 31*e* is connected to the indoor heat exchanger flow path 20*a* via the outdoor unit refrigerant piping 18, the strainer 16, the first shutoff valve 17*a*, the first connection refrigerant piping 3, and the indoor unit refrigerant piping 21. The fourth inlet and outlet port 31*f* is connected to the expansion valve 15 via the outdoor unit refrigerant piping 18. The third inlet and outlet port 31*e* is formed at a place located downstream of the refrigerant flowing through the second low-temperature-side flow path 31*b* with respect to the fourth inlet and outlet port 31*f*. Incidentally, the flow path between the second inner pipe 31*c* and the second outer pipe 31*d* corresponds to the second high-temperature-side flow path 31*a*. The third inlet and outlet port 31*e* corresponds to the one end portion of the second high-temperature-side flow path 31*a*, and the fourth inlet and outlet port 31*f* corresponds to the other end portion of the second high-temperature-side flow path 31*a*.

Next, a flow of the refrigerant passing through the first high-temperature-side flow path 30*a* and the second high-temperature-side flow path 31*a* will be described.

In the first refrigerant circuit 5*a*, as showed in FIG. 10, the refrigerant that has flowed out from the outdoor heat exchanger flow path 12*a* flows into the first high-temperature-side flow path 30*a* from the first inlet and outlet port 30*e*, and the refrigerant that has passed through the first high-temperature-side flow path 30*a* flows out to the expansion valve 15 from the second inlet and outlet port 30*f*. Since the first inlet and outlet port 30*e* is formed at the place located downstream of the refrigerant flowing through the first low-temperature-side flow path 30*b* with respect to the second inlet and outlet port 30*f*, a flow direction of the refrigerant passing through the first high-temperature-side flow path 30*a* is opposite to a flow direction of the refrigerant passing through the first low-temperature-side flow path 30*b* in the first refrigerant circuit 5*a*.

In the first refrigerant circuit 5*a*, as showed in FIG. 10, the refrigerant that has flowed out from the expansion valve 15 flows into the second high-temperature-side flow path 31*a* from the fourth inlet and outlet port 31*f*, and the refrigerant that has passed through the second high-temperature-side flow path 31*a* flows out to the indoor heat exchanger flow path 20*a* from the third inlet and outlet port 31*e*. Since the third inlet and outlet port 31*e* is formed at the place located downstream of the refrigerant flowing through the second low-temperature-side flow path 31*b* with respect to the fourth inlet and outlet port 31*f*, a flow direction of the refrigerant passing through the second high-temperature-side flow path 31*a* is the same as the flow direction of the refrigerant passing through the second low-temperature-side flow path 31*b* in the first refrigerant circuit 5*a*.

In the second refrigerant circuit 5*b*, as showed in FIG. 11, the refrigerant that has flowed out from the indoor heat exchanger flow path 20*a* flows into the second high-temperature-side flow path 31*a* from the third inlet and outlet port 31*e*, and the refrigerant that has passed through the second high-temperature-side flow path 31*a* flows out to the expansion valve 15 from the fourth inlet and outlet port 31*f*. Since the third inlet and outlet port 31*e* is formed at the place located downstream of the refrigerant flowing through the second low-temperature-side flow path 31*b* with respect to the fourth inlet and outlet port 31*f*, a flow direction of the refrigerant passing through the second high-temperature-side flow path 31*a* is opposite to the flow direction of the refrigerant passing through the second low-temperature-side flow path 31*b* in the second refrigerant circuit 5*b*.

In the second refrigerant circuit 5*b*, as showed in FIG. 11, the refrigerant that has flowed out from the expansion valve 15 flows into the first high-temperature-side flow path 30*a* from the second inlet and outlet port 30*f*, and the refrigerant that has passed through the first high-temperature-side flow path 30*a* flows out to the outdoor heat exchanger flow path 12*a* from the first inlet and outlet port 30*e*. Since the first inlet and outlet port 30*e* is formed at the place located downstream of the refrigerant flowing through the first low-temperature-side flow path 30*b* with respect to the second inlet and outlet port 30*f*, a flow direction of the refrigerant passing through the first high-temperature-side flow path 30*a* is the same as the flow direction of the refrigerant passing through the first low-temperature-side flow path 30*b* in the second refrigerant circuit 5*b*.

As described above, in the air conditioning apparatus 103 according to the embodiment II, in both the first refrigerant circuit 5*a* and the second refrigerant circuit 5*b*, the flow direction of the refrigerant passing through the high-temperature-side flow path provided between the expansion valve 15 and the heat exchanger which functions as a condenser is opposite to the flow direction of the refrigerant passing through the low-temperature-side flow path provided between the compressor 10 and the heat exchanger which functions as an evaporator.

In the air conditioning apparatus 103 according to the embodiment II, in both the first refrigerant circuit 5*a* and the second refrigerant circuit 5*b*, the flow direction of the refrigerant passing through the high-temperature-side flow path provided between the expansion valve 15 and the heat exchanger functioning as an evaporator is same as the flow direction of the refrigerant passing through the low-temperature-side flow path provided between the compressor 10 and the heat exchanger functioning as a condenser.

As described above, similar to the air conditioning apparatus 100 according to the embodiment I, the air conditioning apparatus 103 according to the embodiment II includes the cooler (corresponding to the first refrigerant-to-refrigerant heat exchanger 30 and the second refrigerant-to-refrigerant heat exchanger 31) that cools the refrigerant. The flow path switching device (corresponding to the four-way valve 11) of the air conditioning apparatus 103 switches between the first refrigerant circuit 5*a* and the second refrigerant circuit 5*b*. In the first refrigerant circuit 5*a*, the refrigerant circulates in order of the compressor 10, the heat source-side heat exchanger (corresponding to the outdoor heat exchanger 12), the cooler (corresponding to the first refrigerant-to-refrigerant heat exchanger 30), the pressure-reducing device (corresponding to the expansion valve 15), the load-side heat exchanger (corresponding to the indoor heat exchanger 20), and the compressor 10. In the second refrigerant circuit 5*b*, the refrigerant circulates in order of the compressor 10, the load-side heat exchanger, the cooler (corresponding to the second refrigerant-to-refrigerant heat exchanger 31), the pressure-reducing device, the heat source-side heat exchanger, and the compressor 10. Therefore, with this configuration, the air conditioning apparatus 103 according to the embodiment II also has the same effect as the effect described in the embodiment I.

Further, as an additional configuration, in the air conditioning apparatus 103 according to the embodiment II, the high-temperature-side flow path (corresponding to the first high-temperature-side flow path 30*a* and the second high-temperature-side flow path 31*a*) and the low-temperature-side flow path (corresponding to the first low-temperature-side flow path 30*b* and the second low-temperature-side flow path 31*b*) are formed in the cooler (corresponding to the first refrigerant-to-refrigerant heat exchanger 30 and the second refrigerant-to-refrigerant heat exchanger 31). In the air conditioning apparatus 103, heat exchange is conducted between the refrigerant passing through the high-temperature-side flow path and the refrigerant passing through the low-temperature-side flow path. The flow path switching device (corresponding to the four-way valve 11) of the air conditioning apparatus 103 switches between the first refrigerant circuit 5*a* and the second refrigerant circuit 5*b*. In the first refrigerant circuit 5*a*, the refrigerant circulates in order of the compressor 10, the heat source-side heat exchanger (corresponding to the outdoor heat exchanger 12), the high-temperature-side flow path (corresponding to the first high-temperature-side flow path 30*a*), the pressure-reducing device (corresponding to the expansion valve 15), the load-side heat exchanger (corresponding to the indoor heat exchanger 20), the low-temperature-side flow path (corresponding to the first low-temperature-side flow path 30*b*), and the compressor 10. In the second refrigerant circuit 5*b*, the refrigerant circulates in order of the compressor 10, the load-side heat exchanger, the high-temperature-side flow path (corresponding to the second high-temperature-side flow path 31*a*), the pressure-reducing device, the heat source-side heat exchanger, the low-temperature-side flow path (corresponding to the second low-temperature-side flow path 31*b*), and the compressor 10. With this additional configuration, in the air conditioning apparatus 103 according to the embodiment II, in both the first refrigerant circuit 5*a* and the second refrigerant circuit 5*b*, heat exchange is conducted between the refrigerant flowing from the heat exchanger functioning as a condenser to the expansion valve 15 and the refrigerant flowing from the heat exchanger functioning as an evaporator to the compressor, and the refrigerant flowing into the compressor can be sufficiently heated. Therefore, with this additional configuration, the air conditioning apparatus 103 according to the embodiment II has the effect that the refrigerant which goes into a gas-liquid two-phase state due to gasification of the refrigerant flowing into the compressor is suppressed from flowing into the compressor or the effect that the dryness of the refrigerant flowing into the compressor is increased to improve operation efficiency, in both the first refrigerant circuit 5*a* and the second refrigerant circuit 5*b*.

Further, as an additional configuration, in the air conditioning apparatus 103 according to the embodiment II, in both the first refrigerant circuit 5*a* and the second refrigerant circuit 5*b*, the flow direction of the refrigerant flowing through the high-temperature-side flow path (corresponding to the first high-temperature-side flow path 30*a* in the first refrigerant circuit 5*a* and corresponding to the second high-temperature-side flow path 31*a* in the second refrigerant circuit 5*b*) is opposite to the flow direction of the refrigerant flowing through the low-temperature-side flow path (corresponding to the first low-temperature-side flow path 30*b* in the first refrigerant circuit 5*a* and corresponding to the second low-temperature-side flow path 31*b* in the second refrigerant circuit 5*b*). Generally, the heat exchange efficiency is higher when the flow directions of the refrigerants that exchange heat with each other in the heat exchanger are opposite to each other than when the flow directions of the refrigerants that exchange heat with each other are the same as each other. Therefore, with this additional configuration, the air conditioning apparatus 103 according to the embodiment II has an effect of improving the heat exchange efficiency of the refrigerant-to-refrigerant heat exchanger. When the heat exchange efficiency of the refrigerant-to-refrigerant heat exchanger is improved, the ability to cool the refrigerant passing through the high-temperature-side flow path is also improved, and even when the dryness of the refrigerant in a gas-liquid two-phase state which flows out from the heat exchanger functioning as a condenser is high, the refrigerant can be cooled to a liquid state. The ratio of the contained liquid refrigerant is lower in the refrigerant in a gas-liquid two-phase state which has a higher dryness than the refrigerant in a gas-liquid two-phase state which has a low dryness, and the refrigerant amount required for the operation of the air conditioning apparatus is further reduced. Therefore, with this additional configuration, the air conditioning apparatus 103 according to the embodiment II has an effect of further reducing the refrigerant amount required for the operation of the air conditioning apparatus.

Further, as an additional configuration, in the air conditioning apparatus 103 according to the embodiment II, the high-temperature-side flow path includes the first high-temperature-side flow path 30*a* and the second high-temperature-side flow path 31*a*, and the low-temperature-side flow path includes the first low-temperature-side flow path 30*b* and the second low-temperature-side flow path 31*b*. Heat exchange is conducted between the refrigerant passing through the first high-temperature-side flow path 30*a* and the refrigerant passing through the first low-temperature-side flow path 30*b*, and heat exchange is conducted between the refrigerant passing through the second high-temperature-side flow path 31*a* and the refrigerant passing through the second low-temperature-side flow path 31*b*. In the first refrigerant circuit, the refrigerant circulates in order of the compressor 10, the heat source-side heat exchanger, the first high-temperature-side flow path 30*a*, the pressure-reducing device, the load-side heat exchanger, the first low-temperature-side flow path 30*b*, and the compressor 10, and in the second refrigerant circuit, the refrigerant circulates in order of the compressor 10, the heat source-side heat exchanger, the second high-temperature-side flow path 31*a*, the pressure-reducing device, the load-side heat exchanger, the second low-temperature-side flow path 31*b*, and the compressor 10. With this additional configuration, the air conditioning apparatus 103 according to the embodiment II has the effect that the refrigerant which goes into a gas-liquid two-phase state due to gasification of the refrigerant flowing into the compressor is suppressed from flowing into the compressor or the effect that the dryness of the refrigerant flowing into the compressor is increased to improve operation efficiency, in both the first refrigerant circuit 5*a* and the second refrigerant circuit 5*b*.

Further, as an additional configuration, in the air conditioning apparatus 103 according to the embodiment II, in the first refrigerant circuit 5*a*, the refrigerant circulates in order of the compressor 10, the heat source-side heat exchanger, the first high-temperature-side flow path 30*a*, the pressure-reducing device, the second high-temperature-side flow path 31*a*, the load-side heat exchanger, one of the first low-temperature-side flow path 30*b* and the second low-temperature-side flow path 31*b*, the other of the first low-temperature-side flow path 30*b* and the second low-temperature-side flow path 31*b*, and the compressor 10, and in the second refrigerant circuit 5*b*, the refrigerant circulates in order of the compressor 10, the heat source-side heat exchanger, the second high-temperature-side flow path 31*a*, the pressure-reducing device, the first high-temperature-side flow path 30*a*, the load-side heat exchanger, one of the first low-temperature-side flow path 30*b* and the second low-temperature-side flow path 31*b*, the other of the first low-temperature-side flow path 30*b* and the second low-temperature-side flow path 31*b*, and the compressor 10. With this additional configuration, since the refrigerant to be suctioned into the compressor can also be heated by the refrigerant which has flowed out from the pressure-reducing device, the air conditioning apparatus 103 according to the embodiment II has the effect that the refrigerant to be suctioned into the compressor can be further heated.

Further, as an additional configuration, in the air conditioning apparatus 103 according to the embodiment II, in the first refrigerant circuit 5*a*, the flow direction of the refrigerant flowing through the first high-temperature-side flow path 30*a* is opposite to the flow direction of the refrigerant flowing through the first low-temperature-side flow path 30*b*, and in the second refrigerant circuit 5*b*, the flow direction of the refrigerant flowing through the second high-temperature-side flow path 31*a* is opposite to the flow direction of the refrigerant flowing through the second low-temperature-side flow path 31*b*. With this additional configuration, the flow direction of the refrigerant flowing from the heat exchanger functioning as a condenser to the pressure-reducing device is opposite to the flow direction of the refrigerant flowing from the heat exchanger functioning as an evaporator to the compressor, so that the air conditioning apparatus 103 according to the embodiment II has an effect of improving the heat exchange efficiency.

Further, as an additional configuration, in the air conditioning apparatus 103 according to the embodiment II, in the first refrigerant circuit 5*a*, an inlet port (corresponding to the first inlet and outlet port 30*e*) of the first high-temperature-side flow path 30*a* is formed at a place located downstream of the refrigerant flowing through the first low-temperature-side flow path 30*b* with respect to an outlet port (corresponding to the second inlet and outlet port 30*f*) of the first high-temperature-side flow path 30*a*, and in the second refrigerant circuit 5*b*, an inlet port (corresponding to the third inlet and outlet port 31*e*) of the second high-temperature-side flow path 31*a* is formed at a place located downstream of the refrigerant flowing through the second low-temperature-side flow path 31*b* with respect to an outlet port (corresponding to the fourth inlet and outlet port 31*f*) of the second high-temperature-side flow path 31*a*. With this additional configuration, the flow direction of the refrigerant flowing through the low-temperature-side flow path is oppose to the flow direction of the refrigerant flowing through the high-temperature-side flow path, so that the air conditioning apparatus 103 according to the embodiment II has an effect of improving the heat exchange efficiency.

Further, as an additional configuration, the air conditioning apparatus 103 according to the embodiment II has a configuration in which the refrigerant is R290. R290 has a higher boiling point than other refrigerants such as R410A and R32. The discharge temperature is unlikely to rise, and a situation in which the required degree of heating of the refrigerant to be discharged from the compressor is not satisfied is likely to occur. As described above, in the air conditioning apparatus 103 according to the embodiment II, since the refrigerant flowing into the compressor in both the first refrigerant circuit 5*a* and the second refrigerant circuit 5*b* is capable of being heated, the required degree of heating of the refrigerant to be discharged from the compressor is satisfied by heating the refrigerant to be suctioned into the compressor.

Similar to the outdoor unit 1 according to the embodiment I, the outdoor unit 1*b* according to the embodiment II also includes the compressor 10; the pressure-reducing device (corresponding to the expansion valve 15); the heat source-side heat exchanger (corresponding to the outdoor heat exchanger 12); the cooler (corresponding to the first refrigerant-to-refrigerant heat exchanger 30 and the second refrigerant-to-refrigerant heat exchanger 31) that cools the refrigerant; the flow path switching device (corresponding to the four-way valve 11); the first piping connection portion 18*a* connected to one end portion of the load-side heat exchanger flow path (corresponding to the indoor heat exchanger flow path 20*a*), which is formed in the load-side heat exchanger (corresponding to the indoor heat exchanger 20) that makes heat exchange to be conducted between the refrigerant and the load-side heat medium, via the piping (corresponding to the first connection refrigerant piping 3); and the second piping connection portion 18*b* connected to the other end portion of the load-side heat exchanger flow path via the piping (corresponding to the second connection refrigerant piping 4). The flow path switching device of the outdoor unit 1 switches between the first refrigerant circuit and the second refrigerant circuit. In the first refrigerant circuit, the refrigerant flows in order of the second piping connection portion 18*b*, the compressor 10, the heat source-side heat exchanger, the cooler (corresponding to the first refrigerant-to-refrigerant heat exchanger 30), the pressure-reducing device, and the first piping connection portion 18*a*. In the second refrigerant circuit, the refrigerant flows in order of the first piping connection portion 18*a*, the cooler (corresponding to the second refrigerant-to-refrigerant heat exchanger 31), the pressure-reducing device, the heat source-side heat exchanger, the compressor, and the second piping connection portion. Therefore, with this configuration, the outdoor unit 1*b* according to the embodiment II also has the same effect as the effect described in the embodiment I.

Incidentally, in the air conditioning apparatus 103 according to the embodiment II, in both the first refrigerant circuit 5*a* and the second refrigerant circuit 5*b*, the refrigerant that has flowed out from the heat exchanger functioning as an evaporator flows into the first low-temperature-side flow path 30*b* and the second low-temperature-side flow path 31*b* in order; however, the present disclosure is not limited thereto. For example, the refrigerant that has flowed out from the heat exchanger functioning as an evaporator may flow into the second low-temperature-side flow path 31*b* and the first low-temperature-side flow path 30*b* in order.

Modified Example I of Embodiment II

Next, an air conditioning apparatus according to a modified example I of the embodiment II will be described. In the air conditioning apparatus according to the modified example I of the embodiment II, the shapes of the first outer pipe 30*d* and the second outer pipe 31*d* are different from those of the air conditioning apparatus 103 according to the embodiment II. Incidentally, the air conditioning apparatus of the modified example I of the embodiment II has the same configuration as that of the air conditioning apparatus 103 according to the embodiment II except for the shapes of the first outer pipe 30*d* and the second outer pipe 31*d*, and a description thereof will be omitted.

Figure 12:
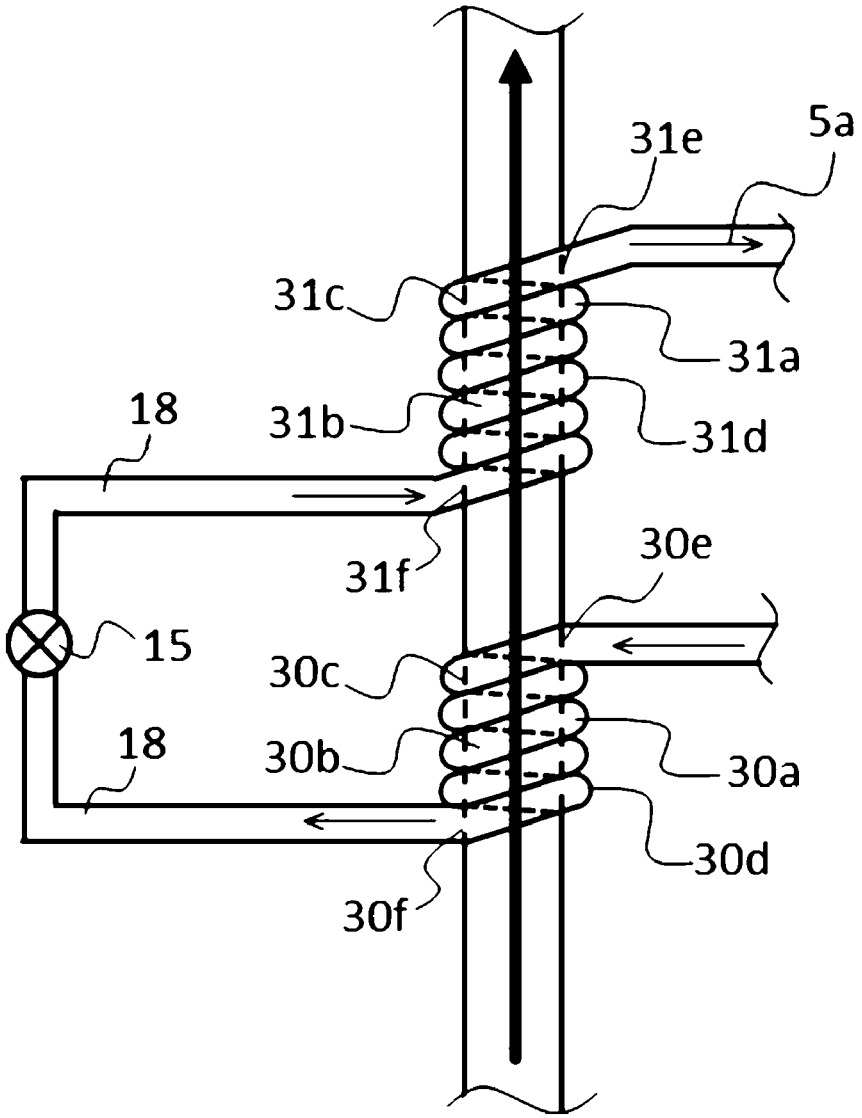
FIG. 12 is a schematic view of a first refrigerant-to-refrigerant heat exchanger and a second refrigerant-to-refrigerant heat exchanger in a first refrigerant circuit of an air conditioning apparatus according to a modified example I of the embodiment II.
Figure 13:
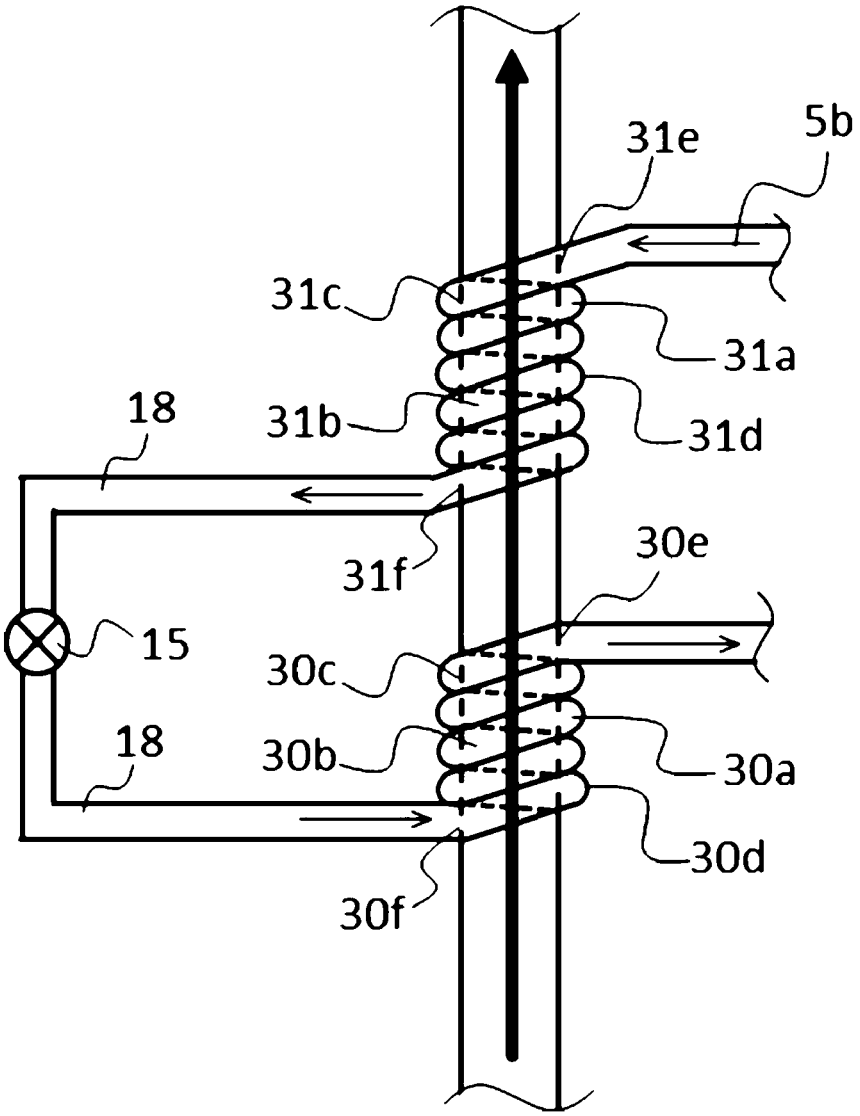
FIG. 13 is a schematic view of the first refrigerant-to-refrigerant heat exchanger and the second refrigerant-to-refrigerant heat exchanger in a second refrigerant circuit of the air conditioning apparatus according to the modified example I of the embodiment II.

FIG. 12 is a schematic view of a first refrigerant-to-refrigerant heat exchanger and a second refrigerant-to-refrigerant heat exchanger in a first refrigerant circuit of the air conditioning apparatus according to the modified example I of the embodiment II. FIG. 13 is a schematic view of the first refrigerant-to-refrigerant heat exchanger and the second refrigerant-to-refrigerant heat exchanger in a second refrigerant circuit of the air conditioning apparatus according to the modified example I of the embodiment II.

The first outer pipe 30*d* is a piping through which the refrigerant flows. One end portion of the first outer pipe 30*d* is connected to the outdoor heat exchanger 12 via the outdoor unit refrigerant piping 18. The other end portion of the first outer pipe 30*d* is connected to the expansion valve 15 via the outdoor unit refrigerant piping 18. The first outer pipe 30*d* is spirally wound around an outer periphery of the first inner pipe 30*c* at a predetermined pitch such that the one end portion of the first outer pipe 30*d* is located downstream of the other end portion with respect to the refrigerant flowing through the first low-temperature-side flow path 30*b*. Incidentally, an inner flow path of the first outer pipe 30*d* corresponds to the first high-temperature-side flow path 30*a*. The one end portion of the first outer pipe 30*d* corresponds to one end portion of the first high-temperature-side flow path 30*a* and the first inlet and outlet port 30*e*, and the other end portion of the first outer pipe 30*d* corresponds to the other end portion of the first high-temperature-side flow path 30*a* and the second inlet and outlet port 30*f*.

The second outer pipe 31*d* is a piping through which the refrigerant flows. One end portion of the second outer pipe 31*d* is connected to the indoor heat exchanger 20 via the outdoor unit refrigerant piping 18, the strainer 16, the first shutoff valve 17*a*, the first connection refrigerant piping 3, and the indoor unit refrigerant piping 21. The other end portion of the second outer pipe 31*d* is connected to the expansion valve 15 via the outdoor unit refrigerant piping 18. The second outer pipe 31*d* is spirally wound around an outer periphery of the second inner pipe 31*c* at a predetermined pitch such that the one end portion of the second outer pipe 31*d* is located downstream of the other end portion with respect to the refrigerant flowing through the second low-temperature-side flow path 31*b*. Incidentally, an inner flow path of the second outer pipe 31*d* corresponds to the second high-temperature-side flow path 31*a*. The one end portion of the second outer pipe 31*d* corresponds to one end portion of the second high-temperature-side flow path 31*a* and the third inlet and outlet port 31*e*, and the other end portion of the second outer pipe 31*d* corresponds to the other end portion of the second high-temperature-side flow path 31*a* and the fourth inlet and outlet port 31*f*.

In the first refrigerant circuit 5*a*, as showed in FIG. 12, the refrigerant that has flowed out from the outdoor heat exchanger 12 flows into the first high-temperature-side flow path 30*a* from the first inlet and outlet port 30*e*, and the refrigerant that has passed through the first high-temperature-side flow path 30*a* flows out to the expansion valve 15 from the second inlet and outlet port 30*f*. Further, the refrigerant that has flowed out from the expansion valve 15 flows into the second high-temperature-side flow path 31*a* from the fourth inlet and outlet port 31*f*, and the refrigerant that has passed through the second high-temperature-side flow path 31*a* flows into the indoor heat exchanger 20 from the third inlet and outlet port 31*e*. As described above, in the first refrigerant circuit 5*a*, a flow direction of the refrigerant passing through the first high-temperature-side flow path 30*a* is opposite to a flow direction of the refrigerant passing through the first low-temperature-side flow path 30*b*. In the first refrigerant circuit 5*a*, a flow direction of the refrigerant passing through the second high-temperature-side flow path 31*a* is the same as the flow direction of the refrigerant passing through the second low-temperature-side flow path 31*b*.

In the second refrigerant circuit 5*b*, as showed in FIG. 13, the refrigerant that has flowed out from the indoor heat exchanger 20 flows into the second high-temperature-side flow path 31*a* from the third inlet and outlet port 31*e*, and the refrigerant that has passed through the second high-temperature-side flow path 31*a* flows out to the expansion valve 15 from the fourth inlet and outlet port 31*f*. Further, the refrigerant that has flowed out from the expansion valve 15 flows into the first high-temperature-side flow path 30*a* from the second inlet and outlet port 30*f*, and the refrigerant that has passed through the first high-temperature-side flow path 30*a* flows out to the outdoor heat exchanger 12 from the first inlet and outlet port 30*e*. As described above, in the second refrigerant circuit 5*b*, a flow direction of the refrigerant passing through the first high-temperature-side flow path 30*a* is the same as a flow direction of the refrigerant passing through the first low-temperature-side flow path 30*b*. In the second refrigerant circuit 5*b*, a flow direction of the refrigerant passing through the second high-temperature-side flow path 31*a* is opposite to the flow direction of the refrigerant passing through the second low-temperature-side flow path 31*b*.

As described above, as an additional configuration, in the air conditioning apparatus according to the modified example I of the embodiment II, the refrigerant-to-refrigerant heat exchanger (corresponding to the first refrigerant-to-refrigerant heat exchanger 30 and the second refrigerant-to-refrigerant heat exchanger 31) includes a first piping (corresponding to the first inner pipe 30*c* and the second inner pipe 31*c*) forming the low-temperature-side flow path (corresponding to the first low-temperature-side flow path 30*b* and the second low-temperature-side flow path 31*b*), and a second piping (corresponding to the first outer pipe 30*d* and the second outer pipe 31*d*) that forms the high-temperature-side flow path (corresponding to the first high-temperature-side flow path 30*a* and the second high-temperature-side flow path 31*a*) and is spirally wound around the first piping. With this additional configuration, the pipe contact surface area between the first piping and the second piping is larger than that in the structure of the refrigerant-to-refrigerant heat exchanger of the air conditioning apparatus according to the embodiment II, so that the heat exchange efficiency is improved. With this additional configuration, since the internal volume of the second piping is smaller than that in the structure of the refrigerant-to-refrigerant heat exchanger of the air conditioning apparatus according to the embodiment II, the refrigerant amount existing in the refrigerant-to-refrigerant heat exchanger is reduced, so that the refrigerant amount can be reduced.

Modified Example II of Embodiment II

Next, an air conditioning apparatus 104 according to a modified example II of the embodiment II will be described. The air conditioning apparatus 104 according to the modified example II of the embodiment II is different from the air conditioning apparatus 103 according to the embodiment II in that an outdoor unit 1*c* includes an accumulator 19. Incidentally, since the air conditioning apparatus 104 according to the modified example II of the embodiment II has the same configuration as that of the air conditioning apparatus 103 according to the embodiment II except that the outdoor unit 1*c* includes the accumulator 19, a description thereof will be omitted.

Figure 14:
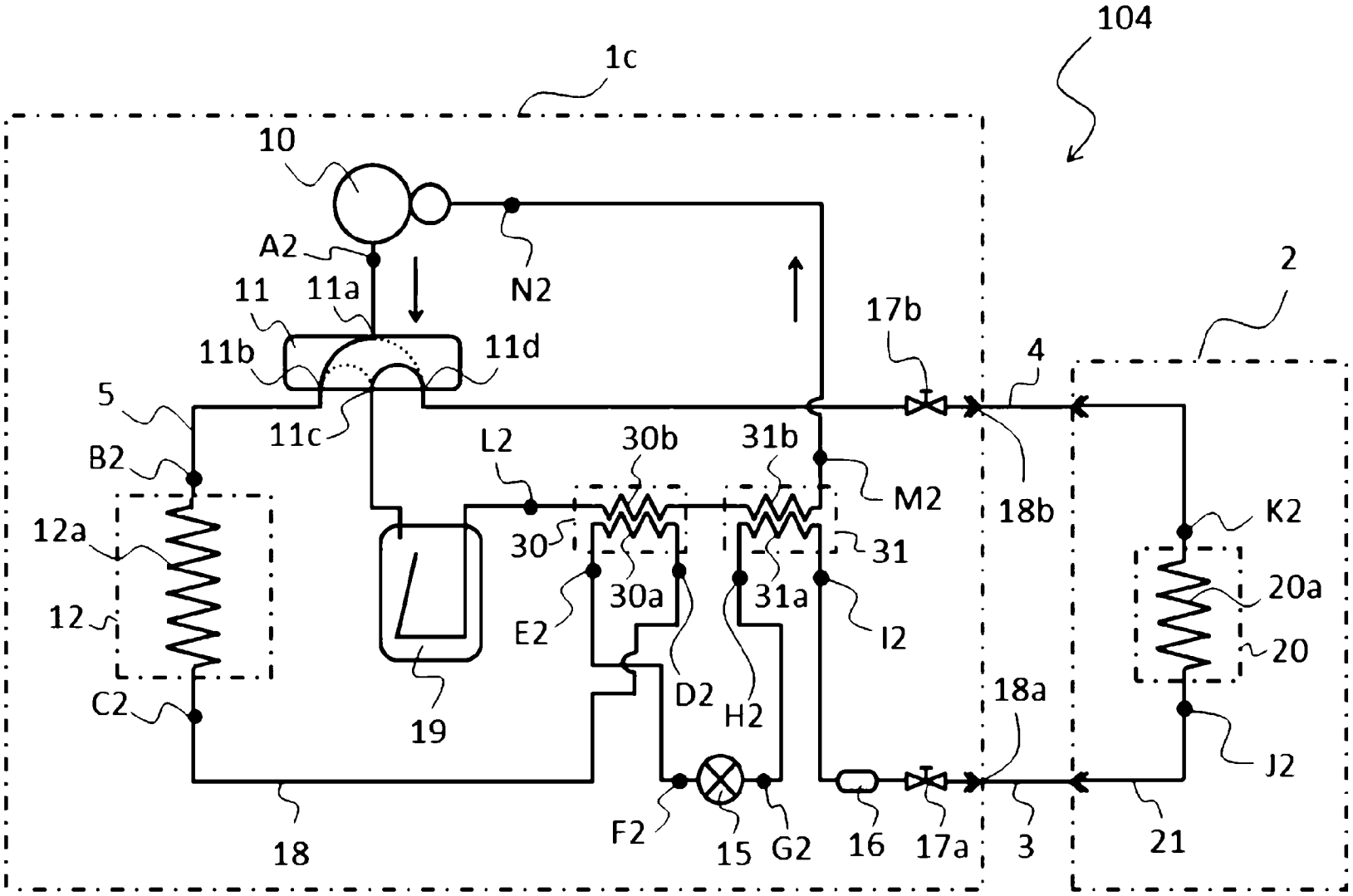
FIG. 14 is a refrigerant circuit diagram of an air conditioning apparatus according to a modified example II of the embodiment II.

FIG. 14 is a refrigerant circuit diagram of the air conditioning apparatus according to the modified example II of the embodiment II. In the outdoor unit 1*c*, the third port 11*c* of the four-way valve 11 and the first low-temperature-side flow path 30*b* are connected to each other via the outdoor unit refrigerant piping 18 and the accumulator 19.

The accumulator 19 stores the surplus refrigerant generated by a difference in refrigerant amount used between the case of the first refrigerant circuit 5*a* and the case of the second refrigerant circuit 5*b*, or the surplus refrigerant generated in a transitional period or the like immediately after the refrigerant circuit has been changed, as the liquid refrigerant.

In the first refrigerant circuit 5*a*, the refrigerant in a gas-liquid two-phase state which has flowed out from the indoor heat exchanger flow path 20*a* passes through the accumulator 19 to flow into the first low-temperature-side flow path 30*b*. In the second refrigerant circuit 5*b*, the refrigerant in a gas-liquid two-phase state which has flowed out from the outdoor heat exchanger flow path 12*a* passes through the accumulator 19 to flow into the first low-temperature-side flow path 30*b*. Namely, in the air conditioning apparatus 104 according to the modified example II of the embodiment II, in both the first refrigerant circuit 5*a* and the second refrigerant circuit 5*b*, the refrigerant that has flowed out from the heat exchanger functioning as an evaporator passes through the accumulator 19, and then flows into the first low-temperature-side flow path 30*b*.

As described above, as an additional configuration, the air conditioning apparatus 104 according to the modified example II of the embodiment II includes the accumulator 19 that stores the refrigerant. In the first refrigerant circuit 5*a* of the air conditioning apparatus 104, the refrigerant circulates in order of the compressor 10, the heat source-side heat exchanger, the high-temperature-side flow path, the pressure-reducing device, the load-side heat exchanger, the accumulator 19, the low-temperature-side flow path, and the compressor 10, and in the second refrigerant circuit 5*b*, the refrigerant circulates in order of the compressor, the load-side heat exchanger, the high-temperature-side flow path, the pressure-reducing device, the heat source-side heat exchanger, the accumulator 19, the low-temperature-side flow path, and the compressor. Generally, the accumulator is provided with an oil return hole that allows the chiller oil accumulated in the accumulator to return to the compressor. In a state where the liquid refrigerant is accumulated in the accumulator, the liquid refrigerant from the oil return hole flows out to the refrigerant piping from the accumulator. Therefore, the refrigerant that has flowed out from the accumulator contains the liquid refrigerant that has flowed out from the oil return hole. Therefore, with this additional configuration, since the refrigerant that has flowed out from the accumulator flows into the low-temperature-side flow path and is heated in the low-temperature-side flow path, the air conditioning apparatus 104 according to the modified example II of the embodiment II has an effect of more increasing the dryness of the refrigerant to be suctioned into the compressor than when the refrigerant that has flowed out from the low-temperature-side flow path flows into the accumulator.

Embodiment III

Next, an air conditioning apparatus 105 according to an embodiment III will be described. The air conditioning apparatus 105 according to the embodiment III is different from the air conditioning apparatus 103 according to the embodiment II in that an outdoor unit 1*d* includes a first bypass piping 18*c*, a second bypass piping 18*d*, a first three-way valve 32, and a second three-way valve 33, which is a new configuration. Incidentally, since the air conditioning apparatus 105 according to the embodiment III has the same configuration as that of the air conditioning apparatus 100 according to the embodiment I except for a structure of the outdoor unit 1*d*, a description thereof will be omitted.

Figure 15:
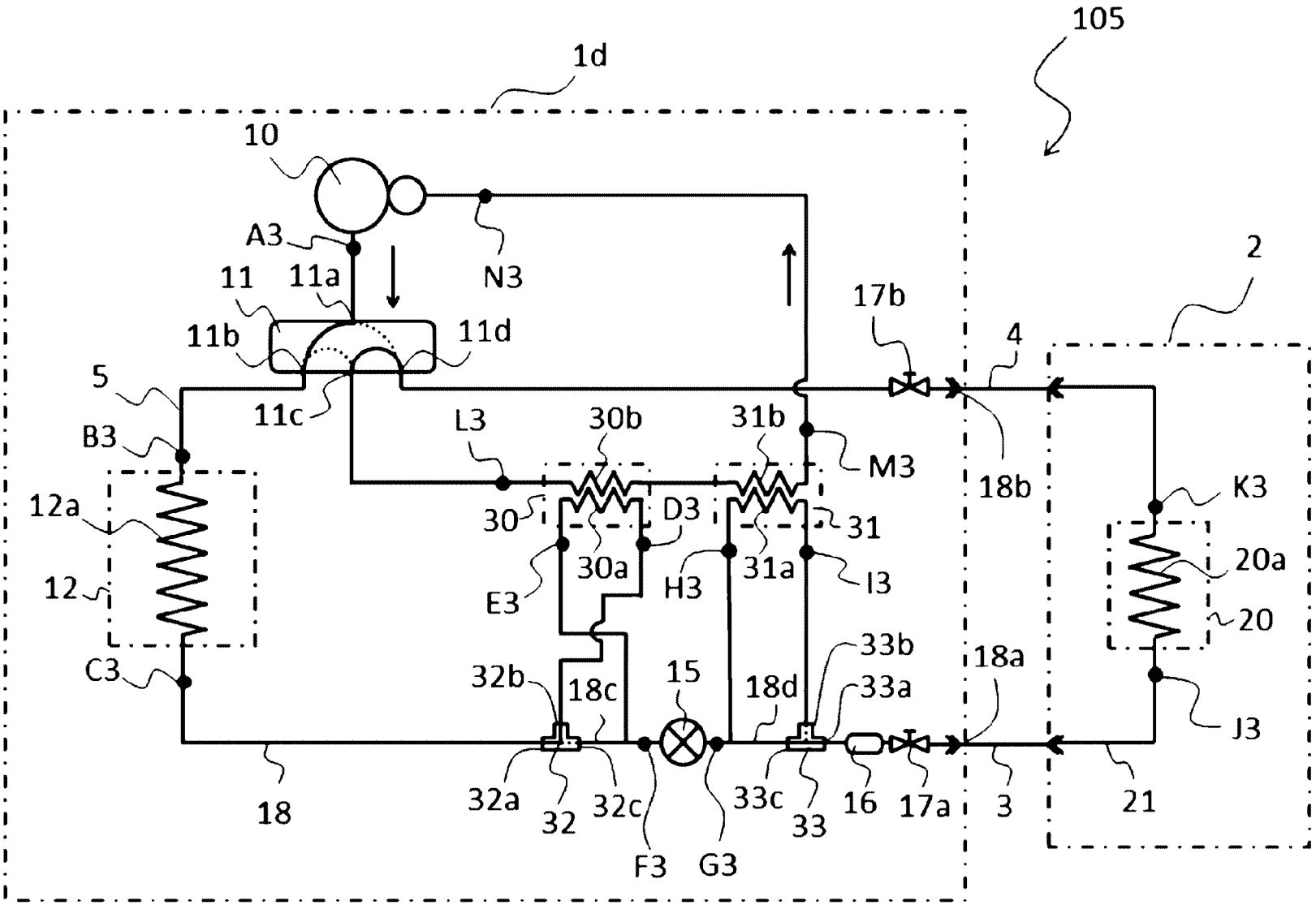
FIG. 15 is a refrigerant circuit diagram of an air conditioning apparatus according to an embodiment III.

FIG. 15 is a refrigerant circuit diagram of the air conditioning apparatus according to the embodiment III. The outdoor unit 1*d* includes the compressor 10, the four-way valve 11, the outdoor heat exchanger 12, the expansion valve 15, the strainer 16, two shutoff valves 17, the first refrigerant-to-refrigerant heat exchanger 30, the second refrigerant-to-refrigerant heat exchanger 31, the first three-way valve 32, and the second three-way valve 33 inside a housing, and these components are connected to each other via the outdoor unit refrigerant piping 18, the first bypass piping 18*c*, or the second bypass piping 18*d*. Incidentally, since the compressor 10, the four-way valve 11, the outdoor heat exchanger 12, the expansion valve 15, the strainer 16, the two shutoff valves 17, the first refrigerant-to-refrigerant heat exchanger 30, and the second refrigerant-to-refrigerant heat exchanger 31 according to the embodiment III are substantially the same as the components with the same reference signs according to the embodiment II except for a connection relationship between some components, a description thereof will be omitted.

The first three-way valve 32 switches between the first refrigerant circuit 5*a* and the second refrigerant circuit 5*b*. Specifically, the first three-way valve 32 includes a total of three ports, namely, a fifth port 32*a*, a sixth port 32*b*, and a seventh port 32*c*. The fifth port 32*a* is connected to the other end portion of the outdoor heat exchanger flow path 12*a* via the outdoor unit refrigerant piping 18. The sixth port 32*b* is connected to one end portion of the first high-temperature-side flow path 30*a* via the outdoor unit refrigerant piping 18. The seventh port 32*c* bypasses the first high-temperature-side flow path 30*a*, and is connected to the expansion valve 15 via the first bypass piping 18*c*.

The second three-way valve 33 switches between the first refrigerant circuit 5*a* and the second refrigerant circuit 5*b*. Specifically, the second three-way valve 33 includes a total of three ports, namely, an eighth port 33*a*, a ninth port 33*b*, and a tenth port 33*c*. The eighth port 33*a* is connected to one end portion of the indoor heat exchanger flow path 20*a* via the outdoor unit refrigerant piping 18, the strainer 16, the first shutoff valve 17*a*, the first connection refrigerant piping 3, and the indoor unit refrigerant piping 21. The ninth port 33*b* is connected to the other end portion of the second high-temperature-side flow path 31*a* via the outdoor unit refrigerant piping 18. The tenth port 33*c* bypasses the second high-temperature-side flow path 31*a*, and is connected to the expansion valve 15 via the second bypass piping 18*d*.

Figure 16:
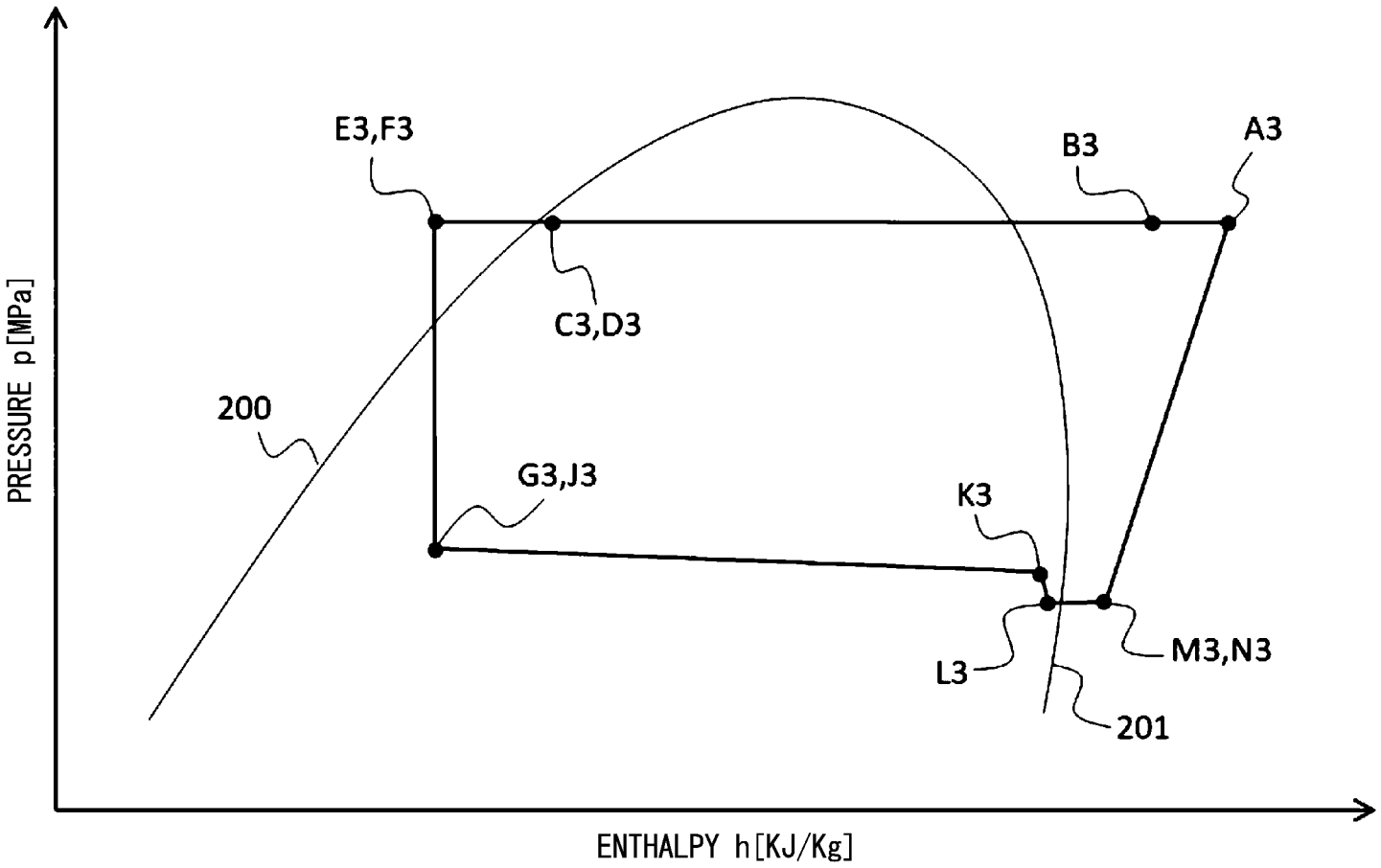
FIG. 16 is a pressure-enthalpy diagram showing a refrigeration cycle in a first refrigerant circuit of the air conditioning apparatus according to the embodiment III.

FIG. 16 is a pressure-enthalpy diagram showing a refrigeration cycle in a first refrigerant circuit of the air conditioning apparatus according to the embodiment III. Next, a flow of the refrigerant circulating in the first refrigerant circuit 5*a* during cooling operation will be described. In the first refrigerant circuit 5*a*, the four-way valve 11, the first three-way valve 32, and the second three-way valve 33 switch to a flow path showed by a solid line in FIG. 15. Namely, in the first refrigerant circuit 5*a*, the four-way valve 11 is in a state where the first port 11*a* and the second port 11*b* are connected to each other and the third port 11*c* and the fourth port 11*d* are connected to each other. In addition, in the first refrigerant circuit 5*a*, the first three-way valve 32 is in a state where the fifth port 32*a* and the sixth port 32*b* are connected and the seventh port 32*c* is closed. Further, in the first refrigerant circuit 5*a*, the second three-way valve 33 is in a state where the eighth port 33*a* and the tenth port 33*c* are connected to each other and the ninth port 33*b* is closed. Incidentally, the state of the refrigerant showed by A3-N3 in FIG. 16 corresponds to the state of the refrigerant in A3-N3 of the refrigerant circuit of the air conditioning apparatus 105 showed in FIG. 15.

First, similar to the embodiment I, the refrigerant in a high-temperature and high-pressure gas state (A3) which has been discharged from the compressor 10 flows into the outdoor heat exchanger flow path 12*a* (B3). Since the outdoor heat exchanger 12 functions as a condenser similar to the embodiment I, the refrigerant in a high-pressure gas-liquid two-phase state flows out from the outdoor heat exchanger flow path 12*a* (C3).

The refrigerant that has flowed out from the outdoor heat exchanger flow path 12*a* flows into the first high-temperature-side flow path 30*a* (D3). The refrigerant in a high-pressure gas-liquid two-phase state passing through the first high-temperature-side flow path 30*a* is cooled by the refrigerant passing through the first low-temperature-side flow path 30*b*. The cooled refrigerant goes into a high-pressure liquid state, and flows out from the first high-temperature-side flow path 30*a* (E3).

The refrigerant in a liquid state which has flowed out from the first high-temperature-side flow path 30*a* flows into the expansion valve 15 (F3), goes into a low-pressure gas-liquid two-phase state, and flows out from the expansion valve 15 (G3). The refrigerant that has flowed out from the expansion valve 15 passes through the second bypass piping 18*d*, and flows into the indoor heat exchanger flow path 20*a* without passing through the second high-temperature-side flow path 31*a* (J3). Since the indoor heat exchanger 20 functions as an evaporator similar to the embodiment I, the refrigerant in a gas-liquid two-phase state which has a higher enthalpy and a lower pressure than the refrigerant immediately before flowing into the indoor heat exchanger flow path 20*a* flows out from the indoor heat exchanger flow path 20*a* (K3).

The refrigerant that has flowed out from the indoor heat exchanger flow path 20*a* flows into the first low-temperature-side flow path 30*b* and the second low-temperature-side flow path 31*b* in order (L3). The refrigerant in a gas-liquid two-phase state passing through the first low-temperature-side flow path 30*b* is heated into a low-pressure gas state by the refrigerant passing through the first high-temperature-side flow path 30*a*, goes into in a low-pressure gas state, and flows out from the first low-temperature-side flow path 30*b*. The refrigerant that has flowed out from the first low-temperature-side flow path 30*b* passes through the second low-temperature-side flow path 31*b* (M3), is suctioned into the suction port of the compressor 10 (N3), and is discharged again in a high-temperature and high-pressure gas state (A3). Incidentally, in the first refrigerant circuit 5*a*, since the refrigerant does not pass through the second high-temperature-side flow path 31*a*, the refrigerant passing through the second low-temperature-side flow path 31*b* is not heated.

Figure 17:
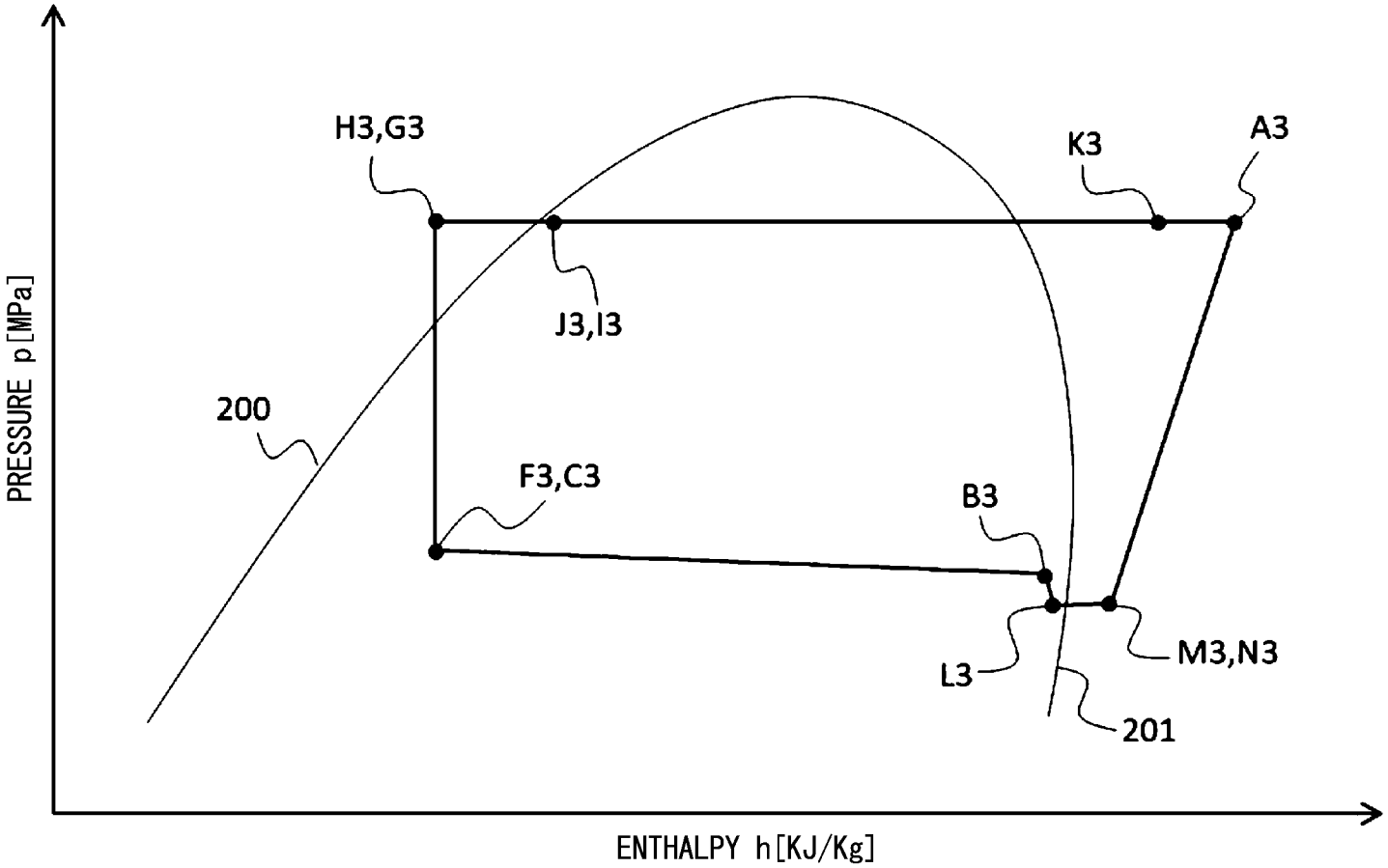
FIG. 17 is a pressure-enthalpy diagram showing a refrigeration cycle in a second refrigerant circuit of the air conditioning apparatus according to the embodiment III.

FIG. 17 is a pressure-enthalpy diagram showing a refrigeration cycle in a second refrigerant circuit of the air conditioning apparatus according to the embodiment III. Next, a flow of the refrigerant circulating in the second refrigerant circuit 5*b* during heating operation will be described. In the second refrigerant circuit 5*b*, the four-way valve 11, the first three-way valve 32, and the second three-way valve 33 switch to a flow path showed by a dotted line in FIG. 15. Namely, in the second refrigerant circuit 5*b*, the four-way valve 11 is in a state where the first port 11*a* and the fourth port 11*d* are connected to each other and the second port 11*b* and the third port 11*c* are connected to each other. In the second refrigerant circuit 5*b*, the first three-way valve 32 is in a state where the fifth port 32*a* and the seventh port 32*c* are connected and the sixth port 32*b* is closed. Further, in the second refrigerant circuit 5*b*, the second three-way valve 33 is in a state where the eighth port 33*a* and the ninth port 33*b* are connected to each other and the tenth port 33*c* is closed. Incidentally, the state of the refrigerant showed by A3-N3 in FIG. 17 corresponds to the state of the refrigerant in A3-N3 of the refrigerant circuit of the air conditioning apparatus 105 showed in FIG. 15.

First, similar to the embodiment I, the refrigerant in a high-temperature and high-pressure gas state (A3) which has been discharged from the compressor 10 flows into the indoor heat exchanger flow path 20*a* (K3). Since the indoor heat exchanger 20 functions as a condenser similar to the embodiment I, the refrigerant in a high-pressure gas-liquid two-phase state flows out from the indoor heat exchanger flow path 20*a* (J3).

The refrigerant that has flowed out from the indoor heat exchanger flow path 20*a* flows into the second high-temperature-side flow path 31*a* (I3). The refrigerant in a high-pressure gas-liquid two-phase state passing through the second high-temperature-side flow path 31*a* is cooled by the refrigerant passing through the second low-temperature-side flow path 31*b*. The cooled refrigerant goes into a high-pressure liquid state, and flows out from the second high-temperature-side flow path 31*a* (H3).

The refrigerant in a liquid state which has flowed out from the second high-temperature-side flow path 31*a* flows into the expansion valve 15 (G3), goes into a low-pressure gas-liquid two-phase state, and flows out from the expansion valve 15 (F3). The refrigerant that has flowed out from the expansion valve 15 passes through the first bypass piping 18*c*, and flows into the outdoor heat exchanger flow path 12*a* without passing through the first high-temperature-side flow path 30*a* (C3). Since the outdoor heat exchanger 12 functions as an evaporator similar to the embodiment I, the refrigerant in a gas-liquid two-phase state which has a higher enthalpy and a lower pressure than the refrigerant immediately before flowing into the outdoor heat exchanger flow path 12*a* flows out from the outdoor heat exchanger flow path 12*a* (B3).

The refrigerant that has flowed out from the outdoor heat exchanger flow path 12*a* flows into the first low-temperature-side flow path 30*b* and the second low-temperature-side flow path 31*b* in order (L3). The refrigerant in a gas-liquid two-phase state which flows out from the first low-temperature-side flow path 30*b* to pass through the second low-temperature-side flow path 31*b* is heated into a low-pressure gas state by the refrigerant passing through the second high-temperature-side flow path 31*a*, and the refrigerant in a low-pressure gas state flows out from the second low-temperature-side flow path 31*b* (M3). The refrigerant that has flowed out from the second low-temperature-side flow path 31*b* is suctioned into the suction port of the compressor 10 (N3), and is discharged again in a high-temperature and high-pressure gas state (A3). Incidentally, in the second refrigerant circuit 5*b*, since the refrigerant does not pass through the first high-temperature-side flow path 30*a*, the refrigerant passing through the first low-temperature-side flow path 30*b* is not heated.

As described above, the air conditioning apparatus 105 according to the embodiment III includes the refrigerant-to-refrigerant heat exchanger (corresponding to the first refrigerant-to-refrigerant heat exchanger 30 in the first refrigerant circuit 5*a* and corresponding to the second refrigerant-to-refrigerant heat exchanger 31 in the second refrigerant circuit 5*b*) that makes heat exchange to be conducted between the refrigerant flowing from the heat exchanger functioning as a condenser to the expansion valve 15 and the refrigerant flowing from the heat exchanger that functions as an evaporator to the compressor in both the first refrigerant circuit 5*a* and the second refrigerant circuit 5*b*.

In the air conditioning apparatus 105 according to the embodiment III, the refrigerant flowing from the heat exchanger functioning as a condenser to the refrigerant-to-refrigerant heat exchanger (corresponding to the first refrigerant-to-refrigerant heat exchanger 30 in the first refrigerant circuit 5*a* and corresponding to the second refrigerant-to-refrigerant heat exchanger 31 in the second refrigerant circuit 5*b*) in both the first refrigerant circuit 5*a* and the second refrigerant circuit 5*b* is in a gas-liquid two-phase state.

In the air conditioning apparatus 105 according to the embodiment III, the refrigerant flowing from the refrigerant-to-refrigerant heat exchanger (corresponding to the first refrigerant-to-refrigerant heat exchanger 30 in the first refrigerant circuit 5*a* and corresponding to the second refrigerant-to-refrigerant heat exchanger 31 in the second refrigerant circuit 5*b*) to the expansion valve 15 in both the first refrigerant circuit 5*a* and the second refrigerant circuit 5*b* is in a liquid state.

As described above, similar to the air conditioning apparatus 100 according to the embodiment I, the air conditioning apparatus 105 according to the embodiment III includes the cooler (corresponding to the first refrigerant-to-refrigerant heat exchanger 30 and the second refrigerant-to-refrigerant heat exchanger 31) that cools the refrigerant. The flow path switching device (corresponding to the four-way valve 11, the first three-way valve 32, and the second three-way valve 33) of the air conditioning apparatus 105 switches between the first refrigerant circuit 5*a* and the second refrigerant circuit 5*b*. In the first refrigerant circuit 5*a*, the refrigerant circulates in order of the compressor 10, the heat source-side heat exchanger (corresponding to the outdoor heat exchanger 12), the cooler (corresponding to the first refrigerant-to-refrigerant heat exchanger 30), the pressure-reducing device (corresponding to the expansion valve 15), the load-side heat exchanger (corresponding to the indoor heat exchanger 20), and the compressor 10. In the second refrigerant circuit 5*b*, the refrigerant circulates in order of the compressor 10, the load-side heat exchanger, the cooler (corresponding to the second refrigerant-to-refrigerant heat exchanger 31), the pressure-reducing device, the heat source-side heat exchanger, and the compressor 10. Therefore, with this configuration, the air conditioning apparatus 105 according to the embodiment III also has the same effect as the effect described in the embodiment I.

Further, as an additional configuration, in the air conditioning apparatus 105 according to the embodiment III, the cooler includes a first cooler (corresponding to the first refrigerant-to-refrigerant heat exchanger 30) and a second cooler (corresponding to the second refrigerant-to-refrigerant heat exchanger 31). The flow path switching device connects: the discharge port of the compressor 10 and the heat source-side heat exchanger; the heat source-side heat exchanger and the first cooler; the pressure-reducing device and the load-side heat exchanger without via the second cooler, and the load-side heat exchanger and the suction port of the compressor 10 in the first refrigerant circuit 5*a* with each other, and to connect the discharge port of the compressor 10 and the load-side heat exchanger, the load-side heat exchanger and the second cooler, the pressure-reducing device and the heat source-side heat exchanger without via the first cooler, and the heat source-side heat exchanger and a suction side of the compressor 10 in the second refrigerant circuit 5*b* with each other. With this additional configuration, in the air conditioning apparatus 105 according to the embodiment III, the lengths of the first refrigerant circuit and the second refrigerant circuit are shorter than those in the structure of the air conditioning apparatus according to the embodiment II, so that the refrigerant amount can be further reduced.

Further, as an additional configuration, in the air conditioning apparatus 105 according to the embodiment III, the high-temperature-side flow path includes the first high-temperature-side flow path 30*a* and the second high-temperature-side flow path 31*a*. The flow path switching device of the air conditioning apparatus 105 connects: the discharge port of the compressor 10 and the heat source-side heat exchanger; the heat source-side heat exchanger and the first high-temperature-side flow path 30*a*; the pressure-reducing device and the load-side heat exchanger without via the second high-temperature-side flow path 31*a*; and the load-side heat exchanger and the low-temperature-side flow path with each other in the first refrigerant circuit 5*a*, and to connect: the discharge port of the compressor 10 and the load-side heat exchanger; the load-side heat exchanger and the second high-temperature-side flow path 31*a*; the pressure-reducing device and the heat source-side heat exchanger without via the first high-temperature-side flow path 30*a*; and the heat source-side heat exchanger and the low-temperature-side flow path with each other in the second refrigerant circuit 5*b*. With this additional configuration, in the air conditioning apparatus 105 according to the embodiment III, the lengths of the first refrigerant circuit and the second refrigerant circuit are shorter than those in the structure of the air conditioning apparatus 103 according to the embodiment II, so that the refrigerant amount is capable of being further reduced.

Similar to the outdoor unit 1 according to the embodiment I, the outdoor unit 1*d* according to the embodiment III also includes the compressor 10; the pressure-reducing device (corresponding to the expansion valve 15); the heat source-side heat exchanger (corresponding to the outdoor heat exchanger 12); the cooler (corresponding to the first refrigerant-to-refrigerant heat exchanger 30 and the second refrigerant-to-refrigerant heat exchanger 31) that cools the refrigerant; the flow path switching device (corresponding to the four-way valve 11, the first three-way valve 32, and the second three-way valve 33); the first piping connection portion 18*a* connected to one end portion of the load-side heat exchanger flow path (corresponding to the indoor heat exchanger flow path 20*a*), which is formed in the load-side heat exchanger (corresponding to the indoor heat exchanger 20) that makes heat exchange to be conducted between the refrigerant and the load-side heat medium, via the piping (corresponding to the first connection refrigerant piping 3); and the second piping connection portion 18*b* connected to the other end portion of the load-side heat exchanger flow path via the piping (corresponding to the second connection refrigerant piping 4). The flow path switching device of the outdoor unit 1*d* switches between the first refrigerant circuit and the second refrigerant circuit. In the first refrigerant circuit, the refrigerant flows in order of the second piping connection portion 18*b*, the compressor 10, the heat source-side heat exchanger, the cooler (corresponding to the first refrigerant-to-refrigerant heat exchanger 30), the pressure-reducing device, and the first piping connection portion 18*a*. In the second refrigerant circuit, the refrigerant flows in order of the first piping connection portion 18*a*, the cooler (corresponding to the second refrigerant-to-refrigerant heat exchanger 31), the pressure-reducing device, the heat source-side heat exchanger, the compressor, and the second piping connection portion. Therefore, with this configuration, the outdoor unit 1*d* according to the embodiment III also has the same effect as the effect described in the embodiment I.

Embodiment IV

Next, an air conditioning apparatus 106 according to an embodiment IV will be described. The air conditioning apparatus 106 according to the embodiment IV is different from the air conditioning apparatus 103 according to the embodiment II in that an outdoor unit 1*e* includes the first three-way valve 32, the second three-way valve 33, and the refrigerant-to-refrigerant heat exchanger 34 instead of the first refrigerant-to-refrigerant heat exchanger 30 and the second refrigerant-to-refrigerant heat exchanger 31. Incidentally, since the air conditioning apparatus 106 according to the embodiment IV has the same configuration as that of the air conditioning apparatus 100 according to the embodiment I except for a structure of the outdoor unit 1*e*, a description thereof will be omitted.

Figure 18:
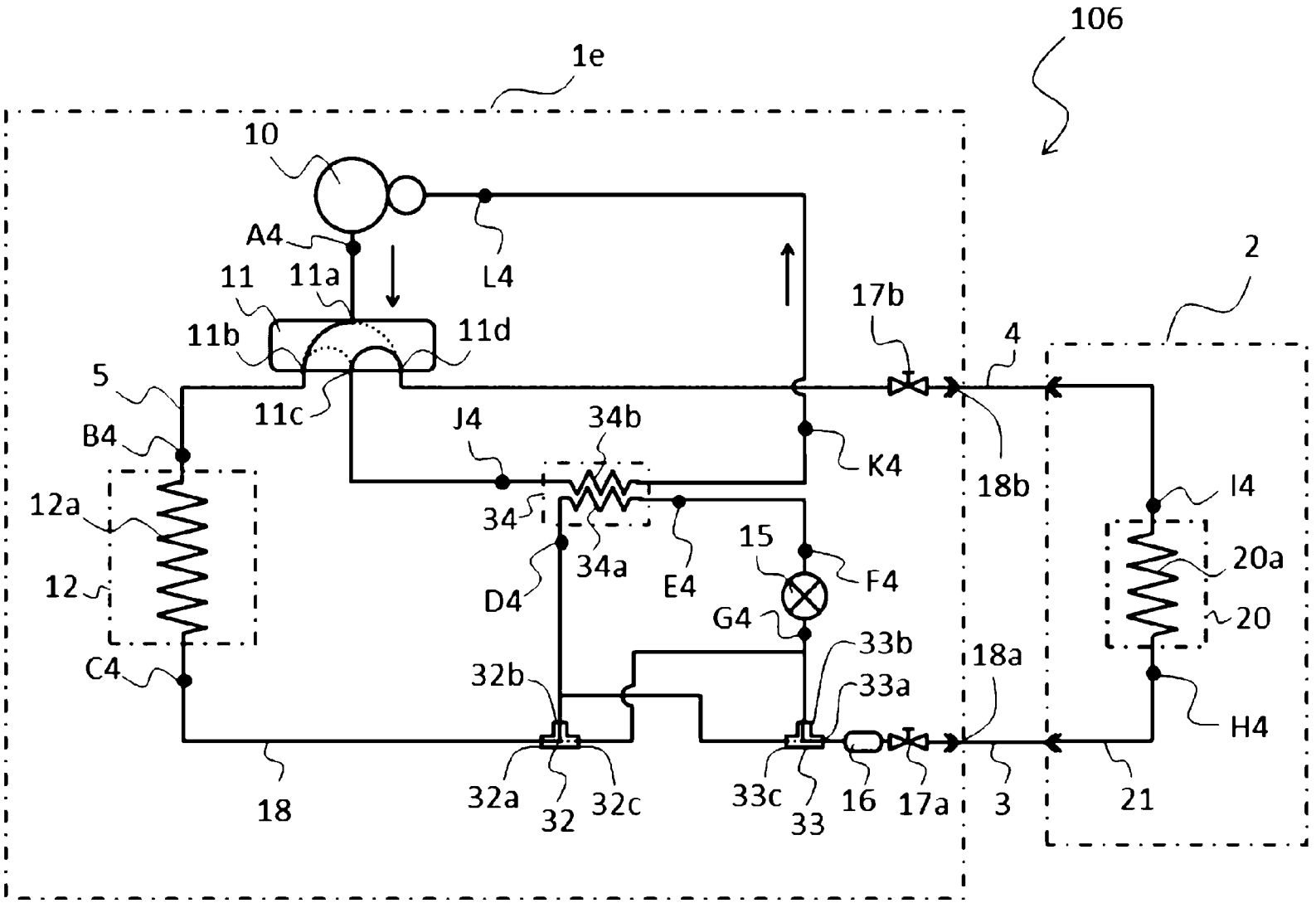
FIG. 18 is a refrigerant circuit diagram of an air conditioning apparatus according to an embodiment IV.

FIG. 18 is a refrigerant circuit diagram of the air conditioning apparatus according to the embodiment IV. The outdoor unit 1*e* includes the compressor 10, the four-way valve 11, the outdoor heat exchanger 12, the expansion valve 15, the strainer 16, two shutoff valves 17, the first three-way valve 32, the second three-way valve 33, and a refrigerant-to-refrigerant heat exchanger 34 inside a housing, and these components are connected to each other by the outdoor unit refrigerant piping 18. Incidentally, since the compressor 10, the four-way valve 11, the outdoor heat exchanger 12, the expansion valve 15, the strainer 16, and the two shutoff valves 17 according to the embodiment IV are substantially the same as the components with the same reference signs according to the embodiment I except for a connection relationship between some components, a description thereof will be omitted.

The first three-way valve 32 switches between the first refrigerant circuit 5*a* and the second refrigerant circuit 5*b*. Specifically, the first three-way valve 32 includes a total of three ports, namely, a fifth port 32*a*, a sixth port 32*b*, and a seventh port 32*c*. The fifth port 32*a* is connected to the other end portion of the outdoor heat exchanger flow path 12*a* via the outdoor unit refrigerant piping 18. The sixth port 32*b* is connected to one end portion of a high-temperature-side flow path 34*a* to be described later via the outdoor unit refrigerant piping 18. The seventh port 32*c* is connected to the outdoor unit refrigerant piping 18, which connects the expansion valve 15 and the ninth port 33*b* to be described later, via the outdoor unit refrigerant piping 18.

The second three-way valve 33 switches between the first refrigerant circuit 5*a* and the second refrigerant circuit 5*b*. Specifically, the second three-way valve 33 includes a total of three ports, namely, an eighth port 33*a*, a ninth port 33*b*, and a tenth port 33*c*. The eighth port 33*a* is connected to one end portion of the indoor heat exchanger flow path 20*a* via the outdoor unit refrigerant piping 18, the strainer 16, the first shutoff valve 17*a*, the first connection refrigerant piping 3, and the indoor unit refrigerant piping 21. The ninth port 33*b* is connected to the expansion valve 15 via the outdoor unit refrigerant piping 18. The tenth port 33*c* is connected to the outdoor unit refrigerant piping 18, which connects the sixth port 32*b* and the one end portion of the high-temperature-side flow path 34*a* to be described later, via the outdoor unit refrigerant piping 18.

The high-temperature-side flow path 34*a* and a low-temperature-side flow path 34*b* are formed in the refrigerant-to-refrigerant heat exchanger 34. The refrigerant-to-refrigerant heat exchanger 34 makes heat exchange to be conducted between the refrigerant passing through the high-temperature-side flow path 34*a* and the refrigerant passing through the low-temperature-side flow path 34*b*. The other end portion of the high-temperature-side flow path 34*a* is connected to the expansion valve 15 via the outdoor unit refrigerant piping 18. One end portion of the low-temperature-side flow path 34*b* is connected to the third port 11*c* of the four-way valve 11 via the outdoor unit refrigerant piping 18. Further, the other end portion of the low-temperature-side flow path 34*b* is connected to the suction port of the compressor 10 via the outdoor unit refrigerant piping 18.

Figure 19:
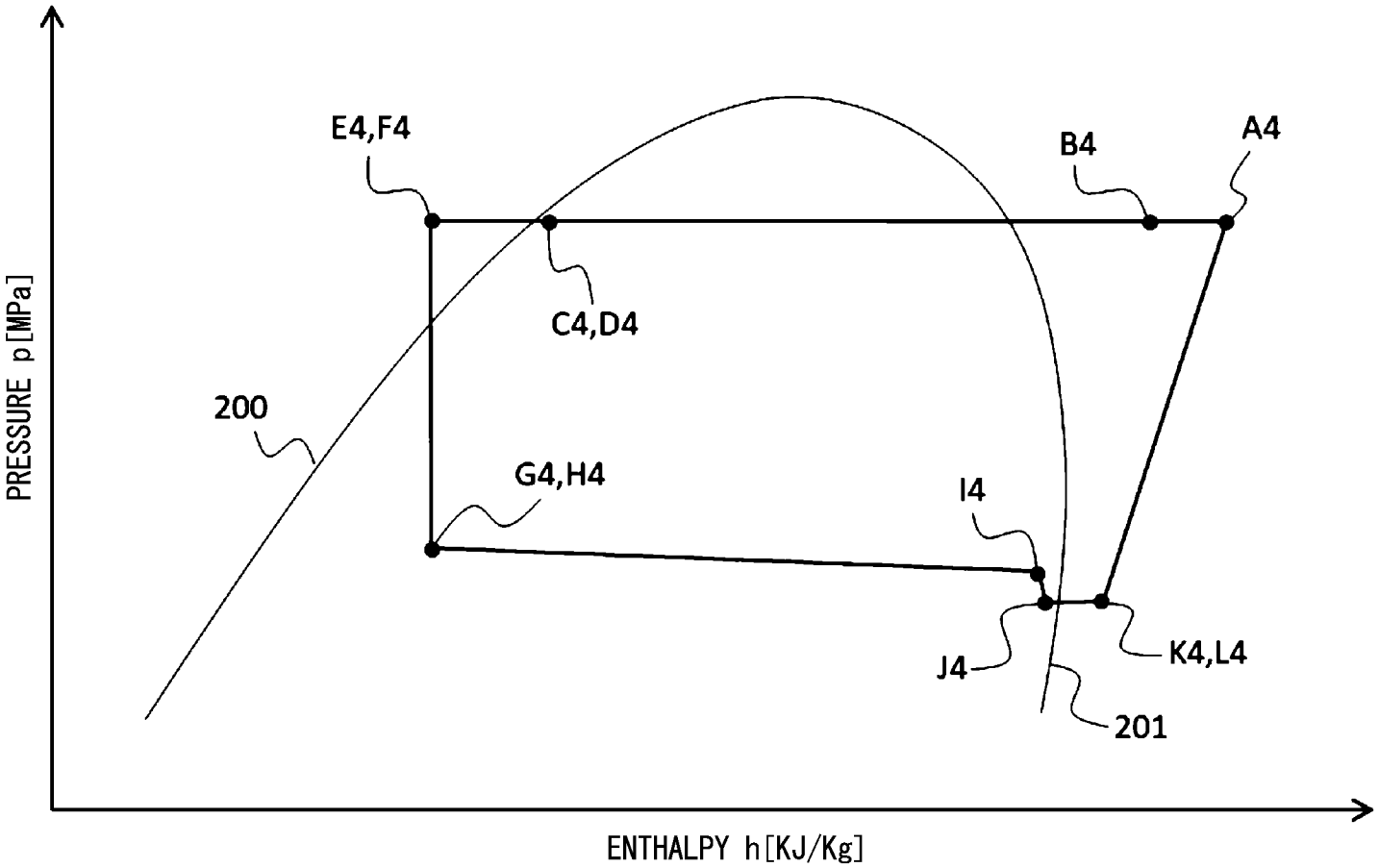
FIG. 19 is a pressure-enthalpy diagram showing a refrigeration cycle in a first refrigerant circuit of the air conditioning apparatus according to the embodiment IV.

FIG. 19 is a pressure-enthalpy diagram showing a refrigeration cycle in a first refrigerant circuit of the air conditioning apparatus according to the embodiment IV. Next, a flow of the refrigerant circulating in the first refrigerant circuit 5*a* during cooling operation will be described. In the first refrigerant circuit 5*a*, the four-way valve 11, the first three-way valve 32, and the second three-way valve 33 switch to a flow path showed a solid line in FIG. 17.

Namely, in the first refrigerant circuit 5*a*, the four-way valve 11 is in a state where the first port 11*a* and the second port 11*b* are connected to each other and the third port 11*c* and the fourth port 11*d* are connected to each other. In the first refrigerant circuit 5*a*, the first three-way valve 32 is in a state where the fifth port 32*a* and the sixth port 32*b* are connected and the seventh port 32*c* is closed. Further, in the first refrigerant circuit 5*a*, the second three-way valve 33 is in a state where the eighth port 33*a* and the ninth port 33*b* are connected to each other and the tenth port 33*c* is closed. Incidentally, the state of the refrigerant showed by A4-L4 in FIG. 19 corresponds to the state of the refrigerant in A4-L4 of the refrigerant circuit of the air conditioning apparatus 106 showed in FIG. 18.

First, similar to the embodiment I, the refrigerant in a high-temperature and high-pressure gas state (A4) which has been discharged from the compressor 10 flows into the outdoor heat exchanger flow path 12*a* (B4). Since the outdoor heat exchanger 12 functions as a condenser similar to the embodiment I, the refrigerant in a high-pressure gas-liquid two-phase state flows out from the outdoor heat exchanger flow path 12*a* (C4).

The refrigerant that has flowed out from the outdoor heat exchanger flow path 12*a* flows into the high-temperature-side flow path 34*a* (D4). The refrigerant in a high-pressure gas-liquid two-phase state passing through the high-temperature-side flow path 34*a* is cooled by the refrigerant passing through the low-temperature-side flow path 34*b*. The cooled refrigerant goes into a high-pressure liquid state, and flows out from the high-temperature-side flow path 34*a* (E4).

The refrigerant in a liquid state which has flowed out from the high-temperature-side flow path 34*a* flows into the expansion valve 15 (F4), goes into a low-pressure gas-liquid two-phase state, and flows out from the expansion valve 15 (G4). The refrigerant that has flowed out from the expansion valve 15 flows into the indoor heat exchanger flow path 20*a* (H4). Since the indoor heat exchanger 20 functions as an evaporator similar to the embodiment I, the refrigerant in a gas-liquid two-phase state which has a higher enthalpy and a lower pressure than the refrigerant immediately before flowing into the indoor heat exchanger flow path 20*a* flows out from the indoor heat exchanger flow path 20*a* (14).

The refrigerant that has flowed out from the indoor heat exchanger flow path 20*a* flows into the low-temperature-side flow path 34*b* (J4). The refrigerant in a gas-liquid two-phase state passing through the low-temperature-side flow path 34*b* is heated into a low-pressure gas state by the refrigerant passing through the high-temperature-side flow path 34*a*, and the refrigerant in a low-pressure gas state flows out from the low-temperature-side flow path 34*b* (K4). The refrigerant that has flowed out from the low-temperature-side flow path 34*b* is suctioned into the suction port of the compressor 10 (L4), and is discharged again in a high-temperature and high-pressure gas state (A4).

Figure 20:
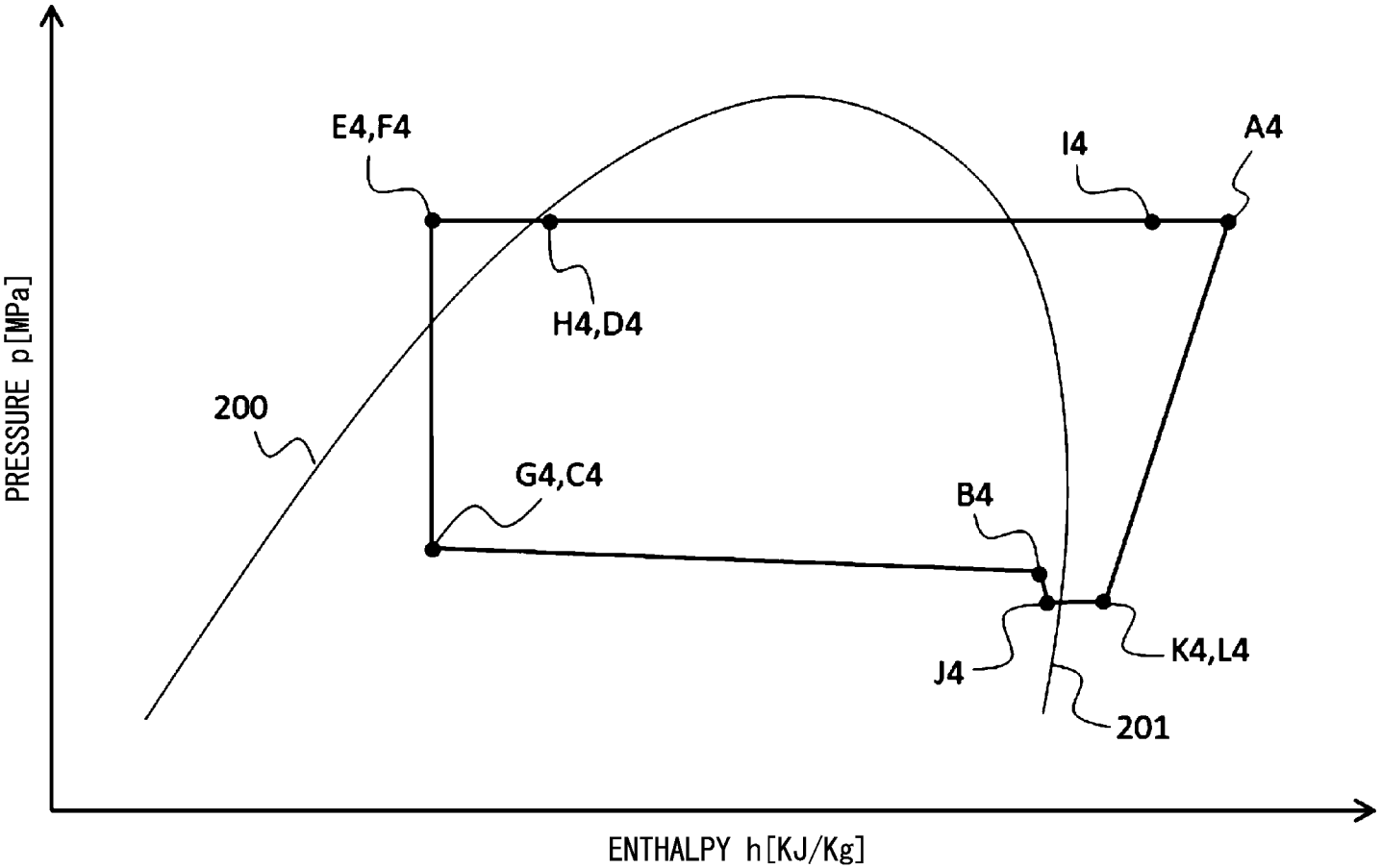
FIG. 20 is a pressure-enthalpy diagram showing a refrigeration cycle in a second refrigerant circuit of the air conditioning apparatus according to the embodiment IV.

FIG. 20 is a pressure-enthalpy diagram showing a refrigeration cycle in a second refrigerant circuit of the air conditioning apparatus according to the embodiment IV. Next, a flow of the refrigerant circulating in the second refrigerant circuit 5*b* during heating operation will be described. In the second refrigerant circuit 5*b*, the four-way valve 11, the first three-way valve 32, and the second three-way valve 33 switch to a flow path showed by a dotted line in FIG. 18. Namely, in the second refrigerant circuit 5*b*, the four-way valve 11 is in a state where the first port 11*a* and the fourth port 11*d* are connected to each other and the second port 11*b* and the third port 11*c* are connected to each other. In the second refrigerant circuit 5*b*, the first three-way valve 32 is in a state where the fifth port 32*a* and the seventh port 32*c* are connected and the sixth port 32*b* is closed. Further, in the second refrigerant circuit 5*b*, the second three-way valve 33 is in a state where the eighth port 33*a* and the tenth port 33*c* are connected to each other and the ninth port 33*b* is closed. Incidentally, the state of the refrigerant showed by A4-L4 in FIG. 20 corresponds to the state of the refrigerant in A4-L4 of the refrigerant circuit of the air conditioning apparatus 106 showed in FIG. 18.

First, similar to the embodiment I, the refrigerant in a high-temperature and high-pressure gas state (A4) which has been discharged from the compressor 10 flows into the indoor heat exchanger flow path 20*a* (14). Since the indoor heat exchanger 20 functions as a condenser similar to the embodiment I, the refrigerant in a high-pressure gas-liquid two-phase state flows out from the indoor heat exchanger flow path 20*a* (H4).

The refrigerant that has flowed out from the indoor heat exchanger flow path 20*a* flows into the high-temperature-side flow path 34*a* (D4). The refrigerant in a high-pressure gas-liquid two-phase state passing through the high-temperature-side flow path 34*a* is cooled by the refrigerant passing through the low-temperature-side flow path 34*b*. The cooled refrigerant goes into a high-pressure liquid state, and flows out from the high-temperature-side flow path 34*a* (E4).

The refrigerant in a liquid state which has flowed out from the high-temperature-side flow path 34*a* flows into the expansion valve 15 (F4), goes into a low-pressure gas-liquid two-phase state, and flows out from the expansion valve 15 (G4). The refrigerant that has flowed out from the expansion valve 15 flows into the outdoor heat exchanger flow path 12*a* (C4). Since the outdoor heat exchanger 12 functions as an evaporator similar to the embodiment I, the refrigerant in a gas-liquid two-phase state which has a higher enthalpy and a lower pressure than the refrigerant immediately before flowing into the outdoor heat exchanger flow path 12*a* flows out from the outdoor heat exchanger flow path 12*a* (B4).

The refrigerant that has flowed out from the outdoor heat exchanger flow path 12*a* flows into the low-temperature-side flow path 34*b* (J4). The refrigerant in a gas-liquid two-phase state passing through the low-temperature-side flow path 34*b* is heated into a low-pressure gas state by the refrigerant passing through the high-temperature-side flow path 34*a*, and the refrigerant in a low-pressure gas state flows out from the low-temperature-side flow path 34*b* (K4). The refrigerant that has flowed out from the low-temperature-side flow path 34*b* is suctioned into the suction port of the compressor 10 (L4), and is discharged again in a high-temperature and high-pressure gas state (A3).

As described above, the air conditioning apparatus 106 according to the embodiment IV includes the refrigerant-to-refrigerant heat exchanger 34 that makes heat exchange to be conducted between the refrigerant flowing from the heat exchanger functioning as a condenser to the expansion valve 15 and the refrigerant flowing from the heat exchanger functioning as an evaporator to the compressor 10 in both the first refrigerant circuit 5*a* and the second refrigerant circuit 5*b*.

In the air conditioning apparatus 106 according to the embodiment IV, the refrigerant flowing from the heat exchanger functioning as a condenser to the refrigerant-to-refrigerant heat exchanger 34 is in a gas-liquid two-phase state in both the first refrigerant circuit 5*a* and the second refrigerant circuit 5*b*.

In the air conditioning apparatus 106 according to the embodiment IV, the refrigerant flowing from the refrigerant-to-refrigerant heat exchanger 34 to the expansion valve 15 is in a liquid state in both the first refrigerant circuit 5*a* and the second refrigerant circuit 5*b*.

In the air conditioning apparatus 106 according to the embodiment IV, in the first refrigerant circuit 5*a*, the flow path switching device (corresponding to the four-way valve 11, the first three-way valve 32, and the second three-way valve 33) connects the discharge port of the compressor 10 and the outdoor heat exchanger flow path 12*a*, the outdoor heat exchanger flow path 12*a* and the high-temperature-side flow path 34*a*, the expansion valve 15 and the indoor heat exchanger flow path 20*a*, and the indoor heat exchanger flow path 20*a* and the low-temperature-side flow path 34*b* with each other. Further, in the air conditioning apparatus 106 according to the embodiment IV, in the second refrigerant circuit 5*b*, the flow path switching device connects the discharge port of the compressor 10 and the indoor heat exchanger flow path 20*a*, the indoor heat exchanger flow path 20*a* and the high-temperature-side flow path 34*a*, the expansion valve 15 and the outdoor heat exchanger flow path 12*a*, and the outdoor heat exchanger flow path 12*a* and the low-temperature-side flow path 34*b* with each other.

As described above, similar to the air conditioning apparatus 100 according to the embodiment I, the air conditioning apparatus 106 according to the embodiment IV also includes the cooler (corresponding to the refrigerant-to-refrigerant heat exchanger 34) that cools the refrigerant. The flow path switching device (corresponding to the four-way valve 11, the first three-way valve 32, and the second three-way valve 33) of the air conditioning apparatus 106 switches between the first refrigerant circuit 5*a* and the second refrigerant circuit 5*b*. In the first refrigerant circuit 5*a*, the refrigerant circulates in order of the compressor 10, the heat source-side heat exchanger (corresponding to the outdoor heat exchanger 12), the cooler (corresponding to the refrigerant-to-refrigerant heat exchanger 34), the pressure-reducing device (corresponding to the expansion valve 15), the load-side heat exchanger (corresponding to the indoor heat exchanger 20), and the compressor 10. In the second refrigerant circuit 5*b*, the refrigerant circulates in order of the compressor 10, the load-side heat exchanger, the cooler (corresponding to the second refrigerant-to-refrigerant heat exchanger 31), the pressure-reducing device, the heat source-side heat exchanger, and the compressor 10. Therefore, with this configuration, the air conditioning apparatus 106 according to the embodiment IV also has the same effect as the effect described in the embodiment I.

Further, as an additional configuration, in the air conditioning apparatus 106 according to the embodiment IV, the flow path switching device connects: the discharge port of the compressor 10 and the heat source-side heat exchanger; the heat source-side heat exchanger and the cooler; the pressure-reducing device and the load-side heat exchanger; and the load-side heat exchanger and the suction port of the compressor with each other in the first refrigerant circuit 5*a*, and to connect: the discharge port of the compressor 10 and the load-side heat exchanger; the load-side heat exchanger and the cooler; the pressure-reducing device and the heat source-side heat exchanger; and the heat source-side heat exchanger and the suction port of the compressor 10 with each other in the second refrigerant circuit 5*b*. With this additional configuration, in the air conditioning apparatus according to the embodiment IV, the number of the mounted coolers can be reduced.

Further, as an additional configuration, in the air conditioning apparatus 106 according to the embodiment IV, the high-temperature-side flow path 34*a* and the low-temperature-side flow path 34*b* are formed in the cooler. Heat exchange is conducted between the refrigerant passing through the high-temperature-side flow path 34*a* and the refrigerant passing through the low-temperature-side flow path 34*b*. The flow path switching device connects: the discharge port of the compressor 10 and the heat source-side heat exchanger; the heat source-side heat exchanger and the high-temperature-side flow path 34*a*; the pressure-reducing device and the load-side heat exchanger; and the load-side heat exchanger and the low-temperature-side flow path 34*b* with each other in the first refrigerant circuit 5*a*, and to connect: the discharge port of the compressor 10 and the load-side heat exchanger; the load-side heat exchanger and the high-temperature-side flow path 34*a*; the pressure-reducing device and the heat source-side heat exchanger; and the heat source-side heat exchanger and the low-temperature-side flow path 34*b* with each other in the second refrigerant circuit 5*b*. With this additional configuration, in the air conditioning apparatus according to the embodiment IV, the lengths of the first refrigerant circuit and the second refrigerant circuit are shorter than those in the structure of the air conditioning apparatus according to the embodiment II, so that the refrigerant amount can be further reduced.

Similar to the outdoor unit 1 according to the embodiment I, the outdoor unit 1*e* according to the embodiment IV also includes the compressor 10; the pressure-reducing device (corresponding to the expansion valve 15); the heat source-side heat exchanger (corresponding to the outdoor heat exchanger 12); the cooler (corresponding to the refrigerant-to-refrigerant heat exchanger 34) that cools the refrigerant; the flow path switching device (corresponding to the four-way valve 11, the first three-way valve 32, and the second three-way valve 33); the first piping connection portion 18*a* connected to one end portion of the load-side heat exchanger flow path (corresponding to the indoor heat exchanger flow path 20*a*), which is formed in the load-side heat exchanger (corresponding to the indoor heat exchanger 20) that makes heat exchange to be conducted between the refrigerant and the load-side heat medium, via the piping (corresponding to the first connection refrigerant piping 3); and the second piping connection portion 18*b* connected to the other end portion of the load-side heat exchanger flow path via the piping (corresponding to the second connection refrigerant piping 4). The flow path switching device switches between the first refrigerant circuit and the second refrigerant circuit. In the first refrigerant circuit, the refrigerant flows in order of the second piping connection portion 18*b*, the compressor 10, the heat source-side heat exchanger, the cooler, the pressure-reducing device, and the first piping connection portion 18*a*. In the second refrigerant circuit, the refrigerant flows in order of the first piping connection portion 18*a*, the cooler, the pressure-reducing device, the heat source-side heat exchanger, the compressor, and the second piping connection portion 18*b*. Therefore, with this configuration, the outdoor unit 1*e* according to the embodiment IV also has the same effect as the effect described in the embodiment I.

What is claimed is:

1. An air conditioning apparatus comprising:

a compressor that compresses a refrigerant;

a pressure-reducing valve that reduces a pressure of the refrigerant;

a heat source-side heat exchanger that makes heat exchange to be conducted between the refrigerant and a heat source-side heat medium;

a load-side heat exchanger that makes heat exchange to be conducted between the refrigerant and a load-side heat medium;

first and second refrigerant-to-refrigerant heat exchangers that cool the refrigerant;

a flow path switching valve that switches a refrigerant circuit in which the refrigerant circulates; and a refrigerant piping that connects the compressor, the pressure-reducing valve, the heat source-side heat exchanger, the load-side heat exchanger, the first and second refrigerant-to-refrigerant heat exchangers, and the flow path switching valve, wherein a high-temperature-side flow path and a low-temperature-side flow path are formed in the first and second refrigerant-to-refrigerant heat exchangers, the high-temperature-side flow path includes a first high-temperature-side flow path and a second high-temperature-side flow path, the low-temperature-side flow path includes a first low-temperature-side flow path and a second low-temperature-side flow path, heat exchange is conducted between the refrigerant passing through the first high-temperature-side flow path and the refrigerant passing through the first low-temperature-side flow path, and heat exchange is conducted between the refrigerant passing through the second high-temperature-side flow path and the refrigerant passing through the second low-temperature-side flow path, the flow path switching valve switches between a first flow direction in which the refrigerant circulates in order of the compressor, the heat source-side heat exchanger, the first high-temperature-side flow path, the pressure-reducing valve, the load-side heat exchanger, the first low-temperature-side flow path, and the compressor, and a second flow direction in which the refrigerant circulates in order of the compressor, the load-side heat exchanger, the second high-temperature-side flow path, the pressure-reducing valve, the heat source-side heat exchanger, the second low-temperature-side flow path, and the compressor, wherein in the first flow direction, an inlet port of the first high-temperature-side flow path is formed at a place located downstream of the refrigerant flowing through the first low-temperature-side flow path with respect to an outlet port of the first high-temperature-side flow path, and in the second flow direction, an inlet port of the second high-temperature-side flow path is formed at a place located downstream of the refrigerant flowing through the second low-temperature-side flow path with respect to an outlet port of the second high-temperature-side flow path.

2. The air conditioning apparatus according to claim 1, wherein the refrigerant flowing from the heat source-side heat exchanger to the first high-temperature-side flow path in the first flow direction is in a gas-liquid two-phase state, and the refrigerant flowing from the load-side heat exchanger to the second high-temperature-side flow path in the second flow direction is in a gas-liquid two-phase state.

3. The air conditioning apparatus according to claim 1, wherein the refrigerant flowing from the first high-temperature-side flow path to the pressure-reducing valve in the first flow direction is in a liquid state, and the refrigerant flowing from the second high-temperature-side flow path to the pressure-reducing valve in the second flow direction is in a liquid state.

4. The air conditioning apparatus according to claim 1, wherein in the first flow direction, the refrigerant circulates in order of the compressor, the heat source-side heat exchanger, the first high-temperature-side flow path, the pressure-reducing valve, the second high-temperature-side flow path, the load-side heat exchanger, the first low-temperature-side flow path and the second low-temperature-side flow path, and the compressor, and in the second flow direction, the refrigerant circulates in order of the compressor, the load-side heat exchanger, the second high-temperature-side flow path, the pressure-reducing valve, the first high-temperature-side flow path, the heat source-side heat exchanger, the first low-temperature-side flow path and the second low-temperature-side flow path, and the compressor.

5. The air conditioning apparatus according to claim 1, wherein in the first flow direction, a flow direction of the refrigerant flowing through the first high-temperature-side flow path is opposite to a flow direction of the refrigerant flowing through the first low-temperature-side flow path, and in the second flow direction, a flow direction of the refrigerant flowing through the second high-temperature-side flow path is opposite to a flow direction of the refrigerant flowing through the second low-temperature-side flow path.

6. The air conditioning apparatus according to claim 1, wherein the first and second refrigerant-to-refrigerant heat exchangers include a first piping forming the low-temperature-side flow path and a second piping forming the high-temperature-side flow path, the second piping being spirally wound around the first piping.

7. The air conditioning apparatus according to claim 1, wherein the refrigerant is a flammable refrigerant.

8. The air conditioning apparatus according to claim 1, wherein the refrigerant is R290.

9. The air conditioning apparatus according to claim 5, wherein a chiller oil of the compressor is polyalkylene glycol.

10. An outdoor unit comprising:

a compressor that compresses a refrigerant;

a pressure-reducing valve that reduces a pressure of the refrigerant;

a heat source-side heat exchanger that makes heat exchange to be conducted between the refrigerant and a heat source-side heat medium;

first and second refrigerant-to-refrigerant heat exchangers that cool the refrigerant;

a flow path switching valve that switches a refrigerant circuit in which the refrigerant circulates;

a refrigerant piping that connects the compressor, the pressure-reducing valve, the heat source-side heat exchanger, the first and second refrigerant-to-refrigerant heat exchangers, and the flow path switching valve;

a first piping connection portion connected to one end portion of a load-side heat exchanger flow path via a piping, the load-side heat exchanger flow path being formed in a load-side heat exchanger that makes heat exchange to be conducted between the refrigerant and a load-side heat medium; and a second piping connection portion connected to the other end portion of the load-side heat exchanger flow path via a piping, wherein a high-temperature-side flow path and a low-temperature-side flow path are formed in the first and second refrigerant-to-refrigerant heat exchangers, the high-temperature-side flow path includes a first high-temperature-side flow path and a second high-temperature-side flow path, the low-temperature-side flow path includes a first low-temperature-side flow path and a second low-temperature-side flow path, heat exchange is conducted between the refrigerant passing through the first high-temperature-side flow path and the refrigerant passing through the first low-temperature-side flow path, and heat exchange is conducted between the refrigerant passing through the second high-temperature-side flow path and the refrigerant passing through the second low-temperature-side flow path, wherein the flow path switching valve switches between a first flow direction and a second flow direction, the first flow direction that flows the refrigerant in order of the compressor, the heat source-side heat exchanger, the first high-temperature-side flow path, the pressure-reducing valve, and the first piping connection portion, the second piping connection portion, and the first low-temperature-side flow path, and the second flow direction that flows the refrigerant in order of the second piping connection portion, the first piping connection portion, the second high-temperature-side flow path, the pressure-reducing valve, the heat source-side heat exchanger, the second low-temperature-side flow path, and the compressor, wherein in the first flow direction, an inlet port of the first high-temperature-side flow path is formed at a place located downstream of an outlet port of the first high-temperature-side flow path with respect to the refrigerant flowing through the first low-temperature-side flow path, and in the second flow direction, an inlet port of the second high-temperature-side flow path is formed at a place located downstream of an outlet port of the second high-temperature-side flow path with respect to the refrigerant flowing through the second low-temperature-side flow path.

* * * * *